US007156509B2

(12) United States Patent
Matsushita et al.

(10) Patent No.: US 7,156,509 B2
(45) Date of Patent: Jan. 2, 2007

(54) IMAGE FORMING APPARATUS

(75) Inventors: Masaki Matsushita, Ikoma-gun (JP); Hirokazu Nakamura, Nara (JP); Naozumi Ueno, Ikoma (JP); Hisashi Yoshimura, Nara (JP); Takashi Gotoh, Nara (JP); Akio Matsumoto, Nara (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 267 days.

(21) Appl. No.: 10/767,750

(22) Filed: Jan. 28, 2004

(65) Prior Publication Data

US 2004/0218026 A1 Nov. 4, 2004

(30) Foreign Application Priority Data

Jan. 29, 2003 (JP) ..... 2003-020878
Jan. 29, 2003 (JP) ..... 2003-020912

(51) Int. Cl.
*B41J 2/175* (2006.01)

(52) U.S. Cl. ..... 347/85; 347/93

(58) Field of Classification Search ..... 347/85, 347/86, 87, 92, 93
See application file for complete search history.

(56) References Cited

U.S. PATENT DOCUMENTS 4,689,641 A * 8/1987 Scardovi et al. ..... 347/68
4,719,479 A * 1/1988 Kyogoku ..... 347/93
5,481,289 A * 1/1996 Arashima et al. ..... 347/93
5,565,899 A * 10/1996 Sugimoto et al. ..... 347/30
6,158,855 A * 12/2000 Saikawa ..... 347/93

FOREIGN PATENT DOCUMENTS

| | | |
|---|---|---|
| JP | 3-288654 | 12/1991 |
| JP | 8-230209 | 9/1996 |
| JP | 10-193634 | 7/1998 |
| JP | 2001-219583 | 8/2001 |

* cited by examiner

*Primary Examiner*—Anh T. N. Vo
(74) *Attorney, Agent, or Firm*—George W. Neuner; David G. Conlin; Edwards Angell Palmer & Dodge LLP

(57) ABSTRACT

An image forming apparatus includes an ink tank; and an ink supplying path for supplying the ink from the ink tank to a print head, wherein the ink supplying path therein includes a filter, which generates negative pressure when the ink is supplied, the negative pressure being smaller than ink absorbing pressure of a nozzle of the print head. Further, the ink tank therein includes, for example, a porous ink absorbing body for retaining ink. The image forming apparatus satisfies:

$$F' < 1/(N \cdot R)$$

where F(m) expresses a filtration accuracy of the filter; N (cells/m) expresses a cell density of the ink absorbing body before the ink absorbing body is contained in the ink tank; and R expresses a compressibility, which is a volume ratio of the ink absorbing body when the ink absorbing body is contained in a compressed state in the ink tank to the ink absorbing body before the ink absorbing body is contained in the ink tank, on condition that: F'=F when an opening of the filter is circle; $F' = \sqrt{2} \cdot F$ in other cases.

20 Claims, 25 Drawing Sheets

$$Rd = \int_0^X \frac{1}{\left\{ 2\sqrt{(dm/2)^2 - X^2} \right\}^4} \, dX$$

$$Rm = \int_0^X \frac{1}{dm^4} \, dX$$

$$Pt = 4\eta\cos\theta / d$$

$Pt = 4\eta / d$

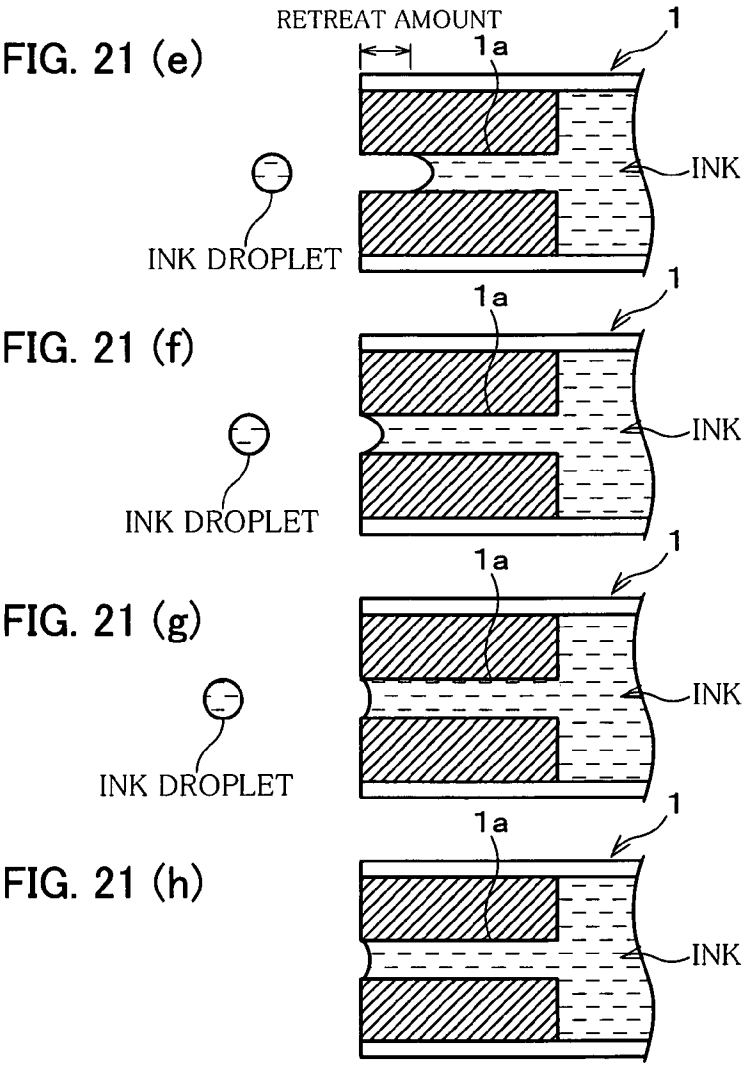
FIG. 21 (e)
FIG. 21 (f)
FIG. 21 (g)
FIG. 21 (h)
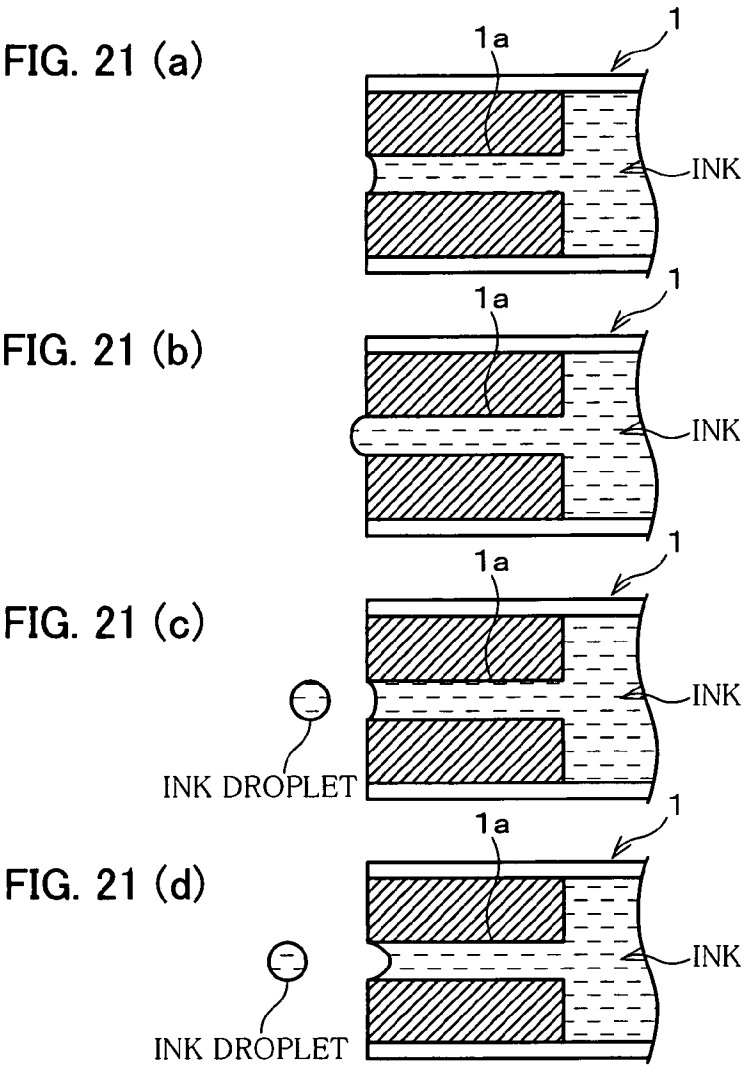
FIG. 21 (a)
FIG. 21 (b)
FIG. 21 (c)
FIG. 21 (d)

IMAGE FORMING APPARATUS

This Nonprovisional application claims priority under 35 U.S.C. § 119(a) on Patent Application No. 2003/020912 and No. 20878/2003 filed in Japan on Jan. 29, 2003, the entire contents of which are hereby incorporated by reference.

FIELD OF THE INVENTION

The present invention relates to an image forming apparatus including an ink containing section for storing ink, and in particular to an inkjet recording apparatus as an image forming apparatus.

BACKGROUND OF THE INVENTION

An inkjet recording apparatus, which operates as an image forming apparatus, carries out printing by discharging ink on a paper recording sheet. The inkjet recording apparatus generally includes an ink cartridge with an ink tank from which the ink is supplied to a print head, and the print head then discharges ink to the sheet.

In such an inkjet recording apparatus, several strategies have been attempted for dealing with a problem of inadequate discharge of the ink, which is caused by air entering into the ink supplying system before the ink is depleted. The strategies have been realized by providing an ink absorbing body or a filter etc.

One example of such strategies can be found in Japanese Laid-Open Patent Application Tokukai 2001-219583/(published on Aug. 14, 2001, hereinafter referred to as Document 1), which discloses an ink cartridge including a filter for capturing air. The filter, whose practical transmission size is 8 μm, is provided in a lower portion of the stream than the ink absorbing body. The ink cartridge also includes a recovering means for applying absorbing pressure, in which the level of the pressure is specified to prevent air from passing through the filter.

Incidentally, the inkjet recording apparatus requires user to change the ink cartridge when the ink cartridge runs out of ink. Thus, the inkjet recording apparatus has to have a function for detecting the remaining amount of ink in the ink cartridge and for informing the user the detection result.

In view of this function, there have been suggested several ink cartridges capable of detecting the remaining amount of ink. One common example of such an ink cartridge uses an optical ink level sensor, which is capable of informing the user that the ink is depleted. This information is provided before the ink supplying system absorbs air. The optical sensor can be provided in a form of electrodes in terms of cost reduction. For example, Japanese Laid-Open Patent Application Tokukaihei 03-288654/1991 (published on Dec. 18, 1991 hereinafter referred to as Document 2) discloses an ink cartridge in which an ink absorbing body (foam material) for absorbing ink is provided inside the ink tank, and an ink supplying path for connecting the ink tank and a print head includes a filter. The ink cartridge has the electrodes in a lower portion in the stream than the filter, i.e., near the discharge end of the ink supplying path, so as to detect if there is any ink remaining in the ink supplying path.

In this inkjet recording apparatus, the ink is supplied from the ink cartridge to the print head via the filter by applying negative pressure with respect to the print head (ink discharging end). Then, depletion of ink in the ink supplying path is detected by checking a current flowing between the electrodes. More specifically, when the remaining amount of ink becomes low in the ink cartridge, there is no ink in the ink supplying path and the current flow stops between the electrodes. Then the cutoff of the current flow between the electrodes is detected as an indication that the ink is depleted.

However, the Document 1 does not mention any strategies for preventing air bubbles from passing through the filter upon discharging of ink.

Further, Document 1 takes no account of the characteristic of ink to be absorbed in the ink absorbing body.

Further, as to Document 2, the structure only accepts an ink absorbing body with an N·R not less than 200, and therefore, the material of the ink absorbing body has to be selected from a limited range.

Further, Document 2 neither takes account of the characteristic of ink to be absorbed in the ink absorbing body. Thus, depending on the type of ink, the inkjet recording apparatus may occur some defects, such as insufficient ink supply when the ink is continuously discharged, or leakage of ink when the ink cartridge is inserted or detached.

Further, when the ink is supplied by applying the negative pressure with respect to the print head (ink discharging end) via the filter, and if the negative pressure excessively increases in the lower stream than the filter in the ink supplying path, air enters into the print head through the end of the nozzle of print head, and may cause inadequate discharge of ink. The increase of the negative pressure may also allow air having been captured by the filter to pass through the filter. The air passed through the filter may block the ink supplying path, or may enter into the print head, thus inducing a risk of inadequate discharge. Further, if the air reaches the ink remaining amount detection section, the current flow between the electrodes stops, and the ink remaining amount detection section may mistakenly judges that the ink is depleted. Accordingly, if the pressure for supplying ink becomes larger than the negative pressure applied to the filter, air enters into the ink supplying path even when there is no decreases of ink remaining amount, thus causing error operation in detecting the remaining amount of ink.

However, the foregoing Documents 1 and 2 do not mention any solutions for such problems.

SUMMARY OF THE INVENTION

An object of the present invention is to provide an image forming apparatus capable of preventing entry of air into the ink supplying path due to other factor than a decrease of ink remaining amount. Further, another object of the present invention is to provide an image forming apparatus with an ink supplying system designed to prevent various defects upon continuous discharge of ink, such as entry of air into the ink supplying system before the ink is depleted, an inadequate ink supply, or leakage of ink when the ink cartridge is inserted or detached; more preferably, the ink supplying system is designed with an account of the characteristic of ink. Further, still another object of the present invention is to provide an image forming apparatus allowing a wider range of the ways of designing of an ink absorbing body.

In order to solve the foregoing problems, an image forming apparatus according to the present invention includes: an ink containing section for retaining ink; and an ink supplying path for supplying the ink from the ink containing section to a print head, wherein: the ink supplying path therein includes a filter, which generates negative pressure when the ink is supplied, the negative pressure being smaller than ink absorbing pressure of a nozzle of the print head.

When the ink is supplied to the print head, the pressure by which the print head absorbs the ink, i.e., the pressure (ink absorbing pressure) by the meniscus of the discharge nozzle of the print head is applied to the ink supplying path (filter). Further, when the critical value of the ink absorbing pressure is not more than the negative pressure generated in the filter when the ink is supplied, i.e., the critical pressure (filter pressure) of the meniscus formed on the opening of the filter, particularly, when it is smaller than the critical pressure, air may be sucked into the print head before the meniscus on the opening of the filter breaks.

Accordingly, by adjusting the pressure by the meniscus of the discharge nozzle when the ink is supplied to the print head, i.e., the ink absorbing pressure, to be larger than the filter pressure when the ink is supplied, the ink absorbing force becomes larger than the negative force generated in the filter when the ink is supplied, and also becomes larger than the surface tension of the meniscus on the opening of the filter, so that the ink is absorbed and the meniscus retreats. As a result, the ink is securely supplied (charged) without entry of air into the nozzle end of the print head.

In order to solve the foregoing problems, an image forming apparatus according to the present invention includes: an ink containing section for retaining ink; and an ink supplying path for supplying the ink from the ink containing section to a print head, wherein: the ink supplying path therein includes a filter, which generates a negative pressure of not more than 2.0 kPa, which is applied to the ink supplying path when the ink is supplied.

By thus providing a filter which makes the negative pressure of the ink supply system to be no larger than 2.0 kPa, the pressure (ink absorbing pressure) of the meniscus of the nozzle generated when the ink is supplied becomes larger than the negative pressure generated in the filter when the ink is supplied. Thus, the ink absorbing force becomes larger than the negative force generated in the filter when the ink is supplied, and also becomes larger than the surface tension of the meniscus on the opening of the filter, so that the ink is absorbed and the meniscus retreats. As a result, the ink is securely supplied (charged) without entry of air into the nozzle end of the print head.

In order to solve the foregoing problems, an image forming apparatus according to the present invention includes: an ink containing section for retaining ink; and an ink supplying path for supplying the ink from the ink containing section to a print head, the ink supplying path therein including a filter, wherein: the image forming apparatus satisfies:

$$F'=4\eta/Pm$$

$$Pm \leq 2000$$

($F'=F$ when the opening of the filter is circle; $F'=\sqrt{2}\cdot F$ in other cases)

where F(m) expresses a filtration accuracy of the filter; η (N/m) expresses a surface tension of the ink; and Pm (Pa) expresses a critical pressure of a negative pressure generated in the filter when the ink is supplied.

By thus providing in the ink supplying path a filter which satisfies the foregoing Relational Expression, the negative pressure applied to the ink supplying path when the ink is supplied is adjusted to be no larger than 2.0 kPa, and the pressure (ink absorbing pressure) of the meniscus of the nozzle generated when the ink is supplied becomes larger than the negative pressure generated in the filter when the ink is supplied. Thus, the ink absorbing force by surface tension of the meniscus becomes larger than the negative force, so that the ink is absorbed, and the meniscus moves ahead and charging of ink is carried out. As a result, the ink is securely supplied (charged) without entry of air into the nozzle end of the print head.

In order to solve the foregoing problems, an image forming apparatus according to the present invention includes: an ink containing section therein includes a porous ink absorbing body for retaining ink; and an ink supplying path for supplying the ink from the ink containing section to a print head, the ink supplying path therein including a filter, wherein: the image forming apparatus satisfies:

$$F'<1/(N\cdot R)$$

($F'=F$ when an opening of the filter is circle; $F'=\sqrt{2}\cdot F$ in other cases)

where F(m) expresses a filtration accuracy of the filter; N (cells/m) expresses a cell density of the ink absorbing body before the ink absorbing body is contained in the ink containing section; and R expresses a compressibility, which is a volume ratio of the ink absorbing body when the ink absorbing body is contained in a compressed state in the ink containing section to the ink absorbing body before the ink absorbing body is contained in the ink containing section.

Further, in order to solve the foregoing problems, an image forming apparatus according to the present invention includes: an ink containing section therein includes a porous ink absorbing body for retaining ink; and an ink supplying path for supplying the ink from the ink containing section to a print head, the ink supplying path therein including a filter, wherein: the ink absorbing body being compressed before the ink absorbing body is contained in the ink containing section, and the image forming apparatus satisfies:

$$F'<1/(N'\cdot R')$$

($F'=F$ when the opening of the filter is circle; $F'=\sqrt{2}\cdot F$ in other cases)

where F(m) expresses a filtration accuracy of the filter; N' (cells/m) expresses a cell density of the ink absorbing body before the ink absorbing body is compressed; and R' expresses a compressibility, which is a volume ratio of the ink absorbing body when the ink absorbing body is compressed to the ink absorbing body before the ink absorbing body is compressed.

Thus, with the foregoing arrangements, it is possible to adjust the critical value of the negative pressure generated in the ink absorbing body by the ink surface tension to be smaller than the negative pressure generated in the filter by the ink surface tension, i.e., the critical value of the pressure (filter pressure) of the meniscus of the opening (mesh) of the filter. Thus, it is possible to prevent entry of air into the ink supplying path due to breakage of the meniscus of ink formed on the opening (mesh) of the filter before the ink is depleted. With this arrangement, the meniscus of the ink absorbing body retreats with the consumption of ink, thus securing the ink supplying operation.

In order to solve the foregoing problems, an image forming apparatus according to the present invention includes: an ink containing section including a porous ink absorbing body for retaining ink; and an ink supplying path for supplying the ink from the ink containing section to a print head, wherein: the ink supplying path therein includes a filter, and the image forming apparatus satisfies:

$$4\cdot\eta/F'>|P\mu|+|Pi|$$

$$P\mu=(k/A)\cdot\{\mu_{TK}\cdot L\cdot(N\cdot R)^2/S\}\cdot Q$$

(where the coefficient (k/A)=485)

$$\mu_{TK}=\alpha\cdot\exp(\beta/T_K),$$

$$\alpha=\mu_{25}/\exp(\beta/298),$$

$$\beta=Ln\{0.42\cdot Ln(\mu_{25})+4.71\}/(1/273-1/298)$$

(F'=F when an opening of the filter is circle; $F'=\sqrt{2}\cdot F$ in other cases)

where F(m) expresses a filtration accuracy of the filter; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; S ($m^2$) expresses a cross-sectional area of the ink absorbing body when the ink absorbing body is contained in the ink containing section in a compressed state; L expresses a length (m) of the ink absorbing body when the ink absorbing body is contained in the ink containing section in a compressed state; $\mu_{25}$ (Pa·s) expresses an ink viscosity at 25° C.; and $\mu_{TK}$ (Pa·s) expresses a viscosity at an arbitrary temperature $T_K$ (K).

With the foregoing arrangement, it is possible to adjust the negative pressure generated in the ink absorbing body to be smaller than the critical value of the negative pressure of the ink meniscus in the opening of the filter. Thus, it is possible to prevent entry of air into the ink supplying path due to breakage of ink meniscus formed on the opening of the filter. Accordingly, this structure can prevent entry of air into the ink supplying path by other factor than decreases of ink remaining amount, thus avoiding error operation in detecting the remaining amount of ink. With this function, it is possible to carry out printing with high image quality.

In order to solve the foregoing problems, an image forming apparatus according to the present invention includes: an ink containing section including a porous ink absorbing body for retaining ink; and an ink supplying path for supplying the ink from the ink containing section to a print head, wherein: the ink supplying path therein includes a filter, and the image forming apparatus satisfies:

$$4\cdot\eta/F'>|P\mu|+|Pi|$$

$$P\mu=(k/A)\cdot\{\mu_{TK}\cdot L\cdot(N'\cdot R')^2/S\}\cdot Q$$

(where the coefficient (k/A)=485)

$$\mu_{TK}=\alpha\cdot\exp(\beta/T_K),$$

$$\alpha=\mu_{25}/\exp(\beta/298),$$

$$\beta=Ln\{0.42\cdot Ln(\mu_{25})+4.71\}/(1/273-1/298)$$

(F'=F when an opening of the filter is circle; $F'=\sqrt{2}\cdot F$ in other cases)

where F(m) expresses a filtration accuracy of the filter; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; η (N/m) expresses a surface tension of the ink; N' (cells/m) expresses a cell density of the ink absorbing body before the ink absorbing body is compressed; and R' expresses a compressibility, which is a volume ratio of the ink absorbing body when the ink absorbing body is compressed to the ink absorbing body before the ink absorbing body is compressed; S ($m^2$) expresses a cross-sectional area of the ink absorbing body when the ink absorbing body is contained in the ink containing section in a compressed state; L expresses a length (m) of the ink absorbing body when the ink absorbing body is contained in the ink containing section in a compressed state; $\mu_{25}$ (Pa·s) expresses an ink viscosity at 25° C.; and $\mu_{TK}$ (Pa·s) expresses a viscosity at an arbitrary temperature $T_K$ (K).

With the foregoing arrangement, the ink may be supplied while appropriately controlling the critical value of the pressure of the meniscus in the opening of the filter to be no larger than the critical value of the ink absorbing pressure of the meniscus of the nozzle of the print head. Thus, it is possible to prevent entry of air into the ink supplying path. Also, the critical value of the negative pressure of the ink meniscus in the opening of the filter becomes smaller than the negative pressure generated in the ink absorbing body, thus preventing entry of air into the ink supplying path due to breakage of the meniscus of ink formed on the opening (mesh) of the filter.

Accordingly, in this structure, the air bubbles etc., generated in the ink in the ink containing section due to the other factor than decreases of ink amount, for example, due to carriage vibration, or changes in temperature or atmospheric pressure or the like, is captured by the filter, thus preventing entry of air into the ink supplying path. This function ensures printing with high image quality, as well as efficient consumption of ink.

Further, with the foregoing arrangements, it is possible to provide an image forming apparatus with an ink supplying system designed to prevent defects upon continuous discharge of ink, such as entry of air into the ink supplying system before the ink is depleted.

Further, with the foregoing arrangements, it is possible to set the negative pressure when the ink is supplied (including the time when the ink is supplied due to depletion of ink) by specifying the filtration accuracy F(m) with small variation, thus ensuring more stable negative pressure.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is a cross-sectional view illustrating the ink cartridge of FIG. 1(*a*) in a state where an ink supplying path is detached from the ink cartridge.

FIG. 1(*c*) is a cross-sectional view illustrating a structure of detecting electrodes.

FIG. 2 is a perspective view illustrating an overall structure of the ink jet recording apparatus, with a portion of the ink jet recording apparatus seen through.

FIGS. 21(*a*) to 21(*h*) are cross-sectional views illustrating how the ink is discharged from a nozzle in steps.

DESCRIPTION OF THE EMBODIMENTS

With reference to FIGS. 1 to 27, the following describes one embodiment of the present invention.

Figure 2:
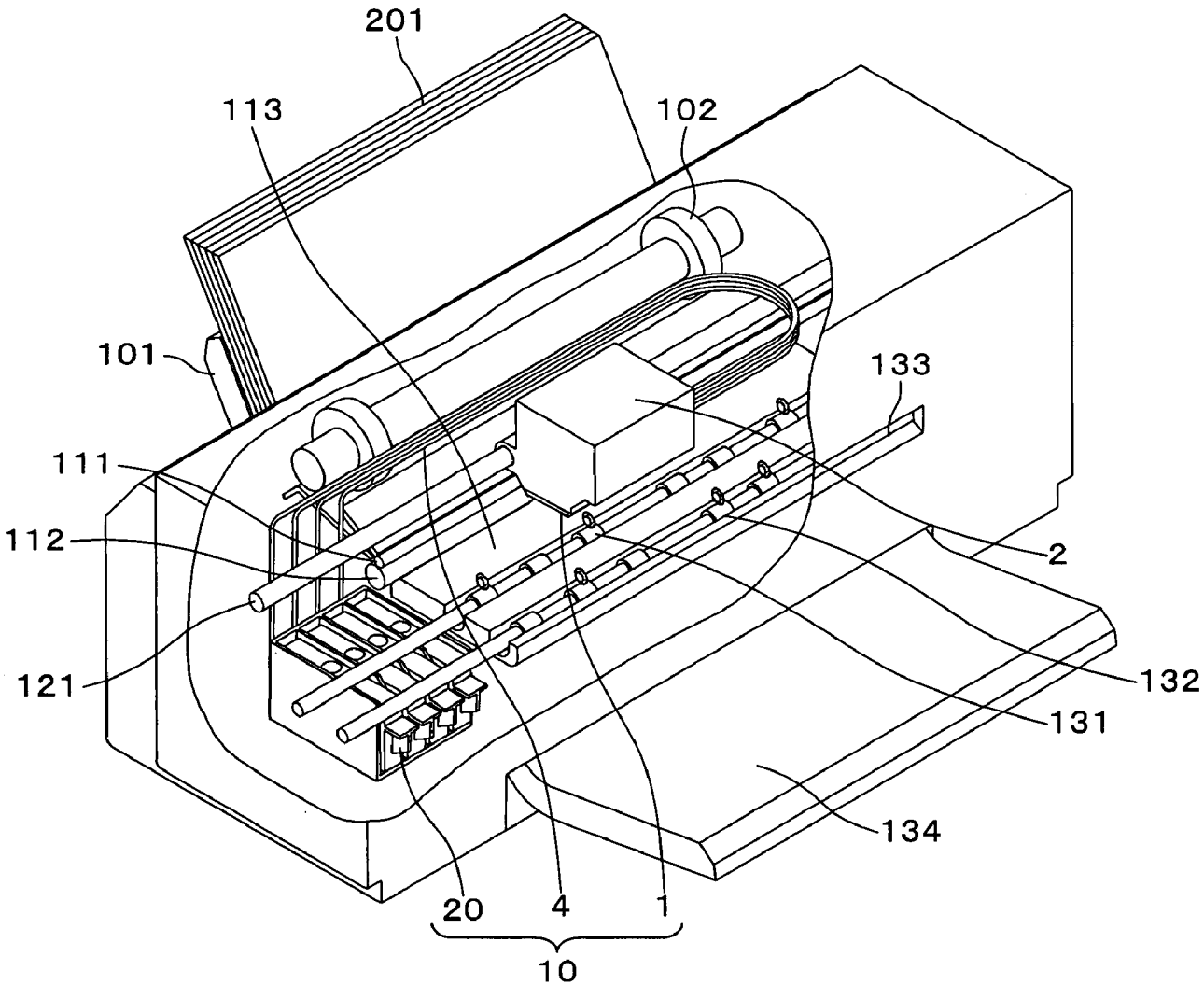

As shown in FIG. 2, an ink jet recording apparatus of the present embodiment functions as an image forming apparatus and includes a feeding section, a separating section, a conveying section, a printing section, and a discharging section.

The feeding section, which includes a feeding tray 101 and a pickup roller 102, feeds a sheet 201 as a recording paper upon printing. When printing is not performed, the feeding section functions as a sheet storage.

The separating section supplies, sheet-by-sheet to the printing section, the sheets 201 fed by the feeding section. The separating section includes a feeding roller and a separator (neither is shown). The separating apparatus is so set that the friction between a sheet 201 and a pad section, which is a point of contact with the sheet, is larger than the friction between the sheets 201. The feeding roller is so set that the friction between the feeding roller and the sheet 201 is larger than the friction between the pad and the sheet 201 or between the sheets 201. As a result, even if two sheets are sent to the separating section, it is possible to separate the sheets 201 and send only the upper sheet to the conveying section.

The conveying section conveys, to the printing section, the sheets 201 supplied sheet-by-sheet by the separating section. The conveying section includes a guiding board (not shown) and a pair of rollers such as a conveying press roller 111 and a conveying roller 112. The roller pair sets the sheet 102 in position when the sheet is being conveyed to the space between a print head 1 and a platen 113, so that the ink supplied by the print head 1 is sprayed onto appropriate positions of the sheet 201.

The printing section performs printing on the sheet 201 supplied by the roller pair of the conveying section. The printing section includes the print head 1, a carriage 2 in which the printer head 1 is installed, a guiding bar 121 for guiding the carriage 2, an ink cartridge 20 for supplying ink to the print head 1, a platen 113 on which the sheet 201 is placed during printing, and an ink supplying path 3 made of an ink supplying tube 4. The ink supplying path 3 made of an ink supplying tube 4 connects the print head 1 and the ink cartridge 20 and supplies ink from the ink cartridge 20 to the print head 1 as an ink runway. The print head 1, the ink cartridge 20, and the ink supplying path 3 made of an ink supplying tube 4 constitute an ink supplying unit 10, which is described later.

The discharging section discharges the sheet 201 out of the ink jet recording apparatus after printing. The discharging section includes discharging rollers 131 and 132 and a discharge tray 134.

The ink jet recording apparatus of the foregoing structure operates as follows to perform printing.

First, the ink jet recording apparatus receives a request for printing from a computer or like apparatus (not shown), the printing request being made according to image information. After receiving the request for printing, the ink jet recording apparatus sends sheets 201 on the feeding tray 101 from the feeding section, using the pickup roller 102.

Next, the sheet 201 that has been sent is conveyed by the feeding roller through the separating section, and is sent to the conveying section. The conveying section conveys the sheet 201 to the space between the print head 1 and the platen 113, using the conveying press roller 111 and the conveying roller 112 making up the roller pair.

In the printing section, ink is sprayed from spraying nozzles (an ink nozzle section of the print head 1: an ink splaying nozzle) 1*a* (refer to FIG. 20) onto the sheet 201 on the platen 113, in accordance with the image information. At this time, the sheet 201 is temporarily stopped on the platen 113. While the ink is being sprayed, the carriage 2 makes a scan in a main-scanning direction by being guided with the guiding bar 121.

After that, the sheet 201 is moved by a certain distance in a sub-scanning direction on the platen 113. These operations are consecutively carried out in the printing section in accordance with the image information, until printing is finished with respect to the entire sheet.

The printed sheet 201 passes an ink drying section, and is discharged by the discharging rollers 131 and 132 to the discharge tray 134 via a sheet discharging opening 133. Then, the sheet 201 is supplied to a user as a printed document.

Figure 1:
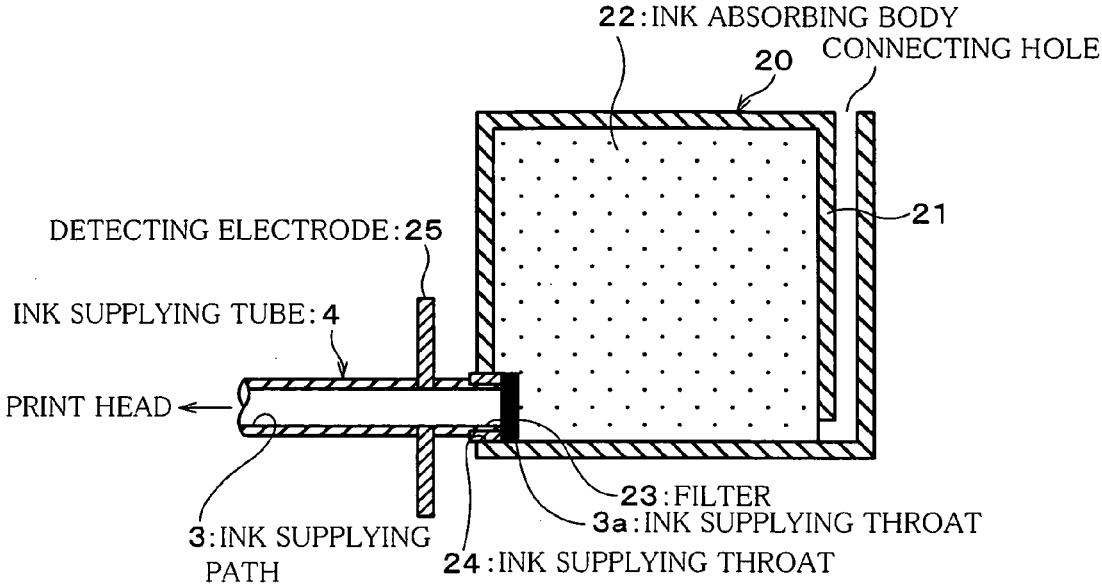
FIG. 1(*a*) is a cross-sectional view illustrating a structure of the main part of an ink cartridge in an inkjet recording apparatus according to one embodiment of the present invention.
Figure 1:
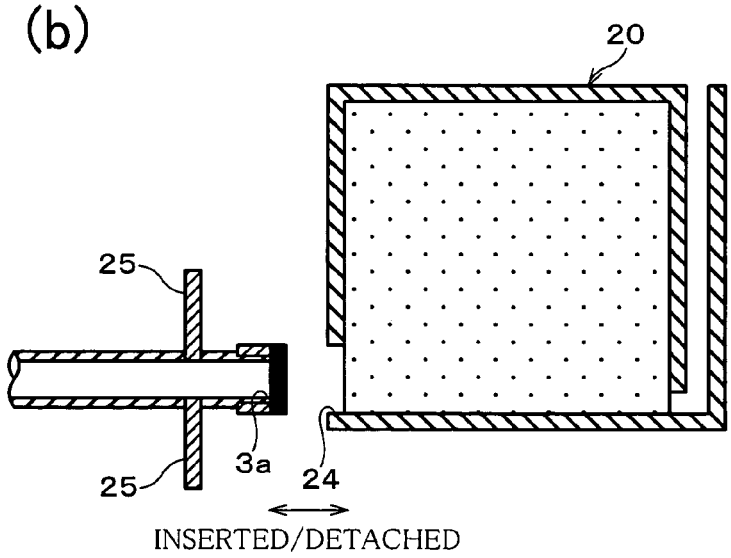
Figure 1:
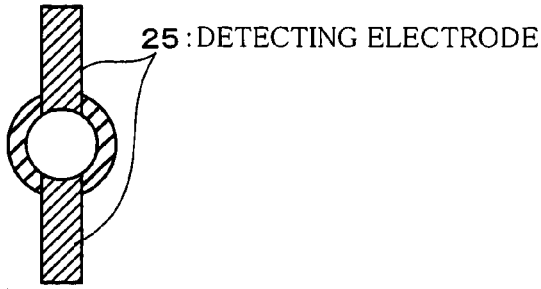
Figure 3:
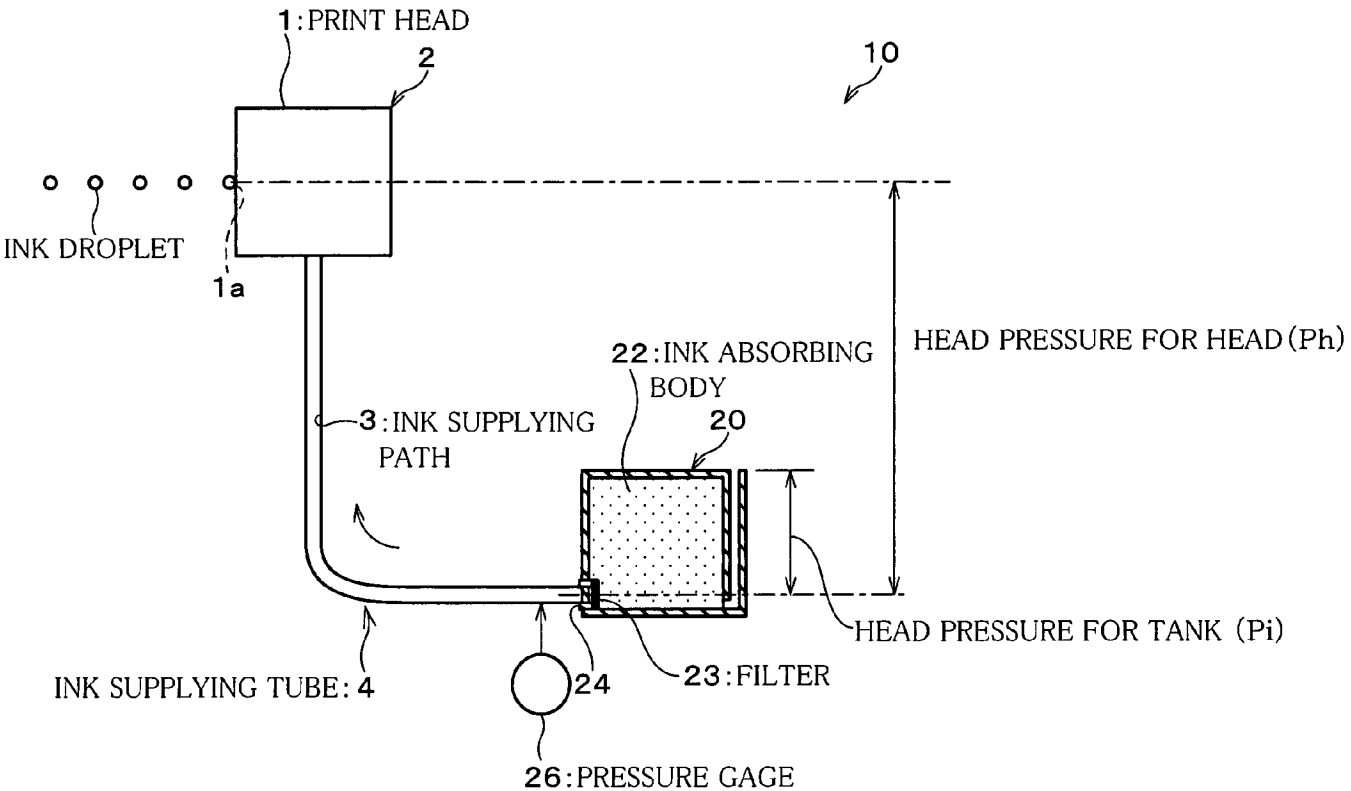
FIG. 3 is a diagram illustrating a schematic structure of an ink supplying apparatus for the inkjet recording apparatus.
Figure 5:
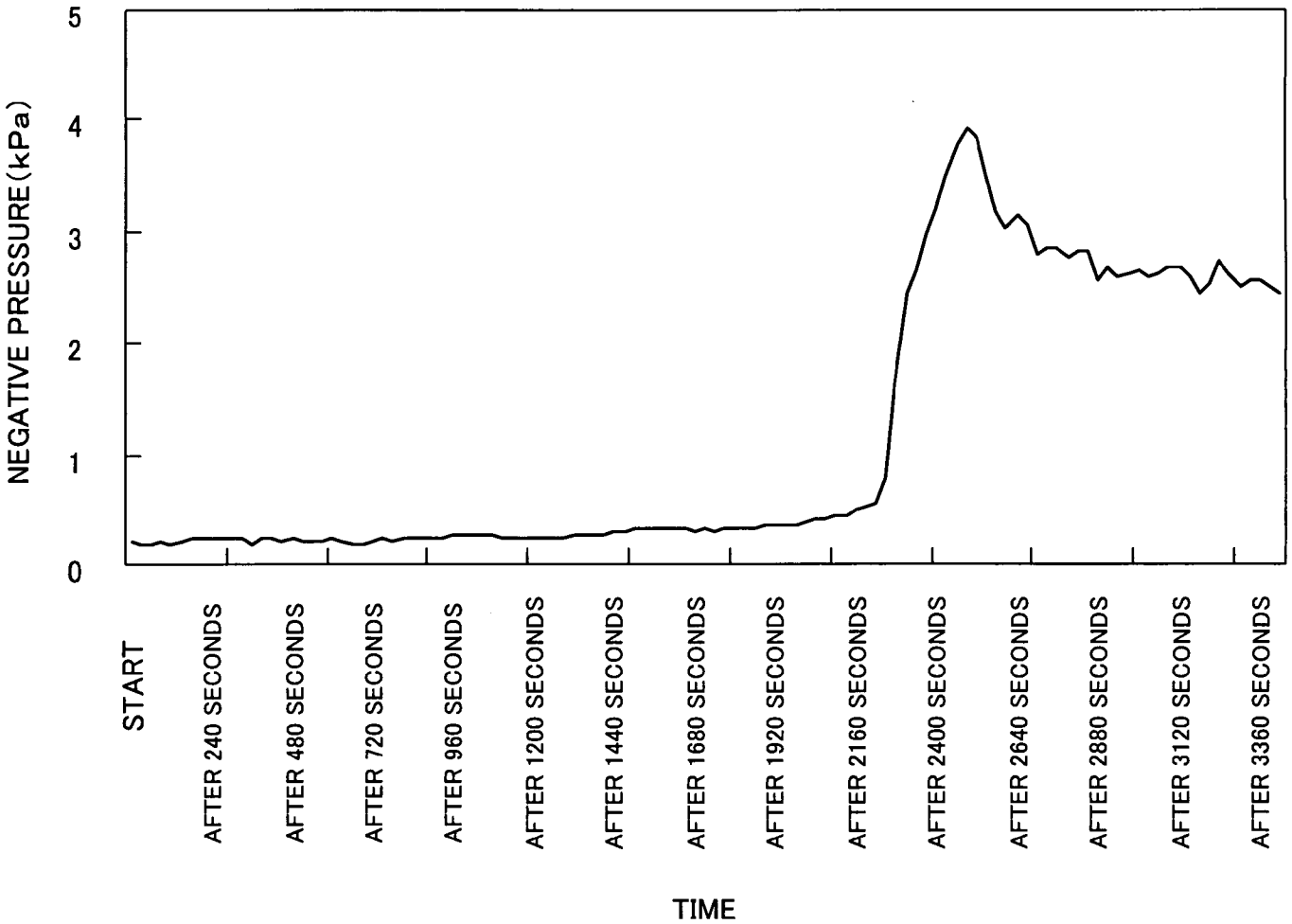
FIG. 5 is a graph showing a relationship between time and the negative pressure generated by the ink cartridge when ink is continuously discharged from the ink cartridge fully charged with the ink.

With reference to FIGS. 1, 3 and 5, the ink supplying unit 10 of the ink jet recording apparatus is described below in detail.

As shown in FIG. 3, the ink supplying unit 10 includes the print head 1, the ink cartridge 20, and the ink supplying path 3, as described above.

As shown in FIGS. 1(*a*) and 1(*b*), the ink cartridge 20 generally has an ink tank 21, provided as an ink containing section inside the ink cartridge 20. In the ink cartridge 20 of the present embodiment, the ink tank 21 includes an ink absorbing body 22, which is, for example, a porous material made of polyurethane resin for retaining ink.

The ink tank 21 has, along a bottom surface thereof for example, the ink supplying path 3 realized by an ink supplying tube 4 for supplying ink to the print head 1.

Inside of the ink supplying path 3, more specifically, a part of the ink supplying path 3 on the side of the ink tank 21, more preferably, at an end of the ink supplying path 3, a filter 23 is provided. The ink supplying tube 4 is connected to the ink tank 21 by that end of the ink supplying path 3 (i.e., the end of the ink supplying tube 4) on the side of the filter 23 which is inserted to the ink supplying throat 24, which is provided, for example, on the bottom surface of the ink tank 21. Therefore, the end of the ink supplying tube 4 on the side of the filter 23, i.e., the end (ink supplying throat 3*a*) of the ink supplying path 3 on which the filter 23 of the ink supplying tube 4 the ink supplying throat 24 is inside the ink tank 21.

As shown in FIGS. 1(*a*), 1(*b*), and 1(*c*), the ink supplying tube 4 outside the ink tank 21 has a pair of detecting electrodes (electrode section) 25 provided to sandwich the ink supplying tube 4. The pair of detecting electrodes 25 functions as an ink remaining amount detection electrode (detector). More specifically, the ink supplying path 3 outside the ink tank 21 has a pair of detecting electrodes 25 provided to sandwich the ink supplying path 3.

The ink supplying device 10 supplies ink stored in the ink tank 21 to the print head 1, by sucking out the ink with application of negative pressure via the filter 23 from the print head 1 side.

The print head 1 is adapted to discharge up to 0.49 cc ($0.49\times10^{-6}$ $m^3$) of ink per minute upon continuous driving of the all channels, for example. With the discharging, the print head 1 sucks out the same amount of ink from the ink tank 21. The pressure exerted within the ink supplying path 3 can be measured by a pressure gauge 26, as shown in FIG. 3. The print head 1 and the ink cartridge 20 are so positioned that the head (Ph; head pressure of head) of the print head 1 is 50 mm, and the head (Pi; head pressure of tank) of the ink tank 21 is 30 mm, for example. Note that, the head pressure of head Ph refers to the head pressure between the spraying nozzle 1*a* of the print head 1 and the ink supplying throat 24. Further, the head pressure of tank Pi refers to a head pressure of the ink tank 21, which occurs when the ink is going to be supplied to the print head 1 already filled with the ink via the ink supplying throat 24.

Figure 4:
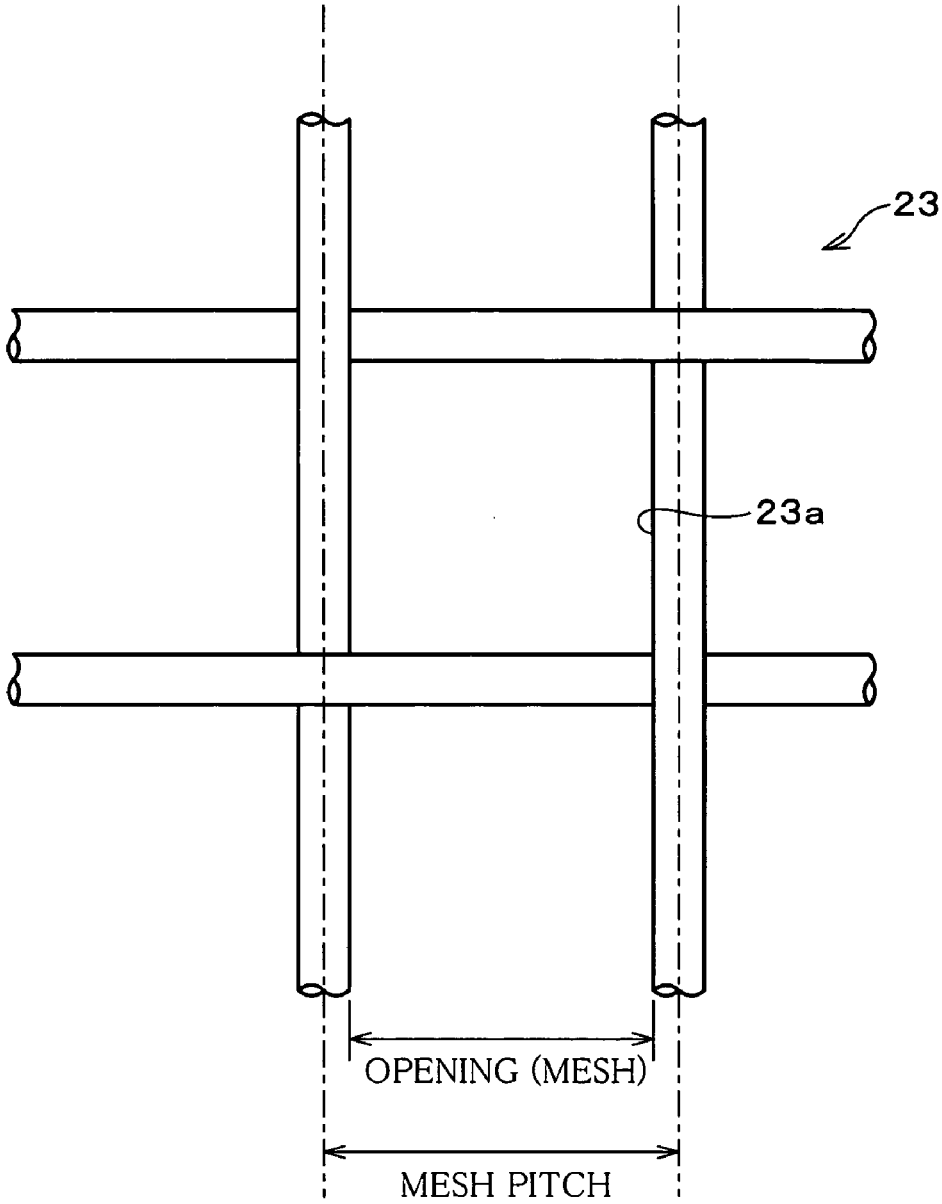
FIG. 4 is a front view illustrating a structure of a filter of the ink supplying apparatus.

The filter 23 is made of a zonal material, for example, a zonal stainless steel, and is prepared by braiding the horizontal and vertical bands of stainless steel as shown in FIG. 4. However, the filter 23 may be prepared in other ways. For example, the filter 23 may be prepared by forming openings on a plate by etching.

As shown in FIGS. 1(*a*), 1(*b*), and 1(*c*), in the ink cartridge 20, a remaining amount of ink, i.e., depletion of ink (ink empty) is detected by utilizing the fact that no current flows across the detecting electrodes 25 when ink has been pushed out from the detecting electrodes 25 by the air entrained into the ink supplying path 3 through the filter 23, that is, when there is no ink between the detecting electrodes 25.

Figure 6:
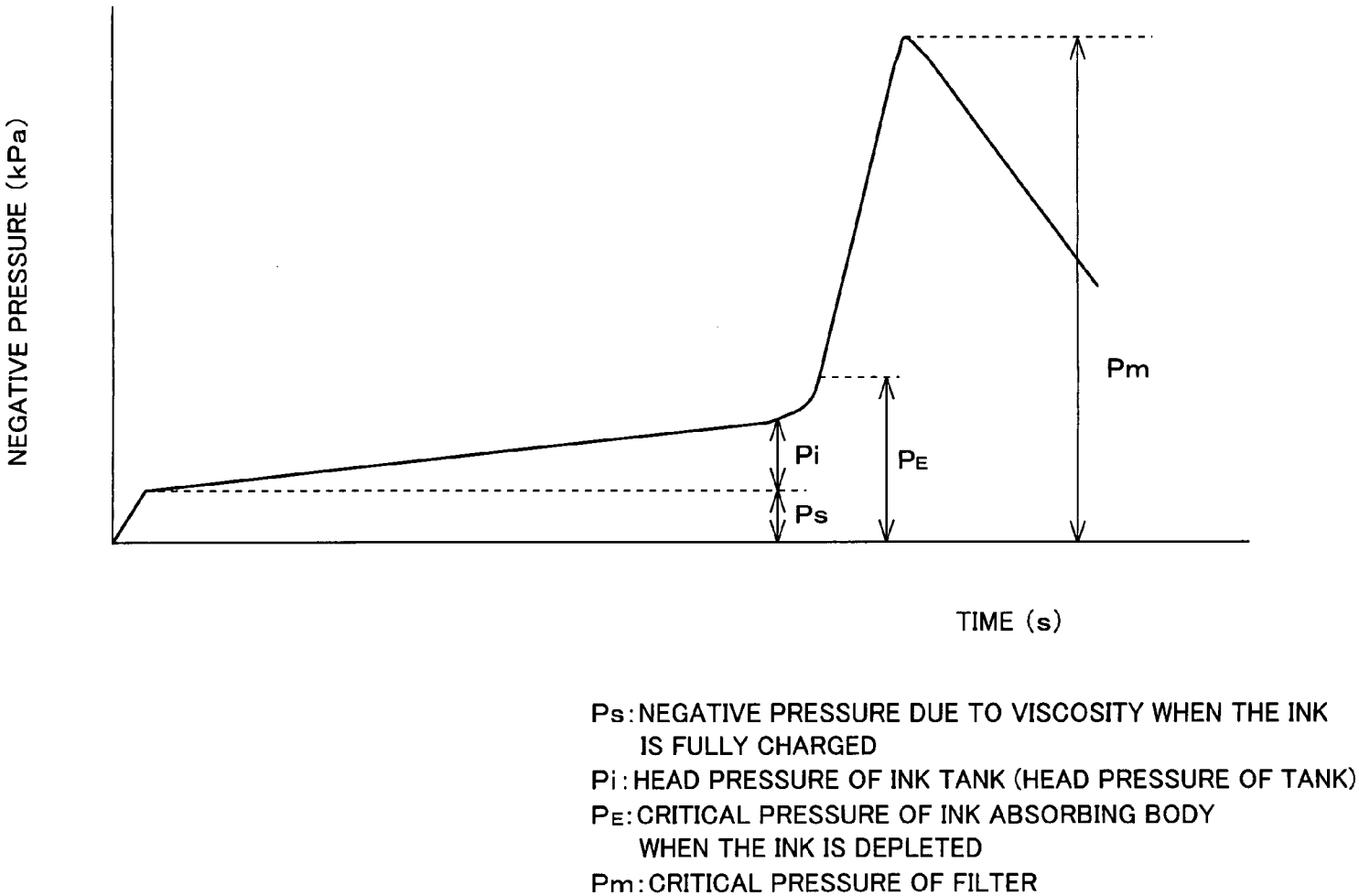
FIG. 6 is a schematic representation of the graph shown in FIG. 5.
Figure 7:
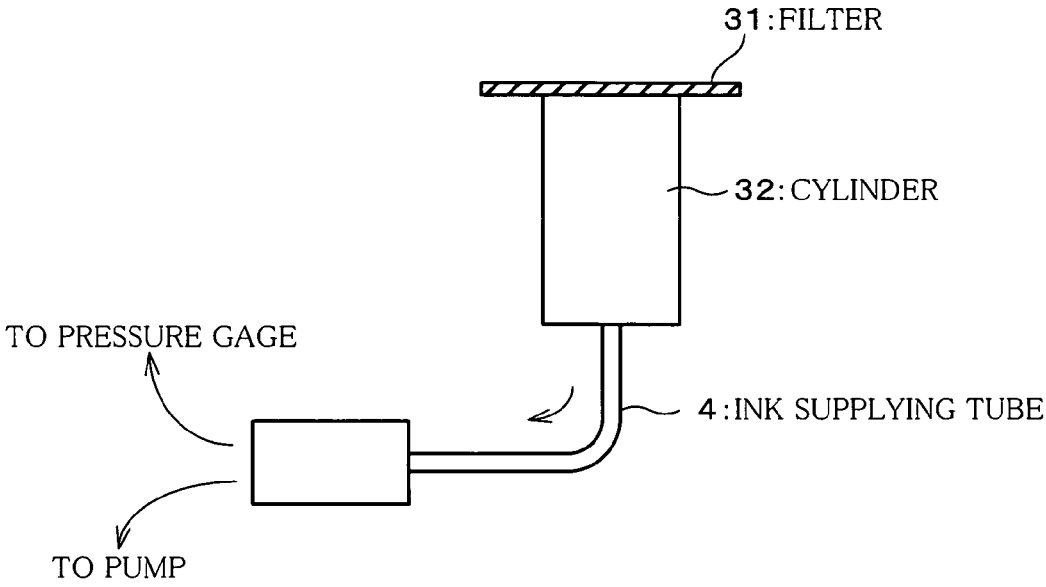
FIG. 7 is a diagram schematically illustrating a structure of a measurement device used for an experiment for measuring a negative pressure applied to the ink supplying path of the foregoing inkjet recording apparatus.

With reference to FIGS. 5 through 7, the following describes a relationship between negative pressure applied to the ink supplying path 3 and elapsed time, in the process of detecting a remaining amount of ink. FIGS. 5 and 6 are graphs showing a relationship between applied pressure within the ink supplying path 3 and elapsed time for continuously discharging ink from the ink cartridge 20 filled with ink. FIG. 6 is a simplified version of the explanatory diagram of FIG. 5.

First, when the print head 1 is driven, that is, when a negative pressure is created in the ink supplying path 3 to consume the ink inside the ink tank 21, the negative pressure gradually increases as the amount of ink consumed increases, as shown in FIGS. 5 and 6.

However, when the remaining amount of ink becomes low, the negative pressure increases abruptly and reaches to a maximum moment, and then decreases. This can be explained as follows. When the negative pressure becomes too large by a large sucking force exerted on the ink supplying tube 3, the meniscus of ink formed on the opening section 23*a* (see FIG. 4) of the filter 23 breaks. The broken ink film causes the decrease in negative pressure.

More specifically, as the remaining amount of ink is reduced, meniscus of the ink having been absorbed in the cell 22*a* (opening section, refer to FIG. 13) of the ink absorbing body 22 retreats, and the negative pressure applied to the ink supplying path 3 gradually increases due to surface tension of the ink. Further, when the negative pressure to the ink supplying path 3 exceeds critical pressure of the cell 22*a* of the ink absorbing body 22, that is, critical pressure $P_E$ by the ink absorbing body 22 when there is no remaining ink, the meniscus of ink reaches to the filter 23, so that the opening 23*a* of the filter 23 now controls the negative pressure applied to the ink supplying path 3. Then, as the ink is further consumed, the meniscus of the opening 23*a* of the filter 23 retreats, as with the meniscus of the ink absorbing body 22, the negative pressure applied to the ink supplying path 3 increases due to surface tension. The negative pressure abruptly increases and reaches to the critical pressure (filter pressure) by the diameter of the opening 23*a*, that is, the critical pressure (maximum negative pressure) Pm by the filter 23. Thereafter, when the suction force from the print head 1 exceeds the critical pressure Pm by the filter 23, the surface of meniscus formed on the opening 23*a* of the filter 23 breaks, and the ink supplying path 3 inhales air. As a result, the negative pressure applied to the ink supplying path 3 decreases.

Note that, in the present embodiment, the negative pressure was measured with a measurement device shown in FIG. 7. The measurement device is constituted of a cylinder 32 connected to the ink supplying tube 4. Further, a mesh filter 31, which is soaked with ink to have the same condition as that of the filter 23 for detecting ink remaining amount, is adhered to the cylinder 32 as a lid thereof.

Then, the ink with which the filter 31 is soaked is sucked by a pump (not shown) via the ink supplying tube 4. connected to the cylinder 32. Here, while the ink is sucked, the amount of ink (ink supplying amount) flowing in the ink supplying path 3 made of the ink supplying tube 4 is adjusted to 0.05 cc (i.e., $0.05\times10^{-6}$ $m^3$) per minute, so as to get rid of influence of viscous resistance of ink. In this manner, the negative pressure applied to the filter 31 is measured by a pressure gage 26, so as to find the negative pressure applied to the ink supplying path 3 made of the ink supplying tube 4.

Figure 8:
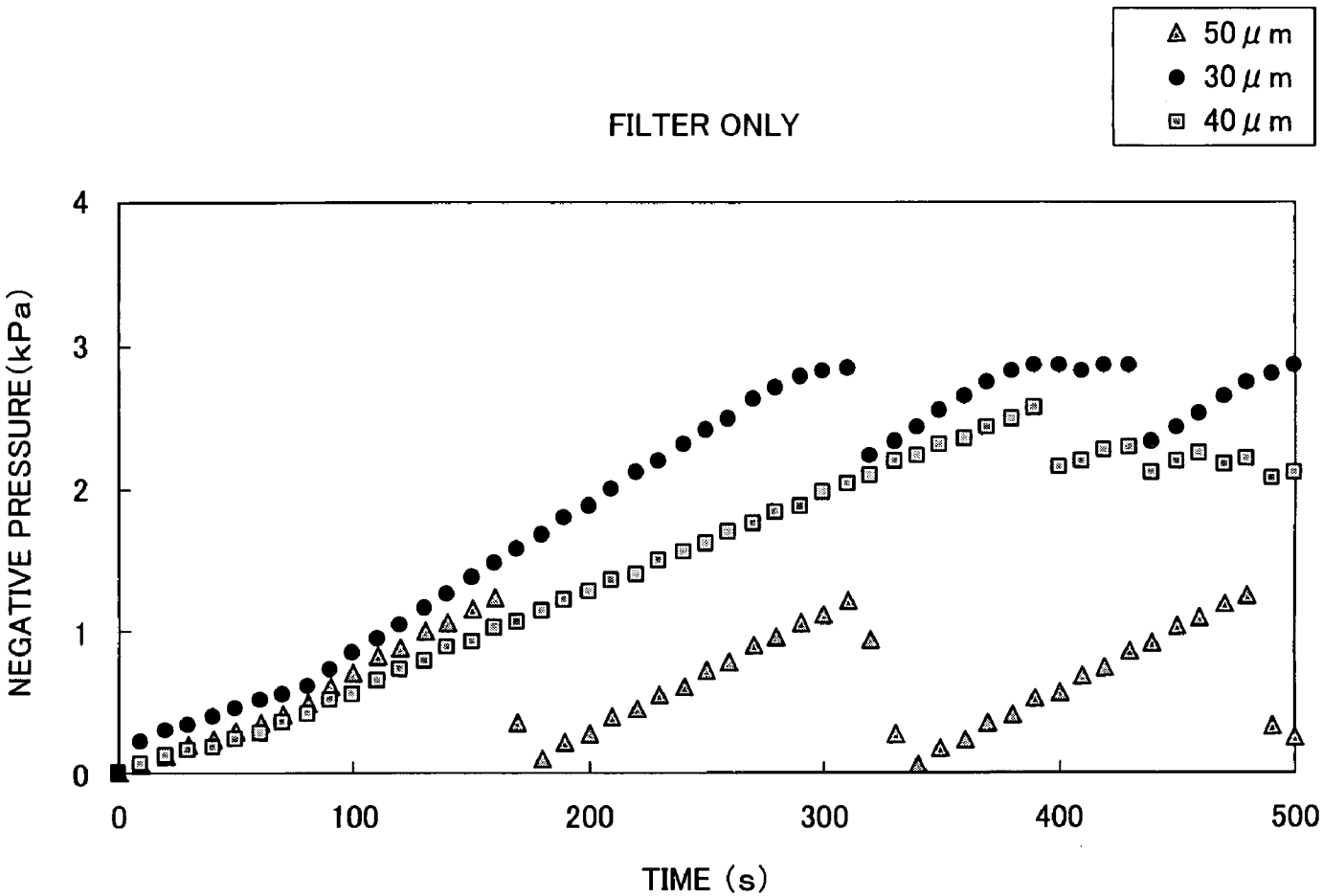
FIG. 8 is a graph showing a relationship between the negative pressure applied to the ink supplying path, and filtration accuracy of the filter which is actually measured with the measurement device of FIG. 7.

Further, the measurement of negative pressure with the foregoing measurement device was carried out again with a filter 23 having a different size (filtration accuracy F) of opening (mesh) 23*a*, i.e., a filter 31 having a different size of opening. As shown in FIG. 8, this measurement found a tendency such that the negative pressure applied to the ink supplying path 3, i.e., the negative pressure applied to the filter 23 (the filter 31 in the foregoing measurement) increases as the filtration accuracy F decreases.

This tendency is further verified with a graph (FIG. 9) showing a relationship between the critical pressure (maximum negative pressure) Pm of the negative pressure by the filter 23 (mesh filter) and the filtration accuracy F of the filter 23.

Here, the filtration accuracy F may also be interpreted as the minimum length (minimum gap width) of the opening 23*a* of the filter 23 (mesh filter).

In a liquid with surface tension of η (N/m), the critical pressure (critical pressure by surface tension) Pc (Pa) of a circular opening with a diameter d (m), which forms the meniscus of ink, is widely known with the following general expression (1).

$$Pc=4\eta/d \quad (1)$$

Note that, in the present embodiment, the same symbol used in the respective expressions (general expression, empirical expression, relational expression) denotes the same physicality. Further, in the calculation results of the expressions, the same symbol denotes the same unit.

Then, the critical pressure Pc (Pa) was found by the foregoing general expression (1) by substituting the filtration accuracy F (m) of the filter 23 for the diameter d (m), so as to find the critical pressure Pm (Pa) by the filter 23. In this calculation, the value found by the general expression (1) was $\sqrt{2}$ times the measurement value. Accordingly, it was found that substitution of the filtration accuracy F of the filter 23 without modification results in a large difference between the calculation value and the measurement value.

The reason of such a difference is assumed as follows. As shown in FIG. 4, the opening of the filter 23 made up of warp and woof is not a circle; and therefore, the critical pressure Pm by the filter 23 depends on the maximum gap width of the opening 23*a* of the filter 23, in contrast to the filtration accuracy F, which depends on the minimum gap width of the opening 23*a* of the filter 23.

Based on this assumption, the critical pressure Pm (Pa) by the filter 23 may be denoted by the following empirical expression (2), using surface tension η (N/m) of ink and the filtration accuracy F (m), by multiplying the filtration accuracy F by $\sqrt{2}$.

$$Pm=4\eta/(\sqrt{\cdot}F) \quad (2)$$

Figure 9:
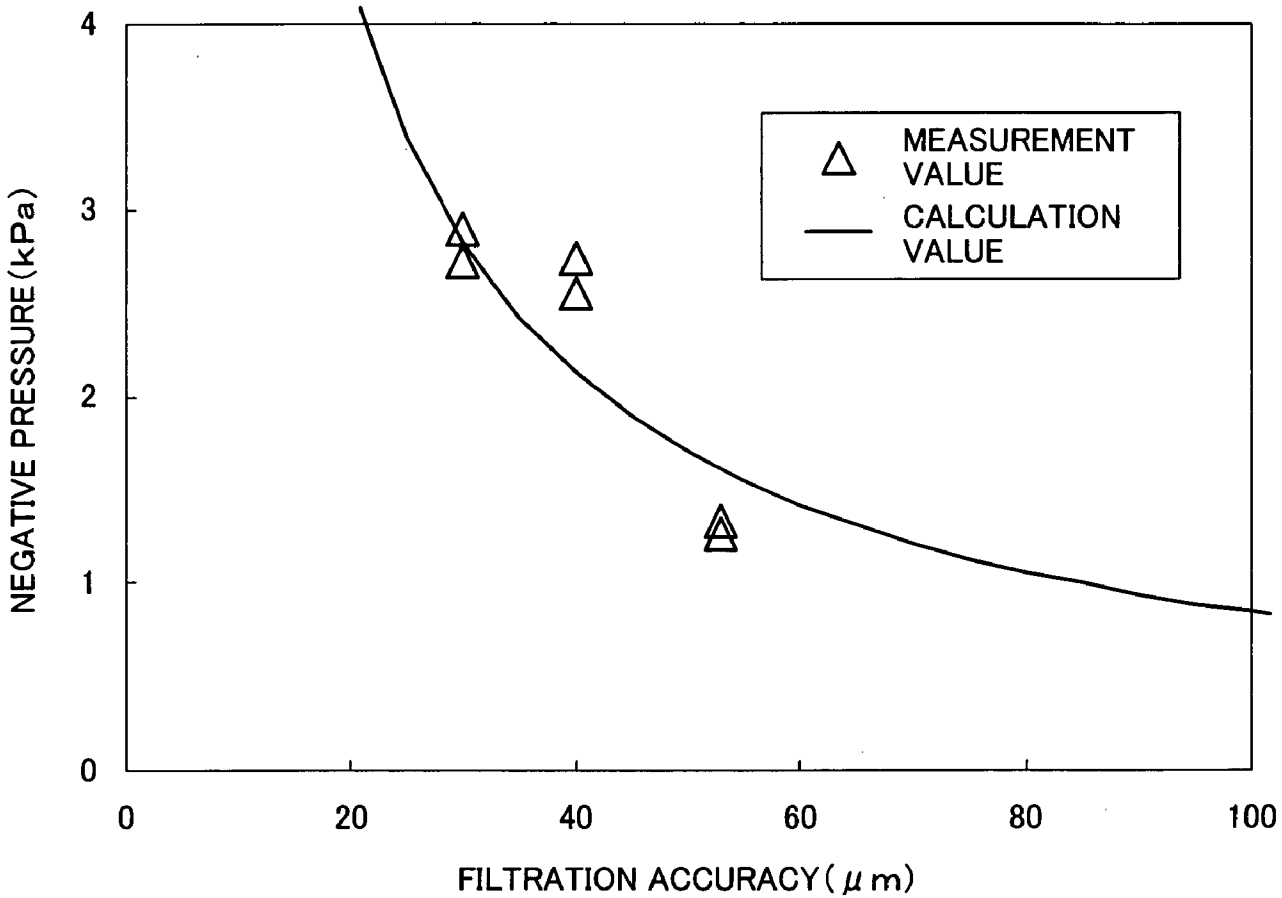
FIG. 9 is a graph showing a relationship between the filtration accuracy of the filter, and the critical pressure of the negative pressure of ink by the filter.

With the value calculated by this empirical expression (2) and the measurement value shown in FIG. 8, FIG. 9 shows a graph indicating a relationship between the critical pressure Pm (Pa) by the filter 23 and the filtration accuracy F. In the graph, the vertical axis denotes the critical pressure Pm (Pa) by the filter 23, i.e., the negative pressure applied to the ink supplying path 3, and the horizontal axis denotes the filtration accuracy F of the filter 23. Note that, in FIG. 9, "Δ" denotes the measurement value shown in FIG. 8, and the solid line denotes the calculation value by the empirical expression (2).

With the graph of FIG. 9, it was found that the measurement value and the calculation value are substantially identical, meaning that the foregoing tendency is correct. In other words, with reference to FIGS. 8 and 9, it was found that the critical pressure Pm (Pa) by the filter 23 depends on the size of opening 23*a* of the filter 23.

As described, when the negative pressure applied to the ink supplying path 3 becomes equal to the critical pressure Pm by the filter 23, the meniscus (liquid surface of ink) formed on the opening of the filter 23 breaks, and air reaches the detection electrodes 25 constituting an electrode section. In the present embodiment, according to the foregoing analysis with FIGS. 8 and 9, the time when the resistance value detected by detection electrodes 25 becomes equal to or greater than a predetermined value due to the air entered into the electrode section is regarded an indication showing that the ink tank 21 is practically empty, i.e., the remaining amount of ink is at an empty level, as detailed in FIG. 6. With this function, it is possible to keep the critical pressure Pm (Pa) by the filter 23, which is a critical pressure for breaking the meniscus of ink, to be lower than the predetermined value.

In the present embodiment, various experiments were carried out regarding the negative pressure applied to the ink supplying path 3 when the remaining amount of ink is the empty level. According to the results of the experiments, the negative pressure of the ink supply system (the critical pressure of the ink absorbing body or the filter 23) was determined to not more than 2.0 kPa.

Figure 20:
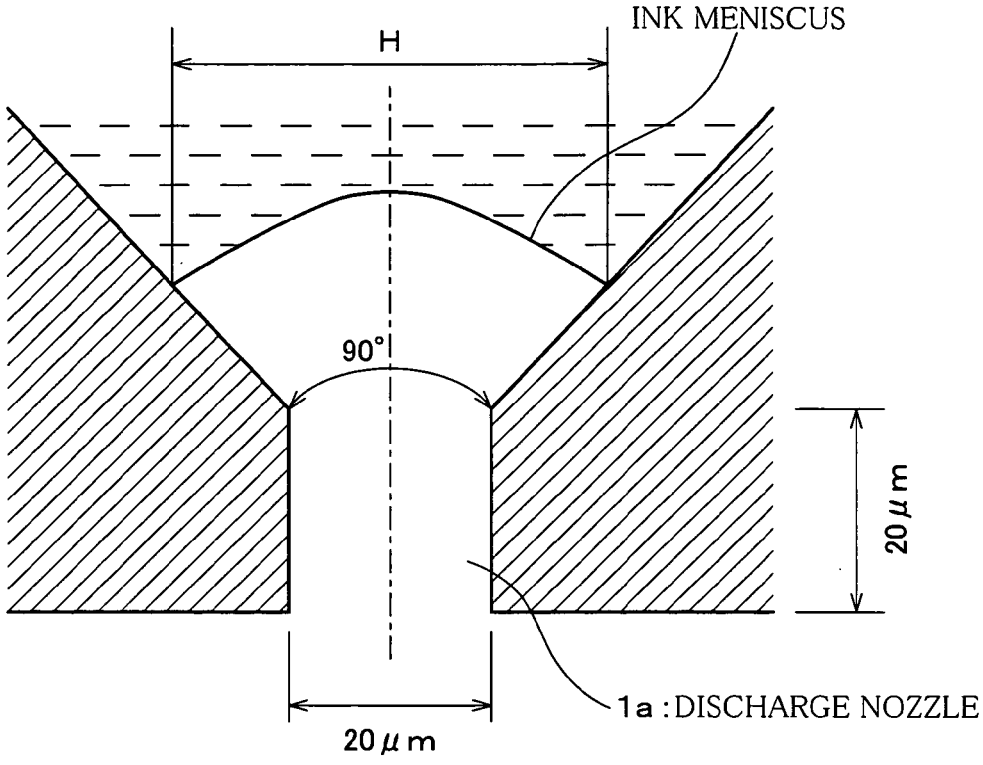
FIG. 20 is a cross-sectional view illustrating a magnified structure of the end of an ink supplying throat.

This value is determined based on the following point of view. When continuous discharge of the ink is performed, the negative pressure generated by the supply system (the critical pressure of the ink absorbing body or the filter 23) needs to be no larger than 2.0 kPa, considering the safety factor. If not, there arises a problem as shown in FIGS. 20 and 21 that air is sucked into the nozzle as the meniscus (liquid surface of the ink) retreats too much from the end (nozzle end) of the discharge nozzle 1*a* of the print head 1, before judging that the ink tank 21 is practically empty with the fact that the negative pressure generated in the ink supply system causes breakage of the meniscus (liquid surface of ink) formed on the opening of the filter 23 so that air reaches to the detection electrodes 25. As a result, the ink cannot be discharged (supplied) properly and stably.

Next, described below in detail is how to optimize the ink absorbing body 22 of the ink cartridge 20.

As shown in FIGS. 1(*a*), 1(*b*), and 1(*c*), in the present embodiment, provided is the ink cartridge 20 including the ink tank 21 in which a foam material is contained as the ink absorbing body 22. The porous material of the foam material is soaked with ink. The foam material is contained in a compressed state in the ink tank 21.

The ink retained in the porous material is discharged by a capillary action from inside the ink cartridge 20 to the print head 1 via the ink supplying throat 24 (discharge nozzle 1*a* (see FIG. 20) of the ink cartridge 20.

However, depending of the ink retaining power of the porous material of the ink tank 21, there are cases where ink is depleted during continuous discharge of the ink, or ink leakage is caused when the ink cartridge 20 is inserted or detached.

These problems can be solved by determining design indices for the ink absorbing body 22 in accordance with properties of the ink. In the present embodiment, an experiment was conducted using the following ink and the ink cartridge 20 to measure an stable negative pressure P in the ink cartridge 20 and to evaluate design indices. Table 1 shows the result of experiment. The ink, and the ink cartridge 20 were used under the following conditions.

Surface tension of the ink: $\eta$=0.03 (N/m) (30 dyn/cm)

Viscosity of the ink: $\mu$=0.07 (Pa·s) (=7 cp)

Composition of the ink: $H_2O$, pigment, and polyethyleneglycol

Cell density of the ink absorbing body 22 (foam material): N=1.57×10$^3$ (cells/m) (=40 cells/inch);

Material of the ink absorbing body 22: polyurethane;

Inner dimensions of the ink cartridge (width W×depth V×height L):

W×D×L=0.015×0.074×0.030(m).

Note that, the outer dimensions of the ink absorbing body 22 when contained in the ink cartridge (ink tank 21) is equal to the inner dimensions of the ink cartridge 20.

The headings used in Table 1 are as follows.

Compressibility R: The volume ratio of the ink absorbing body 22 (foam material) after it is contained in a compressed state in the ink cartridge 20 to the ink absorbing body 22 (the foam material) before it is contained in the ink containing section Cell density N (cells/m): The cell density of the ink absorbing body 22 (the foam material) before the ink absorbing body 22 (the foam material) is contained in the ink cartridge Actual cell density M of the ink absorbing body 22 (foam material) in a compressed state (cells/m): The actual cell density of the ink absorbing body 22 contained in a compressed state in the ink cartridge 20;

Flow rate Q (m$^3$/s): The flow rate of the ink

Efficiency $\tau$ (%): a net amount of flow from the ink cartridge 20 (actual usable volume of ink)÷an amount of ink filled (volume of ink filled);

Maximum ink stable negative pressure P$\mu$ (Pa):

The stable negative pressure in the ink cartridge 20 measured when the ink cartridge 20 is fully charged with the ink (i.e. when the ink cartridge 20 is full and when the ink is discharged at a certain flow rate.

Minimum ink stable negative pressure PL (Pa):

The stable negative pressure in the ink cartridge 20 measured when the ink cartridge is charged at the minimum level (i.e. immediately before the ink in the ink cartridge is depleted) and when the ink is discharged at a certain flow rate.

TABLE 1

| CO | ACTUAL DENSITY M | MEASURED FLOW RATE | E | MSNP (kPa) Max. | MSNP (kPa) Mini. | RATIO AT START POINT | | | RATIO AT END POINT | | |
|---|---|---|---|---|---|---|---|---|---|---|---|
| R | N * R | Q (nm$^3$/s) | $\eta$ (%) | Ph | PL | Rs | R2 | Rs/R2 | Re | R1 | Re/R1 |
| 2 | 3150 | 8.17 | 77% | 0.07 | 0.46 | 0.11 | 0.13 | 0.85 | 0.46 | 0.36 | 1.28 |
| 5 | 7874 | 8.17 | 60% | 0.62 | 0.86 | 1.00 | 0.83 | 1.21 | 0.87 | 0.91 | 0.96 |
| 5.5 | 8661 | 8.17 | 60% | 0.62 | 0.99 | 1.00 | 1.00 | 1.00 | 1.00 | 1.00 | 1.00 |
| 6 | 9449 | 8.17 | 61% | 0.73 | 1.16 | 1.18 | 1.19 | 0.99 | 1.17 | 1.09 | 1.07 |
| 7 | 11024 | 8.17 | 60% | 0.91 | 1.29 | 1.47 | 1.62 | 0.91 | 1.30 | 1.27 | 1.02 |
| 8 | 12598 | 8.17 | 51% | 1.30 | 1.50 | 2.10 | 2.12 | 0.99 | 1.52 | 1.45 | 1.04 |

CO: COMPRESSIBILITY;
E: EFFICIENCY;
MSNP: MEASURED STABLE NEGATIVE PRESSURE

Note that, in the present embodiment, the critical presure $P_E$ (this term may hereinafter be described as the critical pressure of the ink absorbing body in some cases), and the critical pressure Pm by the filter 23 (this term may be hereinafter be described as the critical pressure of the filter in some cases) are specified to satisfy Pm>$P_E$, in terms of foreign body removal ability of the filter 23. Further, as shown in FIG. 6, the present embodiment specifies the critical pressure $P_E$, Pm, the pressure loss P$\mu$ of the ink supplying path 3, and the tank head pressure Pi to satisfy $Pm>P_E>P\mu+Pi$. However, the present embodiment is not limited to those relations. For example, depending on the setting of ink supply system, those values can be inversed in magnitude, and the filter 23 may be omitted.

After the measured values of generated negative pressure were analyzed according to hydrodynamic theories, it was found that the maximum ink stable negative pressure Pu depended on a pressure loss Pμ of the flow path, i.e., the ink supplying path 3 due to the viscosity resistance of the ink, and that the minimum ink stable negative pressure PL depended on the surface tension η of the ink. This analysis is more specifically described later.

Note that, in determining ink retaining power of the ink cartridge, it is necessary to consider a height of the ink cartridge 20, variances among the cells 22*a* of the ink absorbing body 22 (foam material), and the vibration applied to the ink cartridge 20. This is because poor ink retaining power causes the problem of accidental ink leakage when the ink cartridge is inserted or detached in a fully charged state.

For example, when the height of the ink cartridge 20 is 34 mm, the gravity γ of ink is approximately 1.0, and therefore a required ink retaining power is 68 (=34×2) mm by head (0.67 kPa), assuming a safety factor of 2. Further, since a general ink cartridge has a height of not more than 40 mm or similar, the ink cartridge is required to endure a head pressure of ink equal to 0.8 kPa.

The ink retaining power is the capillary pressure generated by the surface tension η. Thus, assuming that the cell in a compressed state is a circular opening with a diameter=d (m), the cell diameter d(m) in a compressed state is denoted by the following expression (3) according to the actual cell density M (M=N·R; more strictly M≈N·R) (cells/m) of the ink absorbing body 22 (foam material) in a compressed state.

$$d=1/(N\cdot R) \tag{3}$$

According to the foregoing general expression (1) and the relational expression (3), the critical pressure $P_E$, the cell density N(cells/m) and the compressibility (R) may be denoted by the following relational expression (4), $$P_E=4\cdot\eta\cdot(N\cdot R) \tag{4}$$

where η (N/m) expresses the surface tension of ink.

By setting the actual cell density M (M=N·R) to be no less than 200 cells/inch (7.87×103 cells/m), the minimum ink stable negative pressure PL can produce an ink retaining power of no less than 0.86 kPa (89 mm) by head. Accordingly, it is possible to prevent the problem of accidental ink leakage when the ink cartridge is inserted or detached.

When continuous discharge of the ink is performed, the negative pressure (the ink absorbing body 22 and the critical pressure of the filter 23) generated by the supply system needs to be no larger than approximately 2.0 kPa, considering the safety factor. If not, the negative pressure generated by the supply system causes depletion of the ink. This leads to a problem that air is sucked into the nozzle as the liquid surface of the ink retreats too much from the front end of the nozzle 1*a* (nozzle end). As a result, the ink cannot be supplied stably.

By setting the actual cell density M (cells/inch) to be no larger than $12.6\times10^3$ (cells/m) (i.e., no larger than 320 cells/inch), the negative pressure generated by the supply system becomes no larger than 1.5 kPa. This makes it possible to stably supply the ink with a margin when continuous discharge of the ink is performed.

Figure 10:
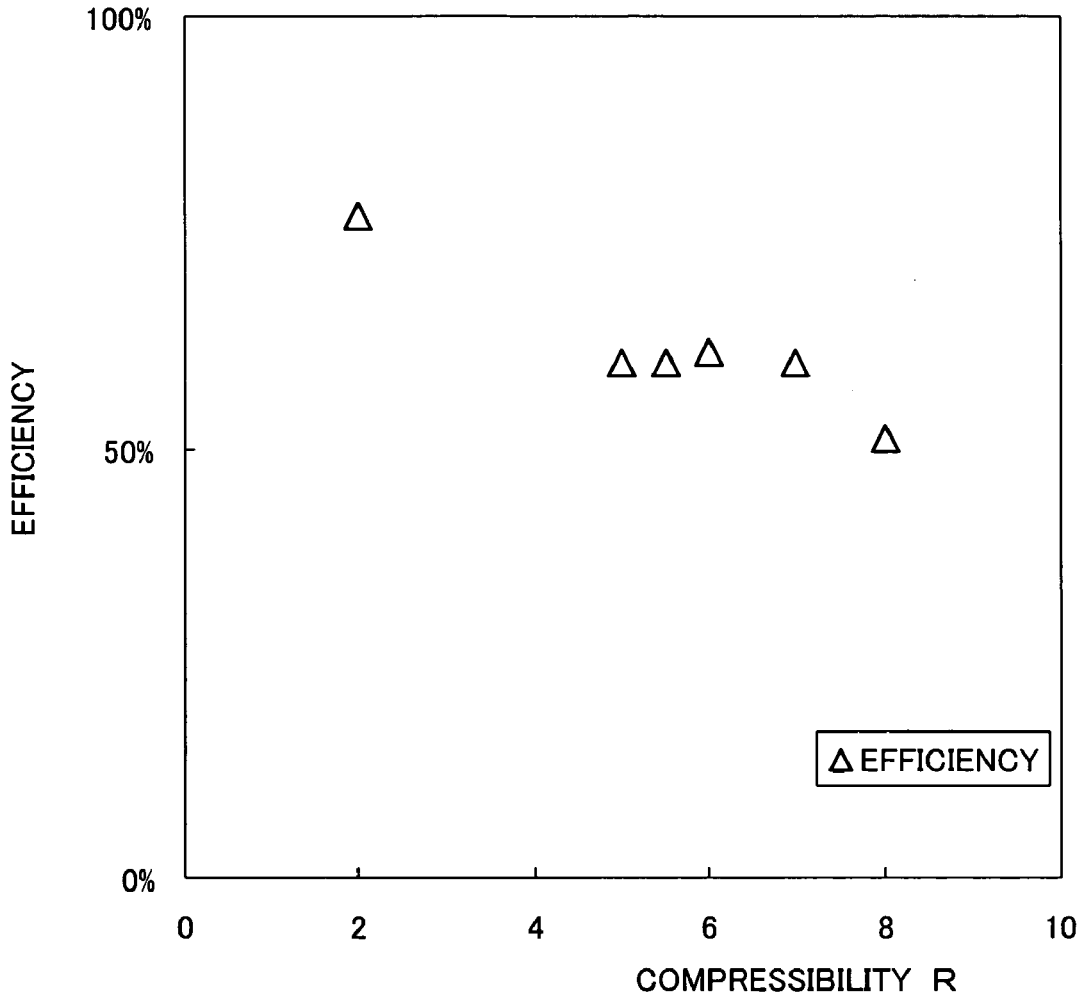
FIG. 10 is a graph showing a relationship between efficiency and cell density.
Figure 11:
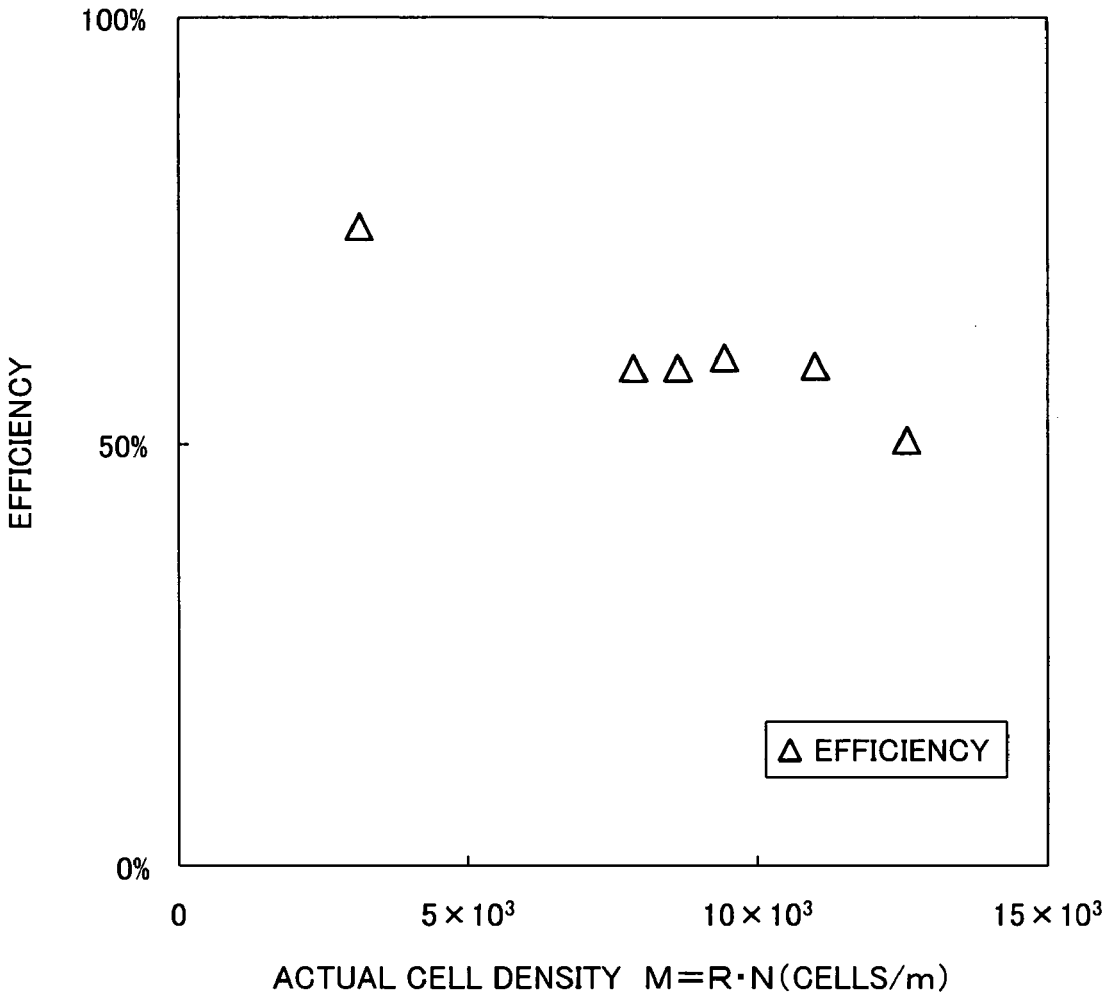
FIG. 11 is a graph showing a relationship between efficiency and actual cell density.

Assuming that the efficiency τ (tank efficiency) is the ratio of (i) a volume of the ink that can be actually used (discharged) to (ii) an internal volume (volume of ink in fully charged state) of the ink cartridge 20, the efficiency τ (%) decreases as R, i.e., the value of N·R, increases, as shown in FIG. 10; and starts to abruptly decrease when the actual cell density M (cells/inch) becomes $12.6\times10^3$ (cells/m) (i.e., no larger than 320 cells/inch), as shown in FIG. 11. Therefore, the actual cell density M (M=N·R) of no larger than $12.6\times10^3$ (cells/m) is one condition for efficiently utilizing the volume of the ink cartridge 20.

Accordingly, by setting the actual cell density M (cells/inch) (M=N·R) to satisfy $7.87\times10^3 \leqq M \leqq 12.6\times10^3$, it is possible to prevent the problem of accidental ink leakage when the ink cartridge is inserted or detached in a fully charged state, and to stably supply the ink with a margin when continuous discharge of the ink is performed, while also ensuring efficient usage of the volume of ink cartridge 20. Further, with the foregoing arrangement, the actual cell density M may be at or larger than $7.87\times10^3$ as long as it is not more than $12.6\times10^3$, thus widening a range of designing of the ink absorbing body 22.

Although the above values are theoretical values, it was confirmed that measured values also met these conditions. Specifically, Table 1 indicates that the minimum ink stable negative pressure PL, which is a measured negative pressure, is no less than 0.86 kPa when the actual cell density M=N·R is $7.87\times10^3$ (cells/m), and that the maximum ink stable negative pressure Pμ, which is a measured negative pressure, is no larger than 1.5 kPa when the actual cell density M (M=N·R) is not more than $12.6\times10^3$ (cells/m). Thus, it is possible to stably supply the ink with a margin when continuous discharge of the ink is performed. Note that, the minimum ink stable negative pressure PL, which is a measured negative pressure, denotes how much negative pressure the meniscus can resist.

Next, the minimum ink stable negative pressure PL and the maximum ink stable negative pressure Pμ are discussed. The maximum ink stable negative pressure Pμ denotes a negative pressure when the ink is flowing.

First, the values of Rs under "RATIO AT START POINT" in Table 1 are normalized values of the respective maximum ink stable negative pressures Pμ with respect to the maximum ink stable negative pressure of Pμ=0.62 kPa for the compressibility of R=5.5 and the flow rate of Q=8.17 $nm^3/s$ (0.49 cc/min). R2 represents values of compressibility R2 normalized with respect to the compressibility of R=5.5.

Meanwhile, the values of Re under "RATIO AT END POINT" in Table 1 are values of the respective minimum ink stable negative pressures PL normalized with respect to the minimum ink stable negative pressure of PL=0.99 kPa for the compressibility of R=5.5 and the flow rate Q=8.17 $nm^3/s$ (0.49 cc/min). R1 represents values of compressibility R normalized with respect to the compressibility of R=5.5.

Here, according to Table 1, Rs/R2 calculated at a start point and Re/R1 calculated at an end point are both substantially equal to 1. Therefore, it is found that the maximum ink stable negative pressure Pμ is proportional to the square of compressibility R, and the minimum ink stable negative pressure PL is proportional to compressibility R.

Based on these findings and in order to obtain more specific design indices for the ink and the ink absorbing body 22 (foam material), theorization was made and the result was analyzed as explained in detail below.

First, the following discusses a relationship between the stable negative pressure (maximum ink stable negative pressure Pμ) and compressibility R when the ink cartridge 20 is fully charged with the ink.

Figure 12:
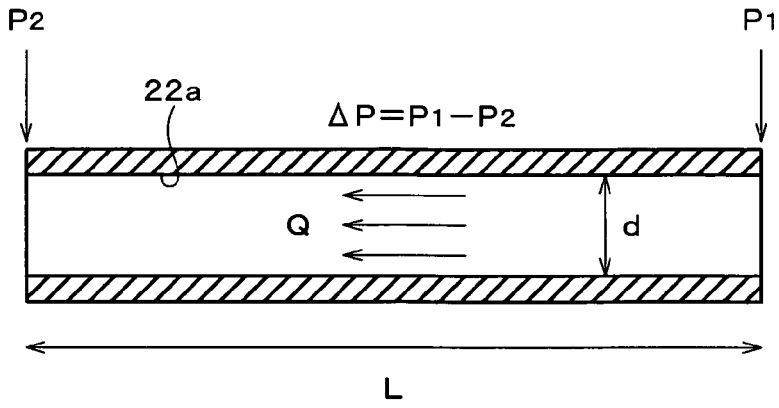
FIG. 12 is a schematic diagram showing a relationship between flow rate in a conduit and pressure difference within a conduit, assuming that each cell of a foam material of the ink cartridge is a round conduit.

When the ink cartridge 20 is fully charged with the ink (i.e. when the ink cartridge 20 is full), it can be assumed that each cell 22*a* of the ink absorbing body 22 (foam material) is a round conduit, and that the liquid (ink) in the conduit is flown by a pressure difference ΔP (pressure P1 at the starting point of the conduit—pressure P2 at the ending point of the conduit) within the conduit, i.e., the pressure loss Pμ of the conduit due to viscous resistance. As shown in FIG. 12, the flow rate Q ($m^3/s$) of a flow in the round conduit (cell 22*a*), i.e., a flow in each conduit can be defined by a general expression:

$$Qi=Pu\cdot\pi\cdot d^4/(128\cdot\mu\cdot L) \quad (5)$$

where Pu is the maximum ink stable negative pressure, which is the pressure loss (Pa) in the conduit due to viscous resistance of ink, d is the diameter (m) of the conduit, μ is the viscosity (Pa·s) of the ink, and L is the length (m) of the conduit.

Here, since the actual cell density (cells/m) of the ink absorbing body 22 (foam material) in a compressed state is M=N·R, the cell diameter d(m) of the ink absorbing body 22 (foam material) in a compressed state is, as described above, given by a relational expression:

$$d=1/(N\cdot R) \quad (3).$$

Figure 13:
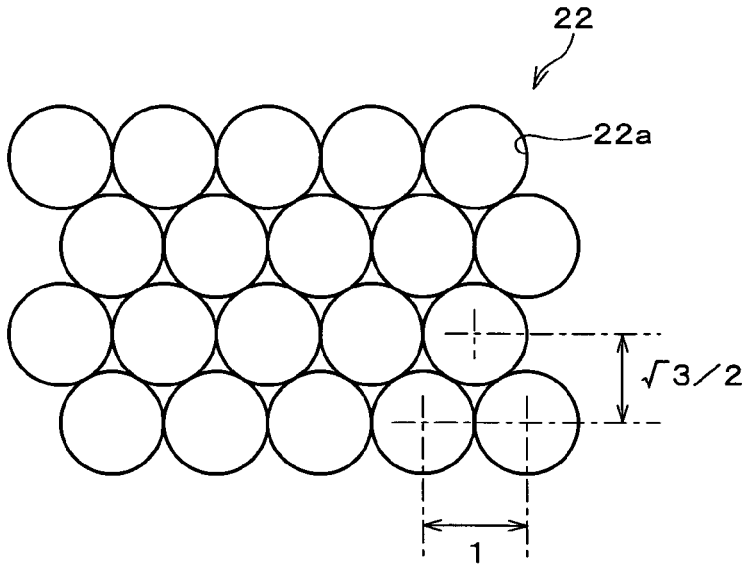
FIG. 13 is a schematic diagram illustrating cells closely packed together.

At this time, because the ink absorbing body 22 (foam material) is contained in the ink cartridge 20 in the compressed state, the cells 22*a* of the ink absorbing body 22 (foam material) are assumed to be most closely packed, as shown in FIG. 13. Therefore, the total number of cells Nd (cells) at a lower end of the form in a compressed state is given by a relational expression:

$$Nd=(2/\sqrt{3})\cdot S/(d^2) \quad (6)$$

where S is the cross-sectional area (Width W× and Depth D) of the ink absorbing body 22 (foam material) contained in the ink cartridge 20 (ink tank 21) in a compressed state.

It follows from this that, when the flow path is assumed to be a column of a constant diameter made of the cells 22*a* with the number given by the foregoing relational Expression (6), the total flow rate Qt ($m^3/s$) (Qt=Qi·Nd; theoretical value) is given by the following relational expression (7) according to a general expression (5), and relational expressions (3), and (6).

$$Qt=Qi\cdot Nd=[Pu\cdot\pi\cdot d^4/(128\cdot\mu\cdot L)]\cdot[(2/\sqrt{3})\cdot S/(d^2)]=A\cdot Pu\,S/[\mu\cdot L\cdot(N\cdot R)^2] \quad (7)$$

where A is a coefficient of $A=2.83\times10^{-2}$.

It can be seen from this that the total flow rate Qt is inversely proportional to the square of the actual cell density (cells/m) (M=N·R) of the ink absorbing body 22 (foam material) in a compressed state.

Figure 14:
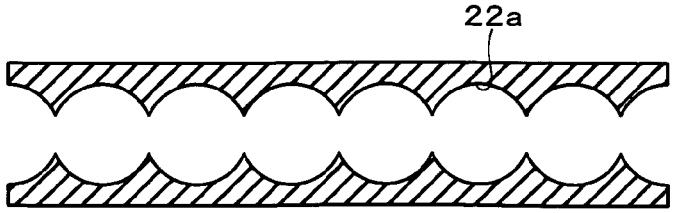
FIG. 14 is a cross-sectional view illustrating a state in which spherical or polyhedral cells are linked together in a beads-like manner in an actual foam material of the ink cartridge.

Table 2 shows values of the total flow rate Qt, which are theoretical values calculated in accordance with Expression (7), assuming the column-shaped flow path shown in FIG. 14.

TABLE 2

| CO R | AVERAGE CELL DIAMETER d (mm) | MSNP Max(Ph) (kPa) | FLOW RATE/ NUMBER Qi ($pm^3/s$) | NUMBER OF FLOW PATHS Nd (number) | TOTAL FLOW RATE Qt ($nm^3/s$) | CALCULATED FLOW RATE Qc ($nm^3/s$) | RATIO Q/Qc |
|---|---|---|---|---|---|---|---|
| 2 | 0.32 | 0.07 | 8.31 | 11,867 | 99 | 7.18 | 1.14 |
| 5 | 0.13 | 0.62 | 1.89 | 74,169 | 140 | 10.17 | 0.80 |
| 5.5 | 0.12 | 0.62 | 1.29 | 89,744 | 116 | 8.41 | 0.97 |
| 6 | 0.11 | 0.73 | 1.07 | 106,803 | 114 | 8.32 | 0.98 |
| 7 | 0.09 | 0.91 | 0.72 | 145,371 | 105 | 7.62 | 1.07 |
| 8 | 0.08 | 1.30 | 0.60 | 189,872 | 115 | 8.33 | 0.98 |
| | | | | CORRECTION COEFFICIENT | 13.75 | | |

CO: COMPRESSIBILITY;
MSNP: MEASURED STABLE NEGATIVE PRESSURE

In the ink absorbing body 22 (foam material), spherical or polyhedral cells 22*a* are linked together in a beads-like manner, as shown in FIG. 14. The effective diameter is therefore smaller than the theoretical value because of the beads-like flow path. As such, an average multiplication factor with respect to the actual flow rate Q (measured value) was calculated for the total flow rate Qt (theoretical value) that was obtained based on the theoretical cell diameter. The resultant value was then used as a correction coefficient k. In Table 2, the correction coefficient k is 13.75 where Qt/Q≈k.

Figure 15:
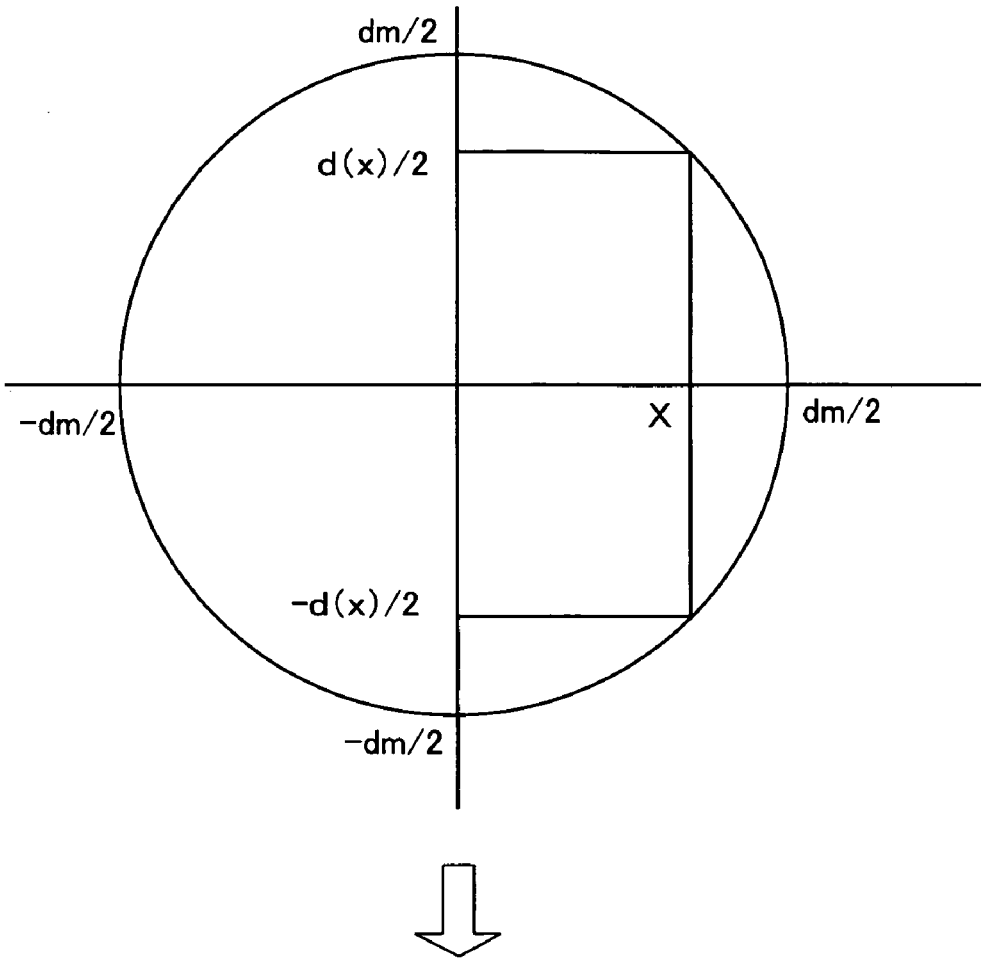
FIG. 15 is an explanatory diagram illustrating how effective diameter is calculated, assuming that the cells in an actual form make up a flow path by being linked together in a beads-like manner.
Figure 16:
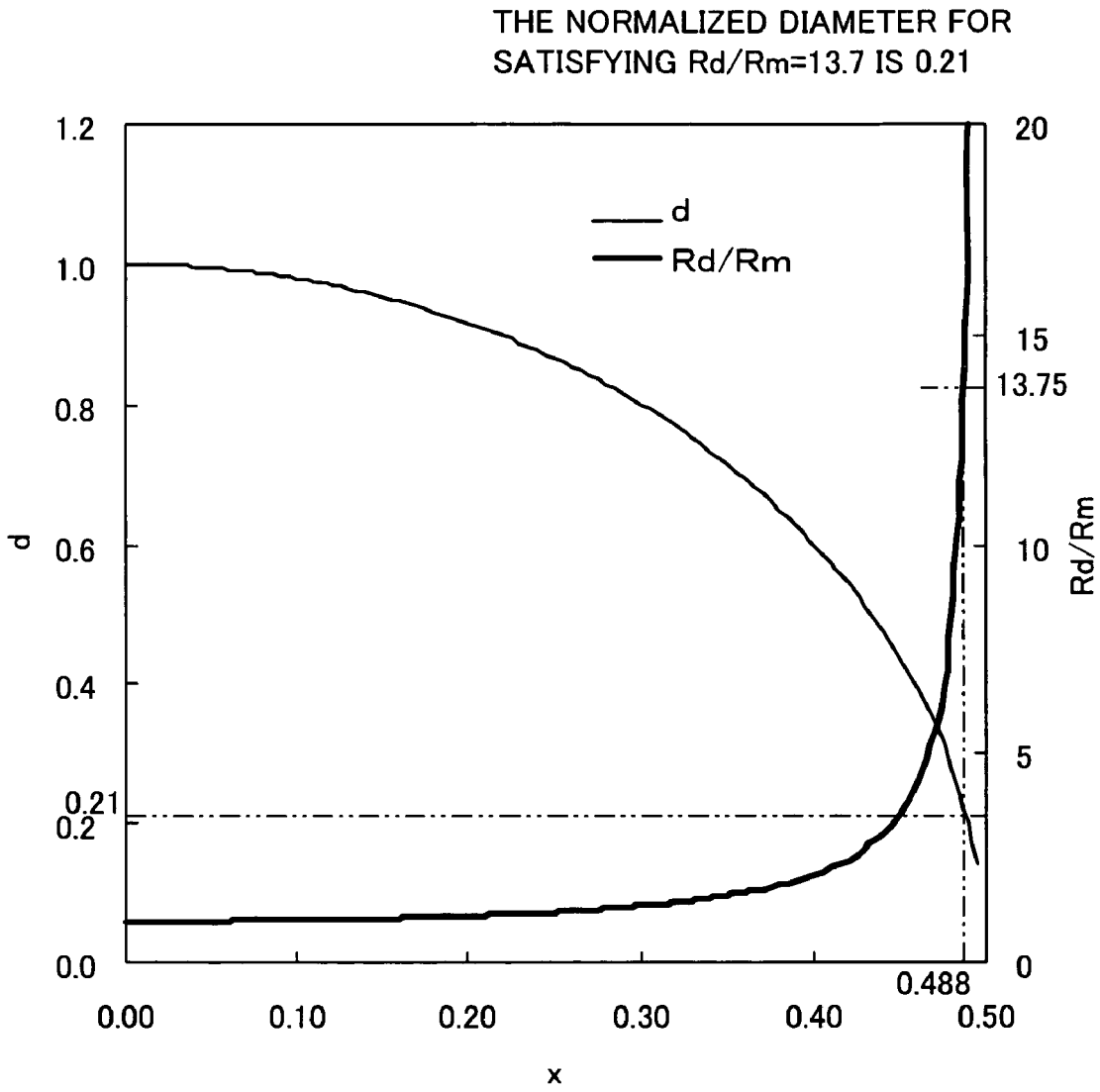
FIG. 16 is a graph illustrating a relationship between X and resistance ratio Rd/Rm and between X and cell diameter d, where Rd is the normalized flow path resistance calculated by performing integration on a spherical flow path by assuming that the center of the spherical flow path is X=0, and Rm is the normalized flow path resistance of a column-shaped flow path.

FIG. 16 shows a resistance ratio Rd/Rm, where Rd is the normalized flow path resistance calculated by performing integration on a spherical flow path with a diameter dm and a center X=0 as shown in FIG. 15, and Rm is the normalized flow path resistance in the column-shaped flow path. As shown in FIG. 16, Rd/Rm≈1 when X is in a vicinity of 0, and Rd/Rm increases as X approaches dm/2 (see FIG. 15). Here, observation is made as to the correction coefficient k=13.75. Assuming that a normalized cell diameter is 1, Rd/Rm=13.75 at X=0.488. This indicates that it is possible to create a model for the flow path where adjacent cells 22*a* are linked together with a normalized diameter of 0.21. Thus, it is confirmed that the value of the correction coefficient k determined by actual measurement is indeed appropriate.

Accordingly, a flow rate Qc ($m^3/s$) is calculated in accordance with the following relational expression (8):

$$Qc=Qt/k \quad (8)$$

where k is a coefficient=13.75, or the following relational expression (9) in which the relational expression (7) is substituted in the relational expression (8), $$Qc=(A/k)\cdot Pu\cdot S/[\mu\cdot L\cdot(N\cdot R)^2] \quad (9)$$

where $(A/k)=2.06\times10^{-3}$.

Here, because the respective values of Q/Qc are substantially equal to 1 in Table 2, it can be seen that the flow rate Q can be accurately calculated using the correction coefficient k as follows.

$$Q=(A/k)\cdot Pu\cdot S/[\mu\cdot L\cdot(N\cdot R)^2]$$

Further, the theoretical value Pv (Pa) of the pressure loss (pressure difference ΔP) of the conduit due to the viscous resistance may be denoted as follows, according to the measured flow rate Q.

$$Pv=(1/A)\cdot[\mu\cdot L\cdot(N\cdot R)^2/S]\cdot Q$$

where A is a coefficient=$2.83\times10^{-2}$.

Further, the pressure loss (pressure difference ΔP) of the conduit due to the viscous resistance obtained by using the correction coefficient k=13.75 as with the foregoing relational expressions (8) and (9), i.e., the calculation value of the pressure loss (pressure difference ΔP) of the conduit due to the viscous resistance Pμ (Pa) (calculated pressure value) may be denoted as follows.

$$P\mu=k\cdot Pv=(k/A)\cdot[\mu\cdot L\cdot(N\cdot R)^2/S]\cdot Q \quad (10)$$

where (k/A)=485

Here, Table 3 shows the theoretical value Pv and the calculation value Pμ of the pressure loss (pressure difference ΔP) of the conduit, by using the measured flow rate Q, according to the relational expression (10). Note that, the flow rate q in Table 3 denotes the measured flow cartridge 20 is depleted), the cells 22*a* at the lower end of the ink absorbing body 22 (foam material) can be regarded as a capillary tube.

Figure 18:
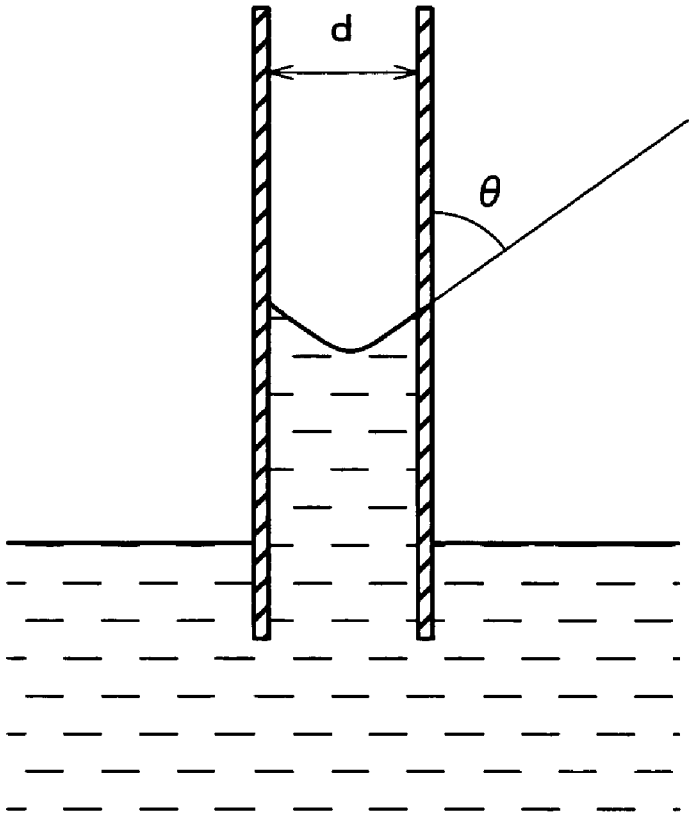
FIG. 18 is a schematic diagram illustrating critical pressure on a liquid surface (meniscus) in a capillary tube, assuming that cells at a lower end of the foam material make up a capillary tube in a state immediately before the ink in the ink cartridge is depleted.
Figure 19:
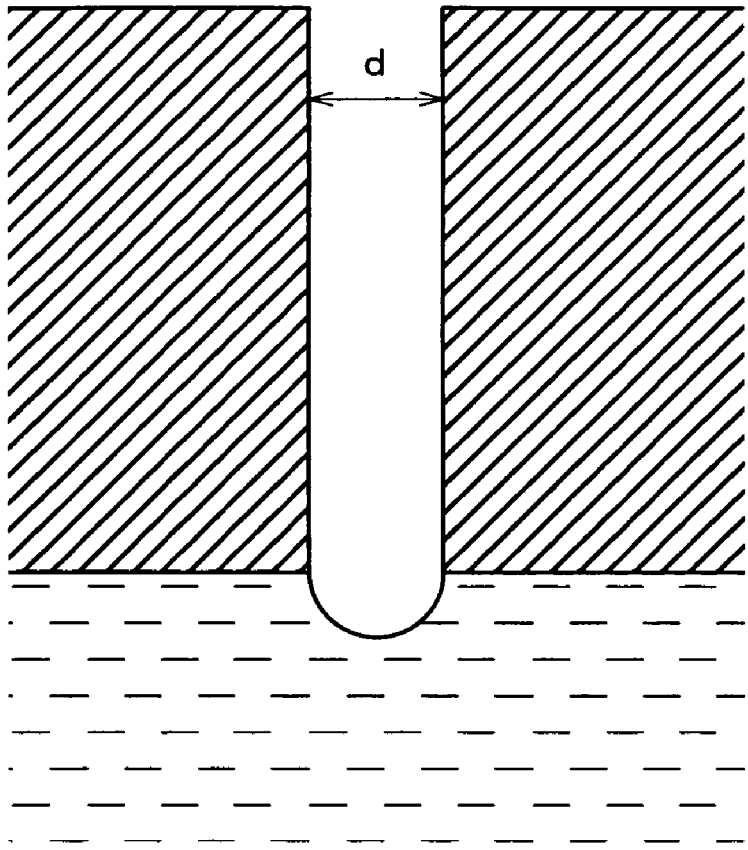
FIG. 19 is a schematic diagram illustrating critical pressure on a liquid surface (meniscus) in the capillary tube.

Therefore, as shown in FIG. 18 (positive pressure is applied to the liquid) and 19 (negative pressure is applied to the liquid), at the critical pressure Pt (Pa) of a liquid surface (meniscus) in the capillary tube, i.e., the critical pressure $P_E$ (=Pt) by the ink absorbing body 22 when the ink is depleted is defined by the following general expression (11):

$$Pt=2\cdot\eta\cdot\cos\theta/(d/2) \quad (11).$$

where η is the surface tension (N/m) of the liquid (ink) in the tube, θ is the contact angle, which is an angle at which the liquid surface contacts the tube, and d is the diameter (m) of the capillary tube. Because such an ink absorbing body 22 is used that has superior wettability to the ink (high affinity for the ink), the contact angle θ can be regarded as substantially equal to zero. Therefore, the general expression (11) can be transformed by the following general expression (12):

$$Pt=4\cdot\eta/d \text{ (more strictly, } Pt\approx4\cdot\eta/d) \quad (12).$$

It follows from this that, from the relational expression (3) and the general expression (12), the critical pressure $P_E$ (=Pt) by the ink absorbing body 22 may be denoted by the following relational expression (4).

TABLE 3

| CO | ACTUAL DENSITY M | AVERAGE CELL DIAMETER | MEASURED FLOW RATE | NUMBER OF FLOW PATHS Nd | FLOW RATE q | PRESSURE | | |
|---|---|---|---|---|---|---|---|---|
| R | N * R | d (mm) | Q ($nm^3$/s) | (number) | ($pm^3$/s) | Pv (kPa) | Pμ(kPa) | Pμ/Pu |
| 2 | 3,150 | 0.32 | 8.17 | 11,867 | 0.688 | 0.0058 | 0.08 | 1.14 |
| 5 | 7,874 | 0.13 | 8.17 | 74,169 | 0.1101 | 0.0362 | 0.50 | 0.80 |
| 5.5 | 8,661 | 0.12 | 8.17 | 89,744 | 0.0910 | 0.0438 | 0.60 | 0.97 |
| 6 | 9,449 | 0.11 | 8.17 | 106,803 | 0.0765 | 0.0521 | 0.72 | 0.98 |
| 7 | 11,024 | 0.09 | 8.17 | 145,371 | 0.0562 | 0.0710 | 0.98 | 1.07 |
| 8 | 12,598 | 0.08 | 8.17 | 189,872 | 0.0430 | 0.0927 | 1.27 | 0.98 |
| 9 | 14,173 | 0.07 | 8.17 | 240,307 | 0.0340 | 0.1173 | 1.61 | — |
| 10 | 15,748 | 0.06 | 8.17 | 296,675 | 0.0275 | 0.1449 | 1.99 | — |
| 5.5 | 8,661 | 0.12 | 1.25 | 89,744 | 0.0139 | 0.0067 | 0.09 | — |

CO: COMPRESSIBILITY

Here, the ratio (Pμ/Pu) of the calculation value Pμ (calculated pressure difference) of the pressure loss (presure difference ΔP) of the conduit was calculated with respect to the maximum ink stable negative pressure Pμ. The ratio Pc/Ph, which is the ratio of a calculated pressure difference Pc to the maximum ink stable negative pressure Pμ, is substantially equal to 1.

Figure 17:
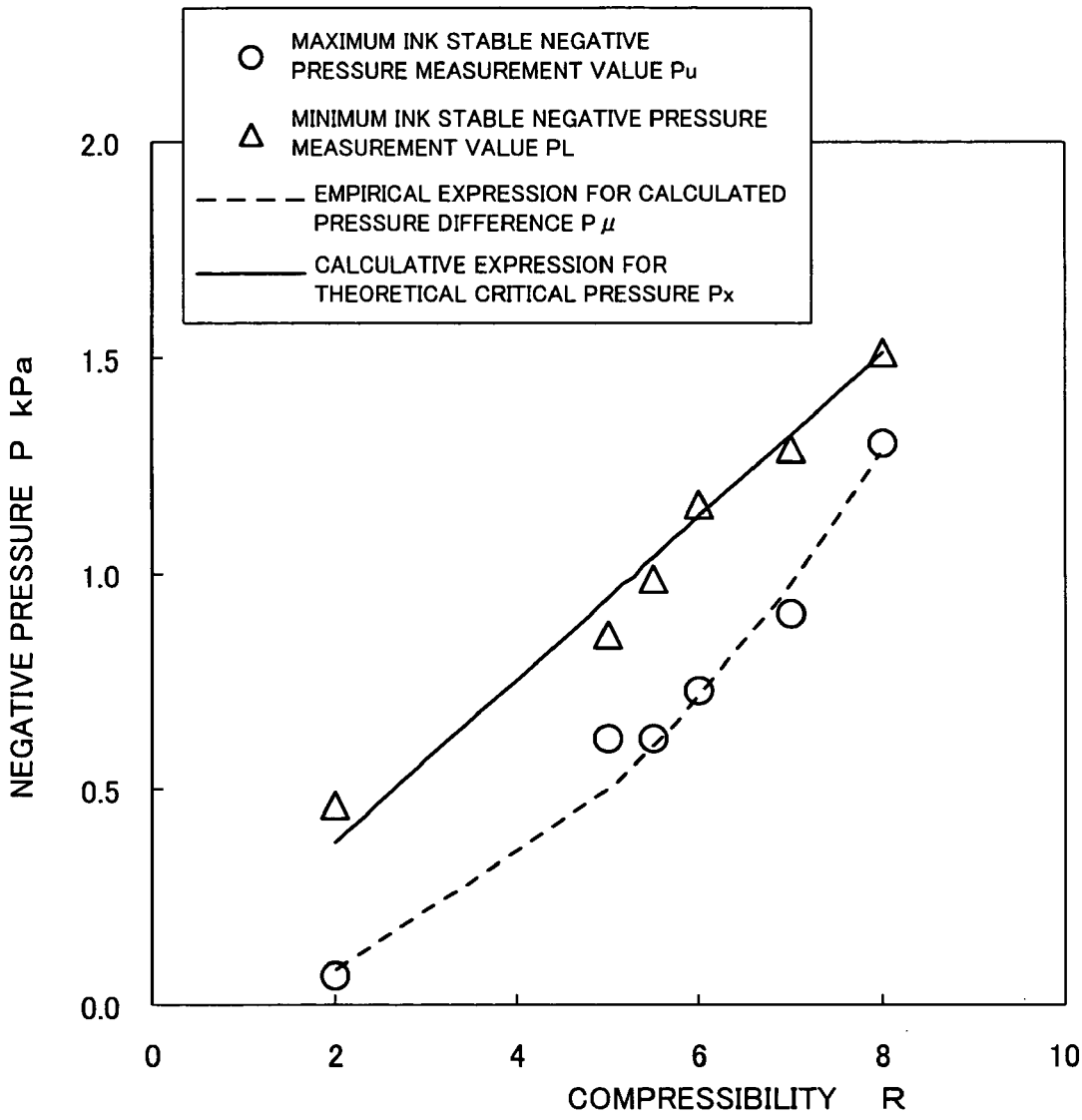
FIG. 17 is a graph showing a relationship between compressibility and negative pressure.

FIG. 17 is a graphical representation of Table 2 and Table 3. As shown in FIG. 17, there is a considerable overlap between the stable pressures (calculated pressure difference Pμ) calculated using the theoretical values and the stable pressures (maximum ink stable negative pressure Pu) that are actually measured. Further, the maximum ink stable pressure Pu can be accurately calculated using the correction coefficient, because the maximum ink stable pressure Pu is created by the pressure loss due to the viscosity of the ink.

Next, the following will discuss the relationship between the stable negative pressure (stable negative pressure PL when the ink is in a minimum level) and the compressibility R, when the ink cartridge 20 is charged with a minimum amount of ink.

When the ink cartridge 20 is charged with a minimum amount of ink (i.e. immediately before the ink in the ink $$P_E=4\cdot\eta\cdot(N\cdot R) \quad (4).$$

Table 4 shows values of the critical pressure Pt of the liquid surface (meniscus) of the ink absorbing body 22, calculated in accordance with the relational expression 4.

TABLE 4

| COMPRESSIBILITY | ACTUAL DENSITY M | AVERAGE CELL DIAMETER | PRESSURE | |
|---|---|---|---|---|
| R | N * R | d (mm) | Px (kPa) | Px/PL |
| 2 | 3,150 | 0.32 | 0.38 | 0.82 |
| 3 | 4,724 | 0.21 | 0.57 | — |
| 4 | 6,299 | 0.16 | 0.76 | — |
| 5 | 7,874 | 0.13 | 0.94 | 1.10 |
| 5.5 | 8,661 | 0.12 | 1.04 | 1.05 |
| 6 | 9,449 | 0.11 | 1.13 | 0.98 |
| 7 | 11,024 | 0.09 | 1.32 | 1.03 |
| 8 | 12,598 | 0.08 | 1.50 | 1.00 |
| 9 | 14,173 | 0.07 | 1.70 | — |
| 10 | 15,748 | 0.06 | 1.89 | — |

The ratio Px/PL calculated by the relational expression (4), which is the ratio of theoretical critical pressure Px to minimum ink stable negative pressure PL (actual pressure) is substantially equal to 1. This confirms the theory that the minimum ink stable negative pressure PL depends on the critical pressure of the capillary tube genereted by the surface tension of the ink, and that the minimum ink stable negative pressure PL can be accurately calculated.

A condition for preventing the problem of accidental ink leakage caused when the ink cartridge 20 is inserted or detached is that the critical pressure $P_E$ (Pa) needs to be larger than the ink head pressure. The critical pressure $P_E$ (Pa) is a critical pressure of the liquid surface (meniscus) in the cells 22*a* (capillary tube) at the lower end of the ink absorbing body 22 (foam material), which is the ink retaining power of the ink absorbing body 22 (foam material), i.e., the critical pressure in the cells 22*a* (with a diameter=1/(N·R) in a compressed state) of the ink absorbing body 22 (foam material), which forms meniscus with a liquid having a surface tension η.

In the ink cartridge 20, when it is assumed that the specific gravity of the ink is γ, and the head height h(m) of the ink, which is a maximum height of the ink tank 21 under an arbitrary orientation, and is relative to the ink supplying throat 24 in the vertical direction, the head pressure of the ink may be expressed as $9.8\times10^3\cdot\gamma\cdot h$ (Pa). Thus, it is necessary that the critical pressure $P_E$ (Pa) in the relational expression (4) satisfy the following condition.

$$4\cdot\eta(N\cdot R)>9.8\times10^3\cdot\gamma\cdot h$$

In other expression, in order to prevent the problem of accidental ink leakage caused when the ink cartridge 20 is inserted or detached, it is necessary to satisfy the following relational expression (13), $$\eta\cdot N\cdot R\cdot B>\gamma\cdot h \tag{13}$$

where coefficient $B=4.08\times10^{-4}$.

Moreover, the cell density of the ink absorbing body 22 (foam material) contained in the ink cartridge 20, that is, the actual cell density M=N·R (cells/m), is given by:

$$M=1575\times5.5\times1.1=9528 \text{ cells/m } (=242 \text{ cells/inch})$$

when, for example, the ink absorbing body 22 whose cell density is N=1575 (cells/m) (=40 cells/inch) and which is compressed at a compressibility of R=5 is further compressed by 10% by containment in the ink cartridge 20. Therefore, by substituting the actual cell density M (cells/m) in Expression (13), the following relational expression is obtained, $$\eta\cdot M\cdot B>\gamma\cdot h \tag{14}$$

where coefficient $B=4.08\times10^{-4}$.

The actual cell density M used here may be a measured value.

The head height h(m) of the ink, which is a maximum height of the ink tank 21 under an arbitrary orientation and is relative to the ink supplying throat 24 in the vertical direction, may be the height of the ink absorbing body 22 (foam material), or the height of inner walls of the ink cartridge 20, under usual orientation.

If different orientations of the ink cartridge 20 need to be taken into account, the head height h is the maximum vertical height relative to the supplying throat 24 of the ink cartridge 20, irrespective of how the ink cartridge 20 is positioned or inclined.

Considering a distribution of cell diameter for example, it is preferable that the safety factor is no less than 2. Therefore, it is preferable to design the ink cartridge 20 according to the following relational expression (15), $$\eta\cdot N\cdot R\cdot B>2\cdot\gamma\cdot h \tag{15}$$

or the following relational expression (16), $$\eta\cdot M\cdot B>2\cdot\gamma\cdot h \tag{16}$$

where coefficient $B=4.08\times10^{-4}$.

As described, the ink cartridge commonly has a height less than approximately 40 mm, taking into account fluctuations of the ink level. Therefore, as described, it is preferable that the specific critical pressure in the cells of the ink absorbing body 22 (foam material) is about 0.8 kPa (0.08 $mH_2O$) when the safety factor is 2. Thus, the specific critical pressure $P_E$ (Pa) in the cells 22*a* of the ink absorbing body 22 (foam material) preferably satisfies $P_E\geqq800$.

Therefore, according to Expression (4), the critical pressure $P_E$ (Pa) in the cells 22*a* of the ink absorbing body 22 (foam material), i.e., the ink retaining power of the ink absorbing body 22 (foam material), can be maintained at or above 0.8 kPa (800 Pa) by satisfying the following relational expression (17), $$4\cdot\eta N\cdot R\geqq800 \tag{17}$$

or the following relational expression (18), $$4\cdot\eta M\geqq800 \tag{18}$$

In this way, it is possible to prevent the problem of accidental ink leakage caused when the ink cartridge 20 is inserted or detached.

FIG. 17 shows that there is a significant overlap between the calculated negative pressures according to the theoretical values (theoretical critical pressure Px) given by the relational expression (4) and the negative pressure (minimum ink stable negative pressure PL) that were actually measured. Table 4 shows negative pressures for the actual cell densities M (=N·R) under different settings.

Next, a critical pressure Pn (this term may hereinafter be referred to as a critical pressure of a nozzle in some cases) is calculated that is created when the ink retreats at an orifice in response to ink discharge from an ink discharge nozzle (ink nozzle section) 1*a*.

It is assumed that, as shown in FIG. 20, the orifice is shaped to have a round nozzle that is 20 μm in diameter and 20 μm in length, and that a frustum of a cone having an apex angle of 90° and an apex circle diameter of 20 μm extends from an end (nozzle end) of the discharge nozzle 1*a*.

Assuming that the ink flow rate is Q=8.17 $nm^3/s$ (0.49 cc/min) in a setting where the ink discharge frequency of the discharge nozzle 1*a* of the print head 1 is 8000 pps and the number of nozzles is 64, a drop of ink is:

$$(8.17\times10^{-9})/8000/64=1.6\times10^{-14}(m^3)(=16pL).$$

On this assumption, Table 5 shows diameter H of the cone portion measured on a liquid surface (meniscus) of the ink that has retreated in response to discharge of the ink. In Table 5, the diameter H=20 μm is the diameter at the tip of a nozzle that has been processed to have a sufficiently long straight portion (refer to FIG. 20), for example, by excimer laser processing. Table 5 shows the case where an ink droplet had a volume of $1.6\times10^{-14}$ ($m^3$) (=16 pL). Further, the measurement in this case was made under two different conditions: one not considering transient vibration of the meniscus at the end of the nozzle; and one considering transient vibration of the meniscus at the end of the nozzle so that the amount of ink retreat is twice as much as the amount of the ink discharged, as shown in FIG. 21(*a*) through FIG. 21(*h*).

FIGS. 21(*a*) through 21(*h*) are cross-sectional views showing sequence of discharging state of the ink from the ink discharge nozzle 1*a*. For example, an inkjet recording apparatus of 600 dpi requires an ink droplet of $1.6\times10^{-14}$ to $2.0\times10^{-14}$($m^{3)(=}$16 to 20 pL)

The critical pressure Pn (Pa) of the nozzle (the discharge nozzle 1*a* in the present embodiment) can be given as follows by substituting the diameter H (m) of the cone portion in the foregoing general expression (12):

$$Pn=4\cdot\eta/H \text{ (more strictly, } Pn\approx4\cdot\eta/H) \quad (19).$$

A necessary condition for not causing depletion of the ink is (Pμ)<(Pn). When the diameter of the discharge nozzle 1*a* is $D_N$(m), it is necessary for avoiding depletion of the ink to satisfy the following relational expression (20), according to the relational expression (10) and the general expression (19), $$(k/A)\cdot[\mu\cdot L\cdot(N\cdot R)^2/S]\cdot Q<4\cdot\eta/D_N \quad (20)$$

where (k/A) is a coefficient=485.

That is, the relational expression (20) can be rearranged into $$C\cdot[\mu\cdot L\cdot Q\cdot(N\cdot R)^2/S]<\eta/D_N \quad (21)$$

where C is a coefficient of C=(k/A)/4=121.

Further, by plugging the actual cell density M (number/m) into the relational expression (21), the necessary condition is $$C\cdot[\mu\cdot L\cdot Q\cdot M^2/S]<\eta/D_N \quad (22)$$

where C is a coefficient of C=(k/A)/4=121.

Table 5 shows values of critical pressure Pn of the discharge nozzle 1*a*, calculated according to the general expression (19) under different settings.

TABLE 5

| CONDITION | H (μm) | Pn (kPa) |
|---|---|---|
| NOZZLE ONLY | 20 | 6.00 |
| $1.6\times10^{-8}$ (cc) TRANSIENT VIBRATION NOT CONSIDERED | 42 | 2.84 |
| $1.6\times10^{-8}$ (cc) TRANSIENT VIBRATION CONSIDERED | 47 | 2.54 |

Table 5 indicates that the critical pressure Pn, which is the ink drawing force generated by the meniscus that has retreated at the end of the nozzle after the discharge of the ink, becomes larger than the negative pressure (the critical pressure of the ink absorbing body 22 or the filter 23) of the ink supply system when the negative pressure of the supply system is approximately at or lower than approximately 2.0 kPa in continuous discharge of the ink, by taking into consideration the safety ratio, that is, errors in transient vibration and flow rate. As a result, it is possible to stably supply a necessary amount of ink even during continuous discharge of the ink.

Therefore, by so setting the negative pressure of the supply system to be no larger than approximately 2.0 kPa, it is possible to prevent the problem that the negative pressure generated by the supply system causes depletion of the ink, and that air is sucked into the nozzle as the liquid level (ink meniscus) of the ink retreats too much from the end of the nozzle. As a result, it is possible to stably supply the ink even when continuous discharge of the ink is carried out.

Note that, when the negative pressure of the ink supply system is adjusted to be no larger than 2.0 kPa, the ink absorbing force by surface tension of the meniscus becomes larger than the negative force, so that the ink is absorbed, and the meniscus moves ahead and charging of ink is carried out. The charging is completed when the negative pressure of the ink supply system and the absorbing force of the meniscus become even. On the other hand, when the negative pressure generated in the ink supply system becomes larger than the critical pressure of meniscus, the meniscus retreats, and air is sucked into the print head 1, thus causing inadequate discharge.

Further, considering the efficiency τ (tank efficiency), which is a volume ratio of discharged ink to the volume of the ink cartridge 20 in a fully charged state, the upper limit of the actual cell density M is approximately $12.6\times10^3$ (cells/m) (=320 cells/inch). Thus, according to Table 1, the critical pressure of ink, i.e., the minimum ink stable negative pressure PL (Pa) which depending on the critical pressure $P_E$ of the liquid surface of the ink absorbing body 22, which is based on the surface tension η of the ink, is 1.5 kPa at the cell density above. Further, since the head pressures of the print head 1*a* and the ink tank 21 are generally determined to be relatively low, for example, 40 mm or similar, the value of 2.0 kPa can also be found in addition of the $P_E$ and Pi.

To summarize the above analysis, the condition required for the cell density N and compressibility R of the ink absorbing body 22 (foam material) is given by the following relational expressions (23) and (24), which are respectively lead from the relational expressions (13) and (21)

$$(N\cdot R)>\gamma\cdot h/(\eta\cdot B) \quad (23)$$

where B is a coefficient of $B=4.08\times10^{-4}$, $$[\eta\cdot S/(C\cdot D_N\cdot\mu\cdot L\cdot Q)]^{0.5}>(N\cdot R) \quad (24)$$

where C is a coefficient of C=(k/A)/4=121.

That is, a necessary condition required for the cell density N and compressibility R of the ink absorbing body 22 (foam material) is given by the following relational expression (25), according to the relational expressions (23) and (24), $$[\eta\cdot S/(C\cdot D_N\cdot\mu\cdot L\cdot Q)]^{0.5}>(N\cdot R)>\gamma\cdot h/(\eta\cdot B) \quad (25)$$

where B is a coefficient of $B=4.08\times10^{-4}$, and C is a coefficient C=121.

Further, a necessary condition for the actual cell density M=N·R, (number/m) of the ink absorbing body 22 (foam material) in a mounted state is given as follows from the relational expressions (14) and (22).

$$[\eta\cdot S/(C\cdot D_N\cdot\mu\cdot L\cdot Q)^{0.5}>M>\gamma\cdot h/(\eta\cdot B) \quad (26)$$

where B is a coefficient of $B=4.08\times10^{-4}$, and C=121.

Accordingly, by satisfying the relational expression (25) or (26), it is possible to prevent ink leakage when the ink cartridge 20 is inserted or detached, and to stably supply ink when continuous discharge is carried out.

Note that, the conditions commonly adopted for the ink of ink jet printers are:

Viscosity μ=0.015 to 0.15 (Pa·s);

Surface tension of the ink η=0.03 to 0.05 (N/m); and

Cell density of the ink absorbing body 22 (foam material) $N=1.57\times10^3$ to $3.94\times10^3$ (cells/m) (=40 to 100 cells/inch).

In view of this, for example, the following conditions were used for analysis

Viscosity μ=0.015 (Pa·s),

Surface tension of the ink η=0.04 (N/m), and

Cell density of the ink absorbing body 22 (foam material) $N=3.15\times10^3$ (cells/m) (=80 cells/inch). This analysis shows that the respective Expressions above can be satisfied under different condition.

As described, regardless of weather or not the filter is used, if the opening of the filter is larger than the cells 22*a* of the ink absorbing body (foam material) 22, the negative pressure generated in the ink supplying system depends on the critical pressure $P_E$ (Pa) of the liquid surface in the cells 22*a* (capillary tube), i.e., the critical pressure $P_E$ of the ink absorbing body 22 when the ink is depleted.

However, when the opening of the filter is made smaller than the cells 22*a* of the ink absorbing body 22 so as to ensure the filtration ability of the filter, or when the ink absorbing body 22 (foam material) is not used, the negative pressure (critical pressure of the ink absorbing body 22 or of the filter) generated in the ink supplying system depends on the critical pressure Pm(Pa) by the filter.

Therefore, when the opening of the filter is smaller than the cells 22*a* of the ink absorbing body (foam material) 22, the following relational expression (27) needs to be satisfied so as to adjust the negative pressure generated in the ink supplying system to be not more than 2.0 kpa.

$$Pm \leqq 2000(Pa) \tag{27}$$

Further, as shown in the foregoing general expression (1) and the empirical expression (2), the critical pressure Pm (Pa) by the filter depends on the ink surface tension η (N/m) and the size of the filter, i.e., the filtration accuracy F(m) of the filter. Thus, according to the foregoing general expression (1) and the empirical expression (2), the following relational expression (28) needs to be satisfied so as to satisfy Pm≦2000(Pa), $$Pm = 4 \cdot \eta / F' \tag{28}$$

where F(m) expresses the filtration accuracy of the filter.

(F'=F when the opening of the filter is circle; $F' = \sqrt{2} \cdot F$ in other cases)

Therefore, according to the foregoing relational expressions (27) and (28), by providing a filter which satisfies the foregoing relational expression (27) and the following relational expression (29), in a portion of the ink supplying path 3 on the side of the ink tank 21, it is possible to adjust the negative pressure generated in the ink supplying system, i.e., the negative pressure (critical pressure Pm by the filter) generated in the filter when the ink is supplied, to be lower than the absorbing pressure (critical pressure of the nozzle) generated in the discharge nozzle 1*a* of the print head 1 (Pn>Pm).

$$F' = 4 \cdot \eta / Pm \tag{29}$$

(F'=F when the opening of the filter is circle; $F' = \sqrt{2} \cdot F$ in other cases)

Accordingly, by providing such a filter in the ink supplying path 3, the ink absorbing force becomes larger than the negative pressure generated in the ink supplying system and also become larger than the surface tension of the meniscus in the opening; and therefore, it is possible to prevent air from entering into the nozzle end of the print head, thus securely supplying (charging) the ink. As with the case above, the ink supplying operation is completed when the negative pressure of the ink supplying system and the absorbing force of the ink meniscus become even. On the other hand, when the critical pressure by the meniscus of the nozzle end is not more than the critical pressure of the meniscus formed on the opening of the filter (i.e., Pn≦Pm), particularly, when it is smaller than the critical pressure (Pm), the meniscus of the nozzle end retreats, and air is sucked into the print head 1, thus causing inadequate discharge.

More specifically, when the ink is supplied to the print head 1, the pressure by which the print head 1 absorbs the ink, i.e., the pressure (ink absorbing pressure) by the meniscus of the discharge nozzle 1*a* of the print head 1 is applied to the ink supplying path 3 (filter). Further, when the ink absorbing pressure, i.e., the critical pressure Pn of the discharge nozzle 1*a* is not more than the negative pressure generated in the filter when the ink is supplied, i.e., the critical pressure Pm (filter pressure) of the meniscus formed on the opening of the filter (i.e., Pn≦Pm), particularly, when it is smaller than the critical pressure (Pm), air is sucked into the print head 1 before the meniscus on the opening of the filter breaks.

Accordingly, by adjusting the pressure by the meniscus of the discharge nozzle 1*a* when the ink is supplied to the print head 1, i.e., the ink absorbing pressure (the critical pressure Pn of the discharge nozzle 1*a*) to be larger than the filter pressure (the critical pressure Pm by the filter), the foregoing problem can be prevented.

Therefore, by adjusting the negative pressure, generated in the filter when the ink is supplied, to be smaller than the ink absorbing pressure of the nozzle 1*a* of the print head 1, more specifically, by constituting the image forming device with the conditions for offering the smaller negative pressure (especially the conditions of the filter), the foregoing problem can be prevented.

To realize such a structure, it is preferable that the filter provided in the ink supplying path, more specifically, in a portion (end portion) of the ink supplying path 3 on the side of the ink tank 21, is designed so that the negative pressure generated in the filter when the ink is supplied becomes smaller than the ink absorbing pressure of the nozzle 1*a* of the print head 1. To meet this condition, the filter has to be made with the conditions denoted by the foregoing relational expressions (27) and (29), and the following relational expression (30).

$$F' \geqq 4 \cdot \eta / 2000 \tag{30}$$

(F'=F when the opening of the filter is circle; $F' = \sqrt{2} \cdot F$ in other cases)

Note that, water has the maximum surface tension as a liquid, which is 0.072; and the ink surface tension η has to be adjusted in a range from 0.03 to 0.06 N/m, so as to prevent reduction of discharging power, the air entering into the nozzle end of the discharge nozzle 1*a*, inadequate discharge of ink due to the ink stained around the discharge nozzle 1*a* or due to leakage of ink, or degradation of image quality due to stains of ink on the paper. Generally, the ink surface tension η is set in a range from 0.03 to 0.05 N/m.

Therefore, according to the relational expression (30), when the ink surface tension η is set to 0.03 N/m in the image forming device of the present embodiment, the negative pressure applied to the ink supplying system, i.e., the critical pressure Pm applied to the filter 23 may be adjusted to be not more than 2000 pa, by making the filter 23 by using a filter with a filtration accuracy F(m) of at or larger than $42 \times 10^{-6}$ (m), i.e., at or larger than 42 μm, more preferably, by using a filter satisfying $F \geqq 50 \times 10^{-6}$ (m) (assuming that the margin considering variation of surface tension, filtration accuracy F etc. is approximately 20%). This theory can be proved with reference to FIG. 9, in which the critical pressure Pm (maximum negative pressure) of negative pressure of ink by the filter 23 (mesh filter) is 2.0 kPa with respect to the filtration accuracy F of 50 μm, i.e., $50 \times 10^{-6}$ (m).

Meanwhile, when the filter 23 is made of a filter with a circular opening, according to the relational expression (30), the negative pressure applied to the ink supplying system, i.e., the critical pressure Pm applied to the filter 23 may be adjusted to be not more than 2000 pa, by making the filter 23 by using a filter with a filtration accuracy F(m) of at or larger than $60\times10^{-6}$ (m), i.e., at or larger than 60 μm, more preferably, by using a filter satisfying $F\geqq70\times10^{-6}$ (m) (assuming that the margin considering variation of surface tension, filtration accuracy F etc. is approximately 20%).

As described, the ink cartridge 20 of the inkjet recording apparatus includes a mesh filter 23 at the end of the ink supplying path 3 on the side of the ink tank 21. With this mesh filter 23, the negative pressure applied to the ink supplying system, i.e., the critical pressure Pm applied to the filter 23 may be adjusted to be not more than 2000 pa.

With this structure, the ink absorbing pressure (the pressure required for supplying ink) generated upon discharge of an ink droplet from the print head 1, i.e., the pressure (ink supplying pressure) applied to the ink absorbing body 22 does not affect to the internal part of the ink tank 21, and therefore, the ink supplying pressure becomes smaller than the filter pressure applied to the opening 23*a* (mesh) of the filter 23.

Thus, the foregoing inkjet recording apparatus can prevent entry of air into the ink supplying path 3 before the meniscus of ink formed on the opening 23*a* (mesh) of the filter 23 breaks. Further, when air enters into the ink supplying path 3 as the meniscus breaks, which is detected as an indication that the ink is depleted; the meniscus does not retreat too much from the nozzle end, thus preventing the nozzle end from sucking the air.

Further, in cases where the air bubbles entered into the ink tank 21 when the ink is fully charged are captured by a front surface of the filter 23, i.e., by a part of the end of the filter 23 on the side of the ink tank 21; or, in cases where a part of the ink absorbing body 22 in an empty state is in contact with the filter 23 when the ink tank 21 almost run out of ink (close to depletion); by satisfying the condition of $Pm>P_E$, it is possible to effectively supplying ink from the ink absorbing body 22 to the print head 1 while blocking air (air bubbles) in the filter 23, in other words, it is possible to prevent air from accidentally entering into the ink supplying throat 3*a* via the ink tank 21.

Here, as described, when the ink in the ink cartridge 20 is almost depleted, the cells 22*a* at the lower end of the ink absorbing body 22 (foam material) can be regarded as a capillary tube. Thus, the critical pressure $P_E$ (Pa) by the ink absorbing body 22 when the ink is depleted, i.e., the critical pressure $P_E$ (Pa) of liquid surface (ink meniscus) of the cells 22*a* is found by the relational expression (4).

Meanwhile, since the critical pressure Pm by the filter 23 with a filtration accuracy F(m) can be found by the Expression 2, the foregoing condition for preventing air from accidentally entering into the ink supplying throat 3*a* via the ink tank 21 can be denoted by the following relational expression (31), with reference to the foregoing empirical expression (2) and the relational expression (4).

$$(4\cdot\eta)/(\sqrt{2}\cdot F)>4\cdot\eta\cdot(N\cdot R) \tag{31}$$

Thus, by re-arranging this Expression (31) in terms of the filtration accuracy F, the following relational expression (32) can be obtained.

$$\sqrt{2}\cdot F<1/(N\cdot R) \tag{32}$$

Further, according to the general expression (1), the critical pressure Pm' by the filter with a circular opening may be denoted by the following general expression (33) by using the ink surface tension η (N/m) and the filtration accuracy F (m).

$$Pm'=4\cdot\eta/F \tag{33}$$

Thus, as with the case of using the filter 23, in the case of using a filter having a circular opening with a filtration accuracy F(m), the condition for preventing air from accidentally entering into the ink supplying throat 3*a* via the ink tank 21 can be denoted by the following relational expression (34), with reference to the foregoing relational expression (4) and the general expression (3).

$$F<1/(N\cdot R) \tag{34}$$

Therefore, in the case of providing a filter with a filtration accuracy F(m) in the ink supplying path 3; by designing the ink cartridge 20 by satisfying the following relational expression (35), it is possible to adjust the ink supplying pressure to be smaller than the negative pressure applied to the filter 23, and thus to prevent entry of air into the ink supplying path 3 by breaking meniscus of ink formed on the opening 23*a* of the filter 23, $$F'<1/(N\cdot R) \tag{35}$$

($F'=F$ when the opening of the filter is circle; $F'=\sqrt{2}\cdot F$ in other cases)

where N expresses the cell density (cells/m) of the ink absorbing body 22 before contained in the ink tank 21, and R expresses the compressibility, which is denoted by a ratio of the volume of the ink absorbing body 22 when contained in the ink tank 21 in a compressed state to the ratio of the ink absorbing body 22 before contained in the ink tank 21. Accordingly, this structure can prevent entry of air into the ink supplying path 3 by other factor than decreases of ink remaining amount, thus avoiding error operation in detecting the remaining amount of ink. With this function, it is possible to carry out printing with high image quality.

Note that, the foregoing condition for adjusting the negative pressure for supplying ink (when ink is depleted) may be modified by specifying the cell diameter, instead of specifying the filtration accuracy F(m). However, the condition of specifying the filtration accuracy (i.e., the minimum length (minimum gap) of the opening) with small variation ensures more stable negative pressure than that of specifying the cell diameter with large variation.

Further, in the foregoing embodiment, N (cells/m) expresses the cell density of the ink absorbing body (22) before contained in the ink tank 21 (ink containing section), and R expresses the compressibility R, which is denoted by a ratio of the volume of the ink absorbing body 22 when contained in the ink tank 21 in a compressed state to the ratio of the ink absorbing body 22 before contained in the ink tank 21. However, the ink absorbing body may be compressed when contained in the ink containing section, or may be compressed in advance.

The ink absorbing body may be made of a foam material (processed by heat in a compressed state to have eternal compression), a common material of the ink absorbing body. The foam material may be a compressed sponge or the like. In this case, the cell density N (cells/m) is determined with the ink absorbing body before being compressed, and the compressibility (compression rate) R is denoted by a ratio of the respective volumes of the ink absorbing body 22 before and after being processed into a compressed state, i.e., the volume difference of the ink absorbing body when the foam material after being compressed is inserted in the ink tank as the ink absorbing body.

Thus, when N' expresses the cell density (cells/m) of the ink absorbing body before being compressed, and R' expresses the compressibility (compression rate) denoted by a ratio of the respective volumes of the ink absorbing body 22 before and after being processed into a compressed state. Accordingly, the foregoing Expressions can be used under conditions N=N' and R=R'.

For example, where N' (cells/m) expresses the cell density (cells/m) with the ink absorbing body before being compressed, and R' expresses the compressibility (compression rate) denoted by a ratio of the respective volumes of the ink absorbing body 22 before and after being processed into a compressed state, the foregoing relational expression (35) may also be denoted by the following relational expression (36).

$$F'<1/(N'\cdot R') \tag{36}$$

(F'=F when the opening of the filter is circle; $F'=\sqrt{2}\cdot F$ in other cases)

Note that, the condition N=N' and R=R' may be adopted for the foregoing Expressions above, and also the Expressions shown later. Further, the actual cell density M can of course be used instead of N·R or N'·R'.

Further, Assuming that the diameter of the discharge nozzle 1*a* is $D_N$ (m), the critical pressure Pn (Pa) of the meniscus of the discharge nozzle 1*a* may be expressed by the following general expression (37), according to the relational expression (19).

$$Pn=4\cdot\eta/D_N \tag{37}$$

Here, the condition for preventing air from entering into the nozzle end is Pn>Pm, and the condition for effectively supplying ink from the ink absorbing body 22 to the print head 1 while preventing air from accidentally entering into the ink supplying throat 3*a* via the ink tank 21 is $Pm>P_E$. Accordingly, in order to more effectively prevent entry of air into the ink supplying path 3 by other factor than decreases of ink remaining amount, and avoiding error operation in detecting the remaining amount of ink, it is necessary to satisfy the following condition.

$$Pn>Pm>PE$$

Further, it is more preferably to satisfy the following relational expression (38), which is based on the foregoing relational expressions (31) and (37).

$$(4\cdot\eta/D^N)>(4\cdot\eta)/F'>4\cdot\eta\cdot(N\cdot R) \tag{38}$$

(F'=F when the opening of the filter is circle; $F'=\sqrt{2}\cdot F$ in other cases)

Therefore, by re-arranging the foregoing Expression (38) in terms of the filtration accuracy F' (m), there obtains the following relational expression (39).

$$D_N<F'<1/(N\cdot R) \tag{39}$$

(F'=F when the opening of the filter is circle; $F'=\sqrt{2}\cdot F$ in other cases)

Next, the following discusses influence of the ink level changing as the ink is consumed. As shown in Figure assuming that the head pressure of head due to level difference h between the ink supplying throat 24 and the front end of the discharge nozzle 1*a* (nozzle end), the effective retaining force Pn' (Pa) by the ink meniscus in the discharge nozzle 1*a* may be defined by the following Expression (40).

$$Pn'=Pn-|Ph| \tag{40}$$

Note that, |Ph| denotes the absolute value of the Ph. That is, || is a symbol of an absolute value. Accordingly, hereinafter, |x| denotes an absolute value of x.

Here, the condition for preventing the meniscus from retreating too much from the nozzle end, which causes the air to enter into the nozzle end may be denoted by the following relational expressions (41) and (42), respectively in the case where the ink is fully charged and in the case where the ink is depleted.

$$Pn'>|P\mu|-|Pi| \tag{41}$$

$$Pn'>Pm \tag{42}$$

If not considering the head pressure Ph of head (head of ink), the condition for preventing the air from entering into the nozzle end is Pn>Pm as described above; However, by taking the head pressure Ph of head into account, the condition becomes more suitable for practical use. More specifically, the head pressure Ph of head is adjusted so as to generate the negative static pressure for preventing leakage of ink from the nozzle end, and therefore, the inkjet recording apparatus is used under conditions allowing the nozzle end to more easily absorb air than the case of taking no account of the head pressure Ph of head. Thus, by taking the head pressure Ph of head into account, it is possible to make the condition of the apparatus more suitable for practical use.

Here, with the use of the filter 23 for blocking foreign bodies, the Pm is denoted as follows.

$$Pm>|P\mu|+|Pi| \tag{43}$$

Accordingly, with reference to the foregoing relational expressions (42) and (43), the following Expression is obtained.

$$Pn'>Pm>|P\mu|+|Pi| \tag{44}$$

Further, with reference to the foregoing relational expressions (41) and (44), the following Expression is obtained.

$$Pn'>Pm>|P\mu|+|Pi|>|P\mu|-|Pi|$$

Thus, by satisfying relational expression (44), in other words, assuming that the diameter of the discharge nozzle 1*a* is $D_N$(m), by satisfying the following relational expression (45) with reference to the foregoing empirical expression (2) and the general expression (37), it is possible to appropriately control leakage of pressure of the filter 23 when ink is supplied (especially when ink is supplied immediately before the ink is depleted) so that the leakage does not exceed the critical pressure Pn of the discharge nozzle 1*a* of the print head 1, and thus prevent the discharge nozzle 1*a* from sucking air and also effectively filtrate foreign substances flowing toward the ink supplying path 3, thus ensuring higher reliability of the discharge operation of the discharge nozzle 1*a*. Note that, the foregoing respective Expressions, for example, the relational expressions (41), (43) through (45) uses the value of Pμ given by the relational expression (10).

$$4\cdot\eta/DN-|Ph|>4\cdot\eta/F'>|P\mu|+|Pi| \tag{45}$$

(F'=F when the opening of the filter is circle; $F'=\sqrt{2}\cdot F$ in other cases)

The inventors of the present invention studied the relationship between viscosity and temperature of various materials. The following will describe the conclusion of the studies.

First, Table 6 below shows the relationship between temperature T(° C.) and viscosity μ (Pa·s) of various material.

TABLE 6

| | VISCOSITY μ (mPa · s) | | | |
|---|---|---|---|---|
| | 0° C. | 25° C. | 50° C. | 75° C. |
| WATER | 1.79 | 0.89 | 0.55 | 0.38 |
| ACETONE | 0.40 | 0.31 | 0.25 | 0.20 |
| ANILINE | 9.45 | 3.82 | 1.98 | 1.20 |
| ETHYL ALCOHOL | 1.87 | 1.08 | 0.68 | 0.46 |
| DIETHYL ETHER | 0.29 | 0.22 | 0.18 | 0.15 |
| CARBON TETRACHLORIDE | 1.34 | 0.91 | 0.66 | 0.50 |
| RICINUS OIL | — | 700.00 | 125.00 | 42.00 |
| SULFURIC ACID | — | 23.80 | 11.70 | 6.60 |

Figure 22:
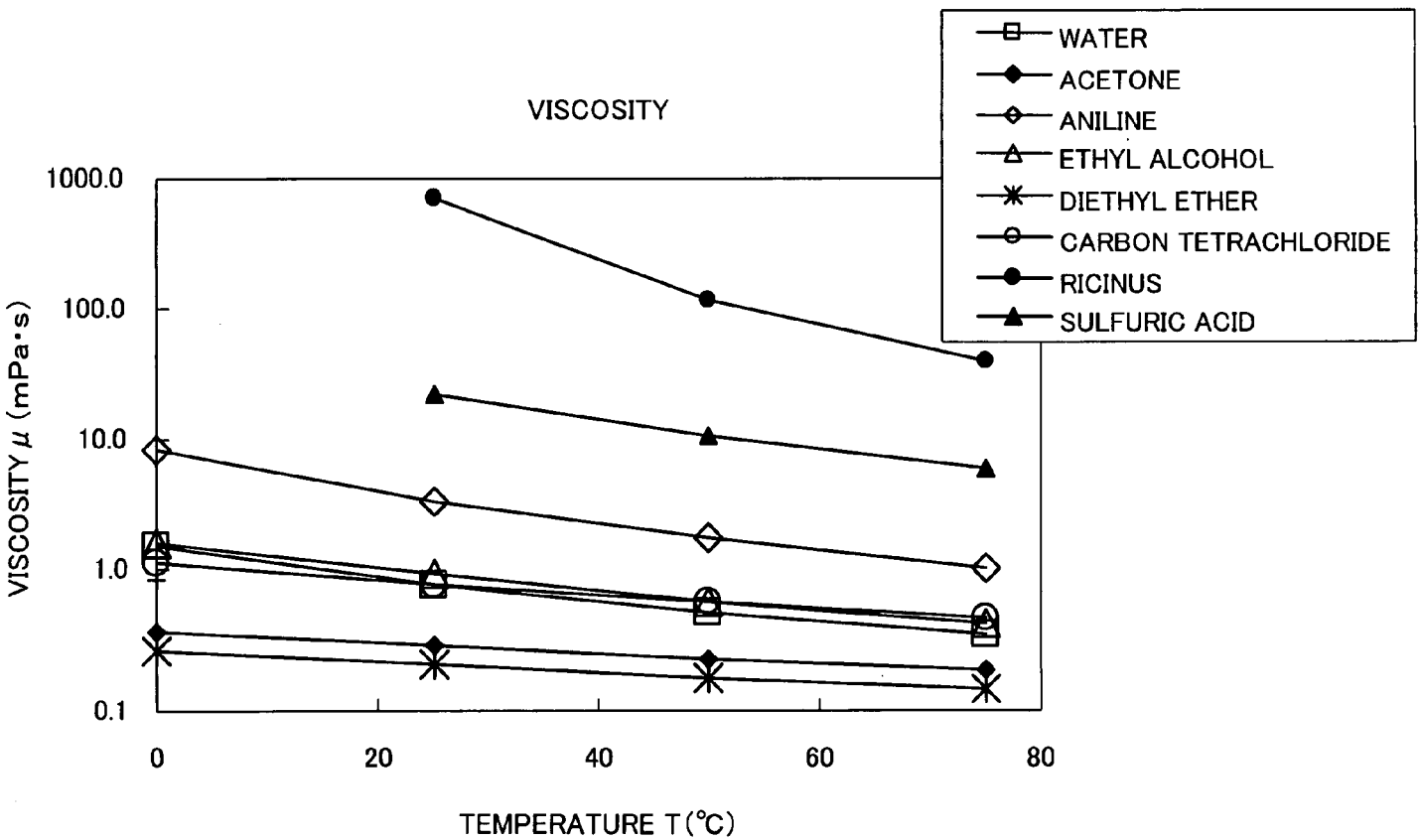
FIG. 22 is a graph created based on the data of Table 6, for showing a relationship between the temperature T (° C.) and viscosity μ (Pa·s).

FIG. 22 shows the relationship between temperature T(° C.) and viscosity μ (Pa·s), based on values of Table 6. However, FIG. 22 is not sufficient to find the correlation between temperature T(° C.) and viscosity μ (Pa·s).

Further, Table 7 below shows viscosity $\mu_T$ (Pa·s) at different temperatures T(° C.), with respect to the viscosity $\mu_{25}$ (Pa·s) at 25° C.; more specifically, the values of viscosity $\mu_T/\mu_{25}$ (normalized viscosity) at different temperatures T(° C.), when assuming that the viscosity $\mu_{25}$ at 25° C. is 1.

TABLE 7

| | VISCOSITY $\mu_T/\mu_{25}$ | | | |
|---|---|---|---|---|
| | 0° C. | 25° C. | 50° C. | 75° C. |
| WATER | 2.01 | 1.00 | 0.62 | 0.43 |
| ACETONE | 1.30 | 1.00 | 0.80 | 0.65 |
| ANILINE | 2.47 | 1.00 | 0.52 | 0.31 |
| ETHYL ALCOHOL | 1.73 | 1.00 | 0.63 | 0.43 |
| DIETHYL ETHER | 1.29 | 1.00 | 0.80 | 0.65 |
| CARBON TETRACHLORIDE | 1.47 | 1.00 | 0.73 | 0.55 |
| RICINUS OIL | — | 1.00 | 0.18 | 0.06 |
| SULFURIC ACID | — | 1.00 | 0.49 | 0.28 |

Figure 23:
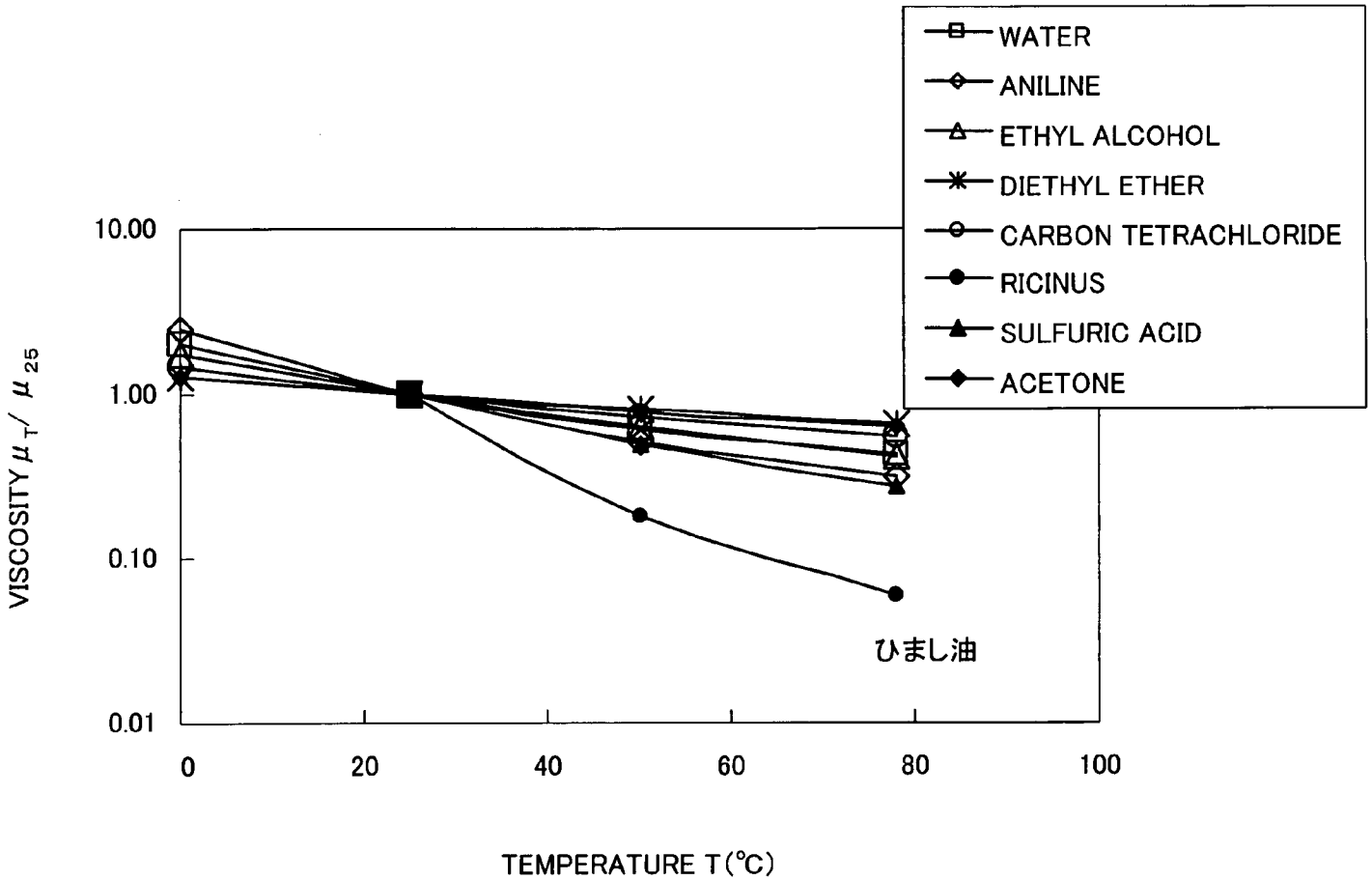
FIG. 23 is a graph created based on the data of Table 7, for showing a relationship between the temperature T (° C.) and viscosity $\mu T/\mu_{25}$ for each temperature T (° C.).

FIG. 23 shows the values of the temperature T(° C.) and the viscosity $\mu_T/\mu_{25}$ (normalized viscosity) at each temperature T(° C.), based on values of Table 7. However, FIG. 23 is not sufficient to find the correlation between the temperature T(° C.) and the viscosity $\mu/\mu_{25}$ (normalized viscosity).

Incidentally, viscosity $\mu_{TK}$ (Pa·s) of a liquid at an arbitrary temperature $T_K$ (K) is expressed by an Andrade's expression as the following general expression (46).

$$\mu_{TK}=\alpha\cdot\exp(\beta/T_K) \quad (46)$$

With this Andrade's Expression, and when the viscosity at $T_{25}$ (K) (=25° C.) is expressed as $\mu_{25}$ (Pa·s), and the viscosity of a liquid at the temperature $T_K$ (K) is expressed as $\mu_{TK}$ (Pa·s), the following general expression (47) is obtained.

$$\mu_{TK}/\mu_{25}=\exp(\beta/T_K)/\exp(\beta/T_{25})=\exp\{(1/T_K-1/T_{25})\cdot\beta\} \quad (47)$$

According to this general expression (47), the following relation is obtained.

$$Ln(\mu_{TK}/\mu_{25})=(1/T_K-1/T_{25})\cdot\beta$$

Further, the following general expression (48) is obtained.

$$\beta=Ln(\mu_{TK}/\mu_{25})/(1/Tk-1/T_{25}) \quad (48)$$

Figure 24:
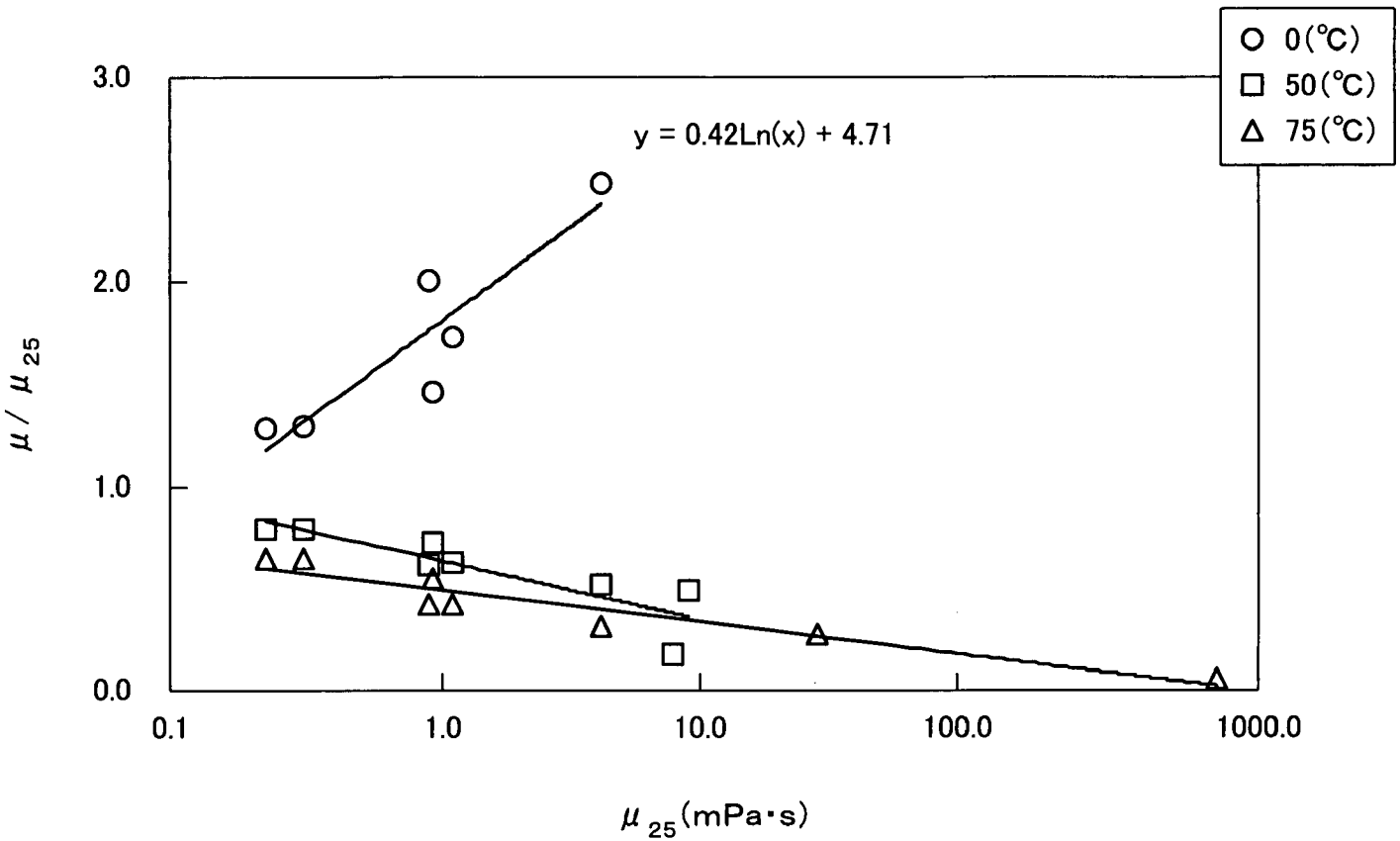
FIG. 24 is a graph created based on the data of Table 7, for showing a correlation between $\mu_{25}$ and $\mu/\mu_{25}$.

Then, FIG. 24 shows correlation between the viscosity $\mu_{25}$ and the viscosity $\mu/\mu_{25}$ (normalized viscosity), which is, in this case, correlation between $\mu_0/\mu_{25}$, $\mu_{50}/\mu_{25}$, and $\mu_{75}/\mu_{25}$, with respect to the foregoing materials, based on values shown in Table 7. Among the plot data of FIG. 24, the viscosity $\mu_0/\mu_{25}$ may be obtained by the following approximate expression (49).

$$\mu_0/\mu_{25}=0.42\cdot Ln(\mu_{25})+4.71 \quad (49)$$

Therefore, since 25° C. as an absolute temperature corresponds to 298(K), according to the foregoing general expressions (48) and (49), the following relational expression (50) is obtained.

$$\beta=Ln[0.42\cdot Ln(\mu_{25})+4.71]/(1/273-1/298) \quad (50)$$

Further, according to the Andrade's expression as the general expression (46), the viscosity $\mu_{25}$ (Pa·s) at 25° C. may be given by, $$\mu_{25}=\alpha\cdot\exp(\beta/298).$$

Thus, the following Expression (51) is further obtained.

$$\alpha=\mu_{25}/\exp(\beta/298) \quad (51)$$

Further, according to the foregoing general expressions (46), (50) and the relational expression (51), the following approximate expression (52) is obtained.

$$\mu_{TK}=\alpha\cdot\exp(\beta/T_K)$$

(where $$\alpha=\mu_{25}/\exp(\beta/298),\ \beta=\mathrm{Ln}[0.42\cdot\mathrm{Ln}(\mu_{25})+4.71]/(1/273-1/298)] \quad (52)$$

Further, Table 8 below shows the approximately viscosity μ' (Pa·s) denoted by $\mu_{TK}$ (Pa·s) given by the approximate expression (52).

TABLE 8

| | | | APPROXIMATE VISCOSITY μ' (mPa · s) | | | |
|---|---|---|---|---|---|---|
| | Coefficient β | Coefficient α | 0° C. | 25° C. | 50° C. | 75° C. |
| WATER | 1839 | $1.86 \times 10^{-3}$ | 1.57 | 0.89 | 0.55 | 0.37 |
| ACETONE | 896 | $1.54 \times 10^{-2}$ | 0.41 | 0.31 | 0.25 | 0.20 |
| ANILINE | 2810 | $3.07 \times 10^{-4}$ | 9.06 | 3.82 | 1.84 | 0.98 |
| ETHYL ALCOHOL | 1986 | $1.38 \times 10^{-3}$ | 1.99 | 1.08 | 0.64 | 0.41 |
| DIETHYL ETHER | 540 | $3.66 \times 10^{-2}$ | 0.26 | 0.22 | 0.19 | 0.17 |
| CARBON TETRACHLORIDE | 1858 | $1.79 \times 10^{-3}$ | 1.62 | 0.91 | 0.56 | 0.37 |
| RICINUS OIL | 4938 | $4.46 \times 10^{-5}$ | 3192 | 700 | 194 | 65 |
| SULFURIC ACID | 3723 | $8.91 \times 10^{-5}$ | 74.73 | 23.80 | 9.05 | 3.95 |

Figure 25:
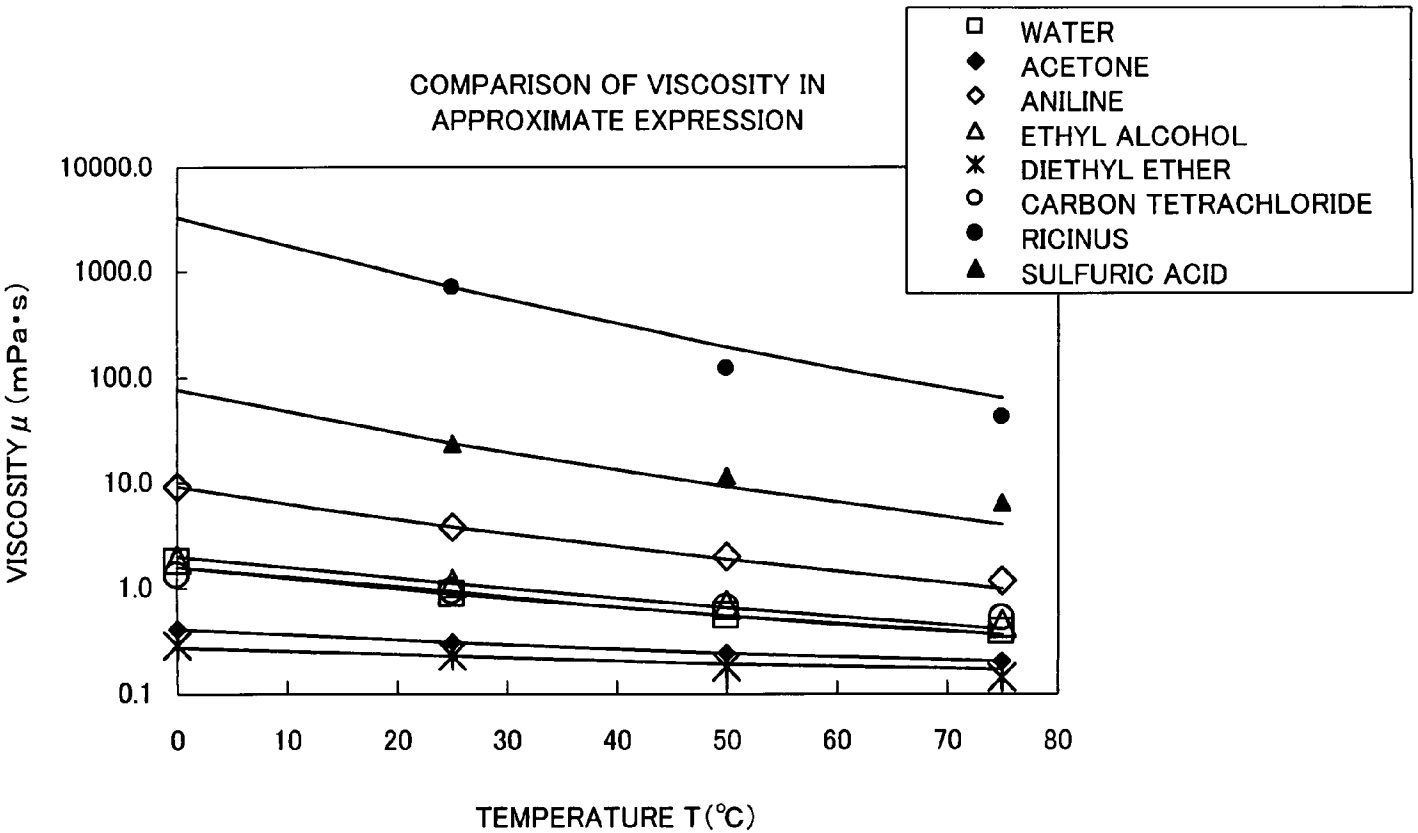
FIG. 25 is a graph showing a relationship between viscosity μ'(Pa·s) in approximate expression and actual viscosity μ(Pa·s).

Further, FIG. 25 shows the relationship between the approximate viscosity μ' (Pa·s), which is found by the foregoing approximate Expression (52), and actual viscosity μ (Pa·s). In FIG. 25, the solid line expresses the approximate viscosity μ' (Pa·s), and the respective identification symbols expresses actual viscosity μ (Pa·s).

FIG. 25 reveals that there is not much difference between the approximate viscosity μ' (Pa·s) and the actual viscosity μ (Pa·s)(i.e. the measured value). Accordingly, the accuracy of the approximate Expression (52) was proved.

Further, Table 9 shows the relationship between the temperature T (° C.) and viscosity μ (Pa·s), $\mu/\mu_{25}$, μ'/μ (approximate viscosity/measurement value), in the case of adopting the foregoing approximate expression (52) for eight kinds of ink (Ink 1 through 8), and water ($H_2O$).

TABLE 9

| | VISCOSITY μ (mPa · s) | | | VISCOSITY $\mu/\mu_{25}$ | | COEFFICIENT | | μ'/μ | |
|---|---|---|---|---|---|---|---|---|---|
| | 5° C. | 25° C. | 40° C. | 5° C. | 40° C. | β | α | 5° C. | 40° C. |
| INK 1 | 3.5 | 1.8 | 1.3 | 1.94 | 0.72 | 2345 | $6.84 \times 10^{-4}$ | 0.91 | 0.95 |
| INK 2 | 4.4 | 2.1 | 1.7 | 2.10 | 0.81 | 2446 | $5.73 \times 10^{-4}$ | 0.86 | 0.83 |
| INK 3 | 4.7 | 2.2 | 1.6 | 2.14 | 0.73 | 2476 | $5.43 \times 10^{-4}$ | 0.85 | 0.92 |
| INK 4 | 4.1 | 2.3 | 1.7 | 1.78 | 0.74 | 2504 | $5.16 \times 10^{-4}$ | 1.03 | 0.90 |
| INK 5 | 4.9 | 2.5 | 1.7 | 1.96 | 0.68 | 2556 | $4.70 \times 10^{-4}$ | 0.95 | 0.97 |
| INK 6 | 5.2 | 2.5 | 1.7 | 2.08 | 0.68 | 2556 | $4.70 \times 10^{-4}$ | 0.89 | 0.97 |
| INK 7 | 9.4 | 4.3 | 2.5 | 2.19 | 0.58 | 2878 | $2.75 \times 10^{-4}$ | 0.92 | 1.08 |
| INK 8 | 16.82 | 7.28 | 4.43 | 2.31 | 0.61 | 3162 | $1.79 \times 10^{-4}$ | 0.93 | 0.99 |
| $H_2O$ | 1.52 | 0.89 | 0.64 | 1.71 | 0.71 | 1839 | $1.86 \times 10^{-3}$ | 0.91 | 1.04 |
| | | | | | | | MAXIMUM | 1.03 | 1.08 |
| | | | | | | | MINIMUM | 0.85 | 0.83 |

Figure 26:
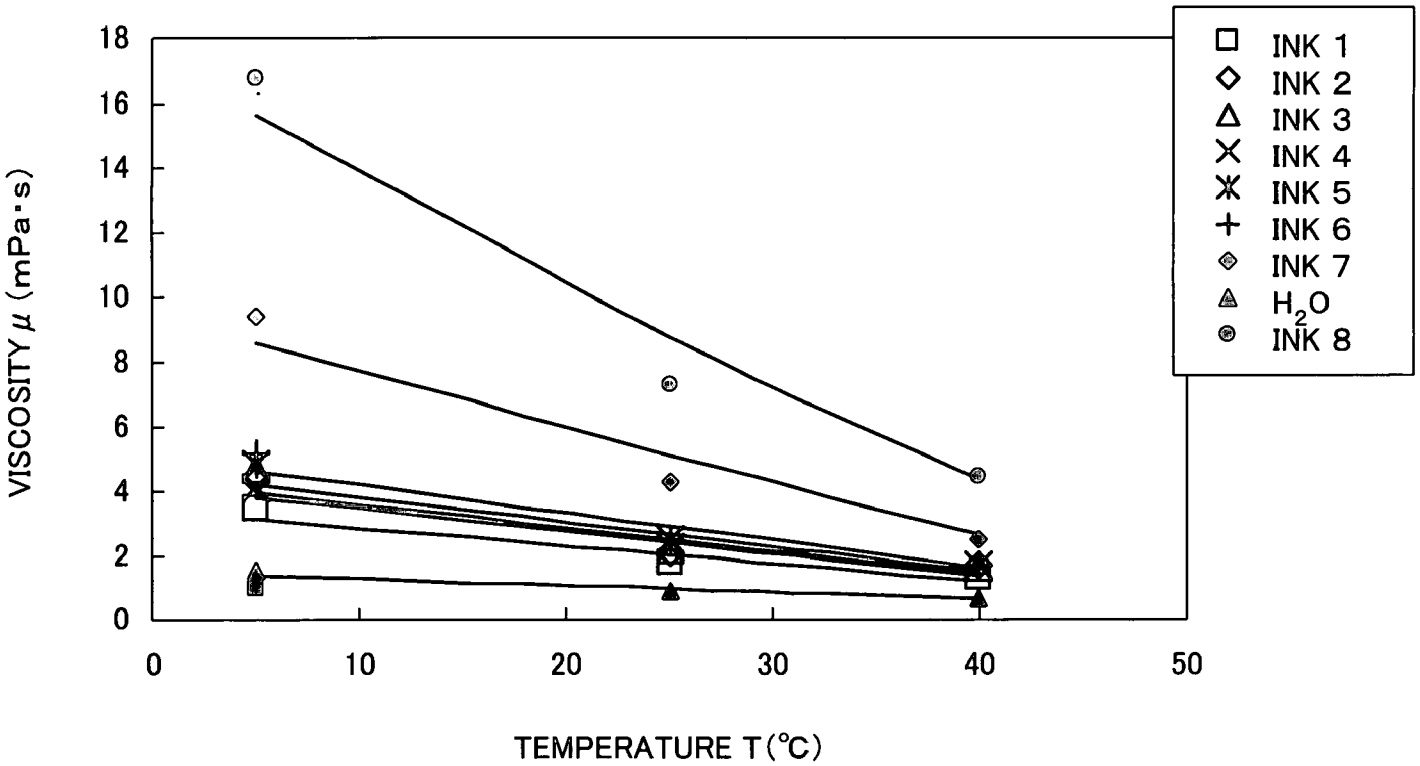
FIG. 26 is a graph created based on the data of Table 9, for showing a relationship between approximate viscosity μ'(Pa·s) and actual viscosity μ(Pa·s).
Figure 27:
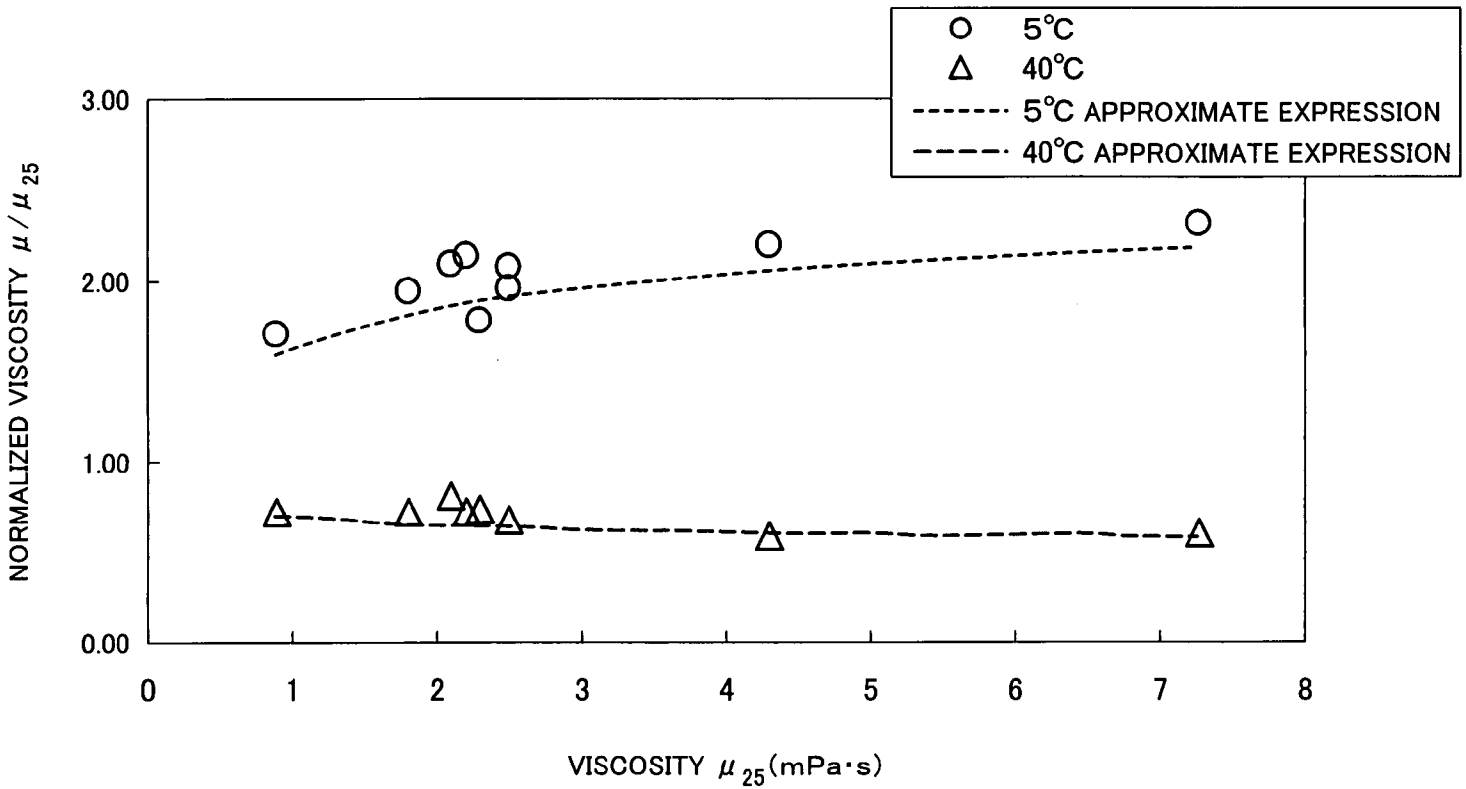
FIG. 27 is a graph showing a relationship between $\mu_{25}$ and $\mu/\mu_{25}$ in ink and water at 25° C.

FIG. 26 is a graph created based on the data of Table 9. FIG. 26 shows a relationship between approximate viscosity μ'(Pa·s) and actual viscosity μ(Pa·s). Further, FIG. 27 shows a relationship between viscosity $\mu_{25}$, and an approximate value and a measurement value of the normalized viscosity $\mu/\mu_{25}$ in the respective kinds of ink and water at 25° C. In FIG. 26, the solid line indicates the approximate viscosity μ'(Pa·s), and the respective identification symbols expresses the measurement value, i.e., actual viscosity μ (Pa·s). Further, in FIG. 27, the broken line indicates the normalized approximate viscosity $\mu'_5/\mu_{25}$ and $\mu'_{40}/\mu_{25}$, "○" indicates the normalized approximate viscosity $\mu/\mu_{25}$ (i.e., $\mu_5/\mu_{25}$) at 5° C., "Δ" indicates the normalized approximate viscosity $\mu/\mu_{25}$ (i.e., $\mu_{40}/\mu_{25}$) at 40° C. and the respective identification symbols indicates the measurement value, i.e., actual viscosity μ (Pa·s).

FIG. 26 revealed that there is not much difference between the approximate viscosity μ' (Pa·s) and the actual viscosity μ (Pa·s) with the adoption of the foregoing approximate Expression (48) for the ink of the ink cartridge 20.

According to the results of studies, the ink viscosity μ (Pa·s) at an arbitrary temperature $T_K$ (K) may be calculated under condition of μ=μ'. Further, it was proved that the use of the foregoing approximate expression (48) enables accurate calculation of the ink viscosity μ (Pa·s) at an arbitrary temperature $T_K$ (K).

According to the foregoing results, by using the approximate viscosity μ' (Pa·s) obtained by the approximate expression (52) and expressed by $\mu_{TK}$ (Pa·s) for the ink viscosity μ (Pa·s) of the relational expression (10), the relational expression (10) may be re-arranged by the following relational expression (53).

$$P\mu=(k/A)\cdot\{\mu_{TK}\cdot L\cdot(N\cdot R)^2/S\}\cdot Q \quad (53)$$

(where the coefficient (k/A)=485)

Thus, according to the foregoing relational expressions (43), (45), (52), and (53), and the empirical Expression (2), by satisfying either the following relational Expressions, it is possible to adjust the negative pressure generated in the ink absorbing body to be smaller than the critical value of the negative pressure of ink meniscus in the opening of the filter at an arbitrary temperature, thus preventing air from entering into the ink supplying path 3 by breaking the meniscus of ink formed on the mesh of the filter. Thus, this structure can prevent entry of air into the ink supplying path 3 by other factor than decreases of ink remaining amount, thus avoiding error operation in detecting the remaining amount of ink. With this function, it is possible to carry out printing with high image quality.

$$4\cdot\eta/F'>|P\mu|+|Pi|$$

$$P\mu=(k/A)\cdot[\mu_{TK}\cdot L\cdot(N\cdot R)^2/S]\cdot Q$$

(where the coefficient (k/A)=485)

$$\mu_{TK}=\alpha\cdot\exp(\beta/T_K),$$

$$\alpha=\mu_{25}/\exp(\beta/298),$$

$$\beta=Ln[0.42\cdot Ln(\mu_{25})+4.71]/(1/273-1/298)$$

(F'=F when the opening of the filter is circle; F'=$\sqrt{2}\cdot F$ in other cases), or, $$4\cdot\eta/F'>|P\mu|+|Pi|$$

$$P\mu=(k/A)\cdot\{\mu_{TK}\cdot L\cdot(N'\cdot R')^2/S\}\cdot Q$$

(where the coefficient (k/A)=485)

$$\mu_{TK}=\alpha\cdot\exp(\beta/T_K),$$

$$\alpha=\mu_{25}/\exp(\beta/298),$$

$$\beta=Ln[0.42\cdot Ln(\mu_{25})+4.71]/(1/273-1/298)$$

(F'=F when the opening of the filter is circle; F'=$\sqrt{2}\cdot F$ in other cases)

where F(m) expresses the filtration accuracy of the filter, Pi (Pa) expresses the head pressure of the ink tank 21 which occurs when the ink is going to be supplied to the print head 1 via the ink supplying path 3 when the ink tank 21 is already filled with the ink, Pμ (Pa) expresses the pressure loss due to the viscosity resistance of the ink tank 21, η (N/m) expresses the surface tension of the ink, N (cells/m) expresses the cell density of the ink absorbing body 22 before contained in the ink tank 21, R expresses the compressibility denoted by ratio of volume of the ink absorbing body 22 after contained in a compressed state in the ink tank 21 to volume of the ink absorbing body 22 before it is contained in the ink tank 21, N' (cells/m) expresses the cell density of the ink absorbing body 22 before contained in the ink tank 21, R' expresses the compressibility denoted by ratio of volume of the ink absorbing body 22 after contained in a compressed state in the ink tank 21 to volume of the ink absorbing body 22 before it is contained in the ink tank 21, S ($m^2$) expresses the cross-sectional area of the ink absorbing body 22 contained in the ink tank 21 in a compressed state, L expresses the length (m) of the ink absorbing body 22 contained in the ink tank 21 in a compressed state, $\mu_{25}$ (Pa·s) expresses the ink viscosity at 25° C., and $\mu_{TK}$ (Pa·s) expresses the viscosity at an arbitrary temperature $T_K$ (K).

Further, the foregoing condition for adjusting the negative pressure for supplying ink (when ink is depleted) may be modified by specifying the cell diameter, instead of specifying the filtration accuracy F(m). However, the condition of specifying the filtration accuracy (i.e., the minimum length (minimum gap) of the opening) with small variation ensures more stable negative pressure than that of specifying the cell diameter with large variation.

Further, by satisfying the relational expression (45), it is possible to appropriately control leakage of pressure of the filter 23 when ink is supplied (especially when ink is supplied immediately before the ink is depleted) so that amount of the leakage does not exceed the critical pressure Pn of the discharge nozzle 1*a* of the print head 1. Therefore, it is possible to prevent the discharge nozzle 1*a* from sucking air and also to effectively filtrate foreign substances flowing toward the ink supplying path 3, thus ensuring higher reliability of the discharge operation of the discharge nozzle 1*a*.

It should be noted that the present invention is not limited to the embodiments above, but may be altered within the scope of the claims. An embodiment based on a proper combination of technical means disclosed in different embodiments is encompassed in the technical scope of the present invention.

As described, an image forming apparatus according to the present invention includes: an ink containing section (for example, an ink tank provided in the ink cartridge) for retaining ink; and an ink supplying path for supplying the ink from the ink containing section to a print head, wherein: the ink supplying path therein includes a filter (for example, a filter provided in a part (end) of the ink supplying path on the side of the ink containing section), which generates negative pressure when the ink is supplied, the negative pressure being smaller than ink absorbing pressure of a nozzle of the print head.

When the ink is supplied to the print head, the pressure by which the print head absorbs the ink, i.e., the pressure (ink absorbing pressure) by the meniscus of the discharge nozzle of the print head is applied to the ink supplying path (filter). Further, when the critical value of the ink absorbing pressure is not more than the negative pressure generated in the filter when the ink is supplied, i.e., the critical pressure (filter pressure) of the meniscus formed on the opening of the filter, particularly, when it is smaller than the critical pressure, air may be sucked into the print head before the meniscus on the opening of the filter breaks.

Accordingly, by adjusting the pressure by the meniscus of the discharge nozzle when the ink is supplied to the print head, i.e., the ink absorbing pressure, to be larger than the filter pressure when the ink is supplied, the ink absorbing force becomes larger than the negative force generated in the filter when the ink is supplied, and also becomes larger than the surface tension of the meniscus on the opening of the filter, so that the ink is absorbed and the meniscus retreats. As a result, the ink is securely supplied (charged) without entry of air into the nozzle end of the print head. Therefore, this structure can prevent entry of air from the nozzle of the print head, and therefore, it is possible to prevent entry of air into the ink supplying path by other factor than decreases of ink remaining amount, thus providing an image forming apparatus capable of secure discharge of ink from the nozzle. Further, in this structure, the air bubbles etc., generated in the ink in the ink containing section due to the other factor than decreases of ink amount, for example, due to carriage vibration, or changes in temperature or atmospheric pressure or the like, is captured by the filter, thus preventing entry of air into the ink supplying path. Consequently, with this structure, it is possible to prevent error operation in detecting remaining amount of ink (in detecting that the ink is depleted).

In order to solve the foregoing problems, an image forming apparatus according to the present invention includes: an ink containing section for retaining ink; and an ink supplying path for supplying the ink from the ink containing section to a print head, wherein: the ink supplying path therein includes a filter, which generates a negative pressure of not more than 2.0 kPa, which is applied to the ink supplying path when the ink is supplied.

By thus providing a filter that makes the negative pressure of the ink supply system to be no larger than 2.0 kPa, the pressure (ink absorbing pressure) of the meniscus of the nozzle generated when the ink is supplied becomes larger than the negative pressure generated in the filter when the ink is supplied. Thus, the ink absorbing force becomes larger than the negative force generated in the filter when the ink is supplied, and also becomes larger than the surface tension of the meniscus on the opening of the filter, so that the ink is absorbed and the meniscus retreats. As a result, the ink is securely supplied (charged) without entry of air into the nozzle end of the print head. Therefore, this structure can prevent entry of air from the nozzle of the print head, and therefore, it is possible to prevent entry of air into the ink supplying path by other factor than decreases of ink remaining amount, thus providing an image forming apparatus capable of secure discharge of ink from the nozzle. Further, in this structure, the air bubbles etc., generated in the ink in the ink containing section due to the other factor than decreases of ink amount, for example, due to carriage vibration, or changes in temperature or atmospheric pressure or the like, is captured by the filter, thus preventing entry of air into the ink supplying path. Consequently, with this structure, it is possible to prevent error operation in detecting remaining amount of ink (in detecting that the ink is depleted).

As described, an image forming apparatus according to the present invention includes: an ink containing section (for example, an ink tank provided in the ink cartridge) for retaining ink; and an ink supplying path for supplying the ink from the ink containing section to a print head, the ink supplying path therein including a filter (for example, a filter provided in a part (end) of the ink supplying path on the side of the ink containing section), wherein: the image forming apparatus satisfies:

$$F'=4\eta/Pm$$

$$Pm \leqq 2000$$

(F'=F when the opening of the filter is circle; $F'=\sqrt{2}\cdot F$ in other cases)

where F(m) expresses a filtration accuracy of the filter; η (N/m) expresses a surface tension of the ink; and Pm (Pa)

expresses a critical pressure of a negative pressure generated in the filter when the ink is supplied.

By thus providing in the ink supplying path a filter which satisfies the foregoing Expression, the negative pressure applied to the ink supplying path when the ink is supplied is adjusted to be no larger than 2.0 kPa, and the pressure (ink absorbing pressure) of the meniscus of the nozzle generated when the, ink is supplied becomes larger than the negative pressure generated in the filter when the ink is supplied. Thus, the ink absorbing force by surface tension of the meniscus becomes larger than the negative force, so that the ink is absorbed, and the meniscus moves ahead and charging of ink is carried out. As a result, the ink is securely supplied (charged) without entry of air into the nozzle end of the print head. Therefore, this structure can prevent entry of air from the nozzle of the print head, and therefore, it is possible to prevent entry of air into the ink supplying path by other factor than decreases of ink remaining amount, thus providing an image forming apparatus capable of secure discharge of ink from the nozzle. Further, in this structure, the air bubbles etc., generated in the ink in the ink containing section due to the other factor than decreases of ink amount, for example, due to carriage vibration, or changes in temperature or atmospheric pressure or the like, is captured by the filter, thus preventing entry of air into the ink supplying path. Consequently, with this structure, it is possible to prevent error operation in detecting remaining amount of ink (in detecting that the ink is depleted).

Further, the foregoing image forming apparatus is preferably arranged so that: the ink containing section therein includes a porous ink absorbing body (for example, foam material) for retaining ink, the image forming apparatus satisfies:

$$D_N<F'<1/(N\cdot R)$$

(F'=F when an opening of the filter is circle; F'=$\sqrt{2}\cdot$F in other cases)

where F(m) expresses a filtration accuracy of the filter; $D_N$(m) expresses a diameter of the nozzle (ink discharging nozzle) of the print head, N (cells/m) expresses a cell density of the ink absorbing body before the ink absorbing body is contained in the ink containing section; and R expresses a compressibility, which is a volume ratio of the ink absorbing body when the ink absorbing body is contained in a compressed state in the ink containing section to the ink absorbing body before the ink absorbing body is contained in the ink containing section.

Further, the foregoing image forming apparatus is preferably arranged so that: the ink containing section therein includes a porous ink absorbing body for retaining ink, the ink absorbing body being compressed before the ink absorbing body is contained in the ink containing section, the image forming apparatus satisfies:

$$D_N<F'<1/(N'\cdot R')$$

(F'=F when the opening of the filter is circle; F'=$\sqrt{2}\cdot$F in other cases)

where F(m) expresses a filtration accuracy of the filter; $D_N$(m) expresses a diameter of the nozzle (ink discharging nozzle) of the print head, N' (cells/m) expresses a cell density of the ink absorbing body before the ink absorbing body is compressed; and R' expresses a compressibility, which is a volume ratio of the ink absorbing body when the ink absorbing body is compressed to the ink absorbing body before the ink absorbing body is compressed.

With the foregoing arrangements, it is possible to appropriately control pressure for absorbing air upon breakage of the meniscus in the opening of the filter when the ink is supplied (when ink is depleted), so that the pressure does not exceed the critical pressure of the nozzle of the print head, thus preventing the nozzle from sucking air, and also effectively filtrating foreign substances flowing toward the ink supplying path (ink flow path).

Further, with the foregoing arrangements, the meniscus in the cells of the ink absorbing body contained in the ink containing section before the ink is depleted will not accidentally suck air via the nozzle end, and therefore, the meniscus of the cells retreats to the position of the filter when the ink is discharged from the nozzle. Further, it is possible to reduce generation of air bubbles, and also to capture the generated air bubbles by the cells of the ink absorbing body before the air bubbles reach the filter. Further, air bubbles having not been captured by the cells are captured by the filter and will not enter into the ink supplying system. Thus, it is possible to prevent air from accidentally entering into the ink supplying path via the ink containing section. With this structure, the ink may be efficiently supplied from the ink absorbing body to the print head while ensuring high reliability of ink discharge operation. Accordingly, the foregoing arrangements can more efficiently prevent entry of air into the ink supplying path by other factor than decreases of ink remaining amount, thus more effectively avoiding error operation in detecting the remaining amount of ink.

Further, the foregoing image forming apparatus is preferably arranged so that: the ink containing section therein includes a porous ink absorbing body (for example, a foam material) for retaining ink, and the image forming apparatus satisfies:

$$4\cdot\eta/D_N-|Ph|>4\cdot\eta/F'>|P\mu|+|Pi|$$

$$P\mu=(k/A)\cdot\{\mu\cdot L\cdot(N\cdot R)^2/S\}\cdot Q$$

(where the coefficient (k/A)=485, F'=F when an opening of the filter is circle; F'=$\sqrt{2}\cdot$F in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

Further, the foregoing image forming apparatus is preferably arranged so that: the ink containing section therein includes a porous ink absorbing body (for example, a foam material) for retaining ink, the ink absorbing body being compressed before the ink absorbing body is contained in the ink containing section, and the image forming apparatus satisfies:

$$4\cdot\eta/D_N-|Ph|>4\cdot\eta/F'>|P\mu|+|Pi|$$

$$P\mu=(k/A)\cdot\{\mu\cdot L\cdot(N'\cdot R')^2/S\}\cdot Q$$

(where the coefficient (k/A)=485, F'=F when an opening of the filter is circle; $F'=\sqrt{2}\cdot F$ in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N' (cells/m) expresses a cell density of the ink absorbing body before the ink absorbing body is compressed; R' expresses a compressibility which is a volume ratio of the ink absorbing body when the ink absorbing body is compressed to the ink absorbing body before the ink absorbing body is compressed; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

With the foregoing arrangements, it is possible to appropriately control pressure for absorbing air upon breakage of the meniscus in the opening of the filter when the ink is supplied (when ink is depleted), so that the pressure do not exceed the critical pressure of the nozzle of the print head, thus preventing the nozzle from sucking air, and also effectively filtrating foreign substances flowing toward the ink supplying path (ink flow path). Further, the meniscus in the cells of the ink absorbing body contained in the ink containing section before the ink is depleted will not accidentally suck air via the nozzle end since it is free from influence of pressure loss of the ink absorbing body, or from changes of pressure with fluctuation of ink level when the ink is supplied; and therefore, the meniscus of the cells of the ink absorbing body contained in the ink containing section will not accidentally suck air via the nozzle end, and retreats to the position of the filter when the ink is discharged from the nozzle. Further, by having the ink absorbing body, it is possible to reduce generation of air bubbles, and also to capture the generated air bubbles by the cells of the ink absorbing body before the air bubbles reach the filter, thus preventing air from accidentally entering into the ink supplying path via the ink containing section. Accordingly, the foregoing arrangements can more efficiently prevent entry of air into the ink supplying path by other factor than decreases of ink remaining amount, thus more effectively avoiding error operation in detecting the remaining amount of ink.

Further, the foregoing image forming apparatus is preferably arranged so that: the ink containing section is provided in the ink cartridge, and therein includes a porous ink absorbing body (for example, a foam material) for retaining ink, and the image forming apparatus satisfies:

$$\eta\cdot N\cdot R\cdot B>2\cdot\gamma\cdot h$$

(coefficient $B=4.08\times10^{-4}$)

where η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; h(m) expresses a head height of the ink, which is a maximum height of the ink containing section under an arbitrary orientation and is relative to the ink supplying throat in the vertical direction; and γ expresses a specific gravity of the ink.

Further, the foregoing image forming apparatus is preferably arranged so that: the ink containing section is provided in the ink cartridge, and therein includes a porous ink absorbing body (for example, a foam material) for retaining ink, and the image forming apparatus satisfies:

$$\eta\cdot N'\cdot R'\cdot B>2\cdot\gamma\cdot h$$

(coefficient $B=4.08\times10^{-4}$)

where η (N/m) expresses a surface tension of the ink; N' (cells/m) expresses a cell density of the ink absorbing body before the ink absorbing body is compressed; R' expresses a compressibility which is a volume ratio of the ink absorbing body when the ink absorbing body is compressed to the ink absorbing body before the ink absorbing body is compressed; h(m) expresses a head height of the ink, which is a maximum height of the ink containing section under an arbitrary orientation and is relative to the ink supplying throat in the vertical direction; and γ expresses a specific gravity of the ink.

Under condition where $\eta\cdot N\cdot R\cdot B>2\cdot\gamma\cdot h$ or $\eta\cdot N'\cdot R'\cdot B>2\cdot\gamma\cdot h$, the ink retaining power becomes larger than a maximum head pressure of the ink under an arbitrary orientation, while taking account of difference of the ink surface tension η. Thus, the foregoing arrangements securely prevent the problem of accidental leakage of ink when the ink cartridge is inserted or detached. Further, upon continuous discharge of ink, it is possible to set the negative pressure, particularly the negative pressure generated in the filter when the ink is supplied (the negative pressure applied to the ink supplying path) to be lower than the ink absorbing force generated in the ink meniscus in that nozzle end of the print head from which the ink is discharged. Therefore, it is possible to prevent occurrence of inadequate ink discharge operation caused by air sucked into the ink supplying system when the liquid surface of ink retreats too much from the nozzle end due to insufficient ink supply by the negative pressure generated in the ink supplying system.

An image forming apparatus according to the present invention includes: an ink containing section (for example, an ink tank provided in the ink cartridge) therein including a porous ink absorbing body (for example, a foam material) for retaining ink; and an ink supplying path for supplying the ink from the ink containing section to a print head, the ink supplying path therein including a filter (for example, a filter provided in a part (end) of the ink supplying path on the side of the ink containing section), wherein: the image forming apparatus satisfies:

the ink containing section therein includes a porous ink absorbing body for retaining ink, the image forming apparatus satisfies:

$$F'<1/(N\cdot R)$$

(F'=F when an opening of the filter is circle; $F'=\sqrt{2}\cdot F$ in other cases)

where F(m) expresses a filtration accuracy of the filter; N (cells/m) expresses a cell density of the ink absorbing body before the ink absorbing body is contained in the ink containing section; and R expresses a compressibility, which is a volume ratio of the ink absorbing body when the ink absorbing body is contained in a compressed state in the ink containing section to the ink absorbing body before the ink absorbing body is contained in the ink containing section.

As described above, the pressure by the print head for absorbing ink, i.e., the pressure (ink absorbing pressure) of meniscus of the nozzle of the print head is applied to the ink supplying path. Here, by setting the foregoing condition, the critical value of the negative pressure generated in the ink tank may be adjusted depending on the filter.

Thus, with the foregoing arrangements, it is possible to adjust the critical value of the negative pressure generated in the ink absorbing body by the ink surface tension to be smaller than the negative pressure generated in the filter by the ink surface tension, i.e., the critical value of the pressure (filter pressure) of the meniscus of the opening (mesh) of the filter. Thus, it is possible to prevent entry of air into the ink supplying path due to breakage of the meniscus of ink formed on the opening (mesh) of the filter before the ink is depleted. With this arrangement, the meniscus of the ink absorbing body retreats with the consumption of ink, thus securing the ink supplying operation. Further, in this structure, the air bubbles etc., generated in the ink in the ink containing section due to the other factor than decreases of ink amount, for example, due to carriage vibration, or changes in temperature or atmospheric pressure or the like, is captured by the filter, thus preventing entry of air into the ink supplying path. This function ensures printing with high image quality, as well as efficient consumption of ink.

Therefore, with the foregoing arrangements, it is possible to provide an image forming apparatus with an ink supplying system designed to prevent defects upon continuous discharge of ink, such as entry of air into the ink supplying system before the ink is depleted.

Further, with the foregoing arrangements, it is possible to set the negative pressure when the ink is supplied (including the time when the ink is supplied due to depletion of ink) by specifying the filtration accuracy F(m) with small variation, thus ensuring more stable negative pressure.

The foregoing image forming apparatus is preferably arranged so that: the image forming apparatus satisfies:

$$D_N < F' < 1/(N \cdot R)$$

(F'=F when the opening of the filter is circle; $F'=\sqrt{2}\cdot F$ in other cases)

where $D_N$(m) expresses a diameter of the nozzle of the print head.

With this arrangement, the critical value of the absorbing pressure of ink meniscus of the nozzle (nozzle section) of the print head becomes larger than the critical value of the pressure of ink meniscus of the opening of the filter. This structure can prevent entry of air from the nozzle end, thus preventing inadequate discharge of the print head.

Further, with the foregoing arrangements, it is possible to prevent entry of air into the ink supplying path due to breakage of ink meniscus formed on the opening of the filter;, and therefore, this structure can prevent accidental entry of air into the ink supplying path, thus efficiently supplying the ink from the ink absorbing body to the print head. Accordingly, this structure can more effectively prevent entry of air into the ink supplying path by other factor than decreases of ink remaining amount, thus more effectively avoiding error operation in detecting the remaining amount of ink.

Therefore, with the foregoing arrangements, it is possible to provide an image forming apparatus with an ink supplying system designed to prevent defects upon continuous discharge of ink, such as entry of air into the ink supplying system before the ink is depleted.

An image forming apparatus according to the present invention includes: an ink containing section (for example, an ink tank provided in the ink cartridge) therein including a porous ink absorbing body (for example, a foam material) for retaining ink; and an ink supplying path for supplying the ink from the ink containing section to a print head, the ink supplying path therein including a filter (for example, a filter provided in a part (end) of the ink supplying path on the side of the ink containing section), wherein: the ink absorbing body is compressed before the ink absorbing body is contained in the ink containing section, and the image forming apparatus satisfies:

$$F' < 1/(N' \cdot R')$$

(F'=F when the opening of the filter is circle; $F'=\sqrt{2}\cdot F$ in other cases)

where F(m) expresses a filtration accuracy of the filter; N' (cells/m) expresses a cell density of the ink absorbing body before the ink absorbing body is compressed; and R' expresses a compressibility, which is a volume ratio of the ink absorbing body when the ink absorbing body is compressed to the ink absorbing body before the ink absorbing body is compressed.

As described above, the pressure by the print head for absorbing ink, i.e., the pressure of meniscus of the nozzle of the print head is applied to the ink supplying path. Here, by setting the foregoing condition, the critical value of the negative pressure generated in the ink tank may be adjusted depending on the filter.

Thus, with the foregoing arrangements, it is possible to adjust the critical value of the negative pressure generated in the ink absorbing body by the ink surface tension to be smaller than the negative pressure generated in the filter by the ink surface tension, i.e., the critical value of the pressure (filter pressure) of the meniscus of the opening (mesh) of the filter. Thus, it is possible to prevent entry of air into the ink supplying path due to breakage of the meniscus of ink formed on the opening (mesh) of the filter before the ink is depleted. With this arrangement, the meniscus of the ink absorbing body retreats with the consumption of ink, thus securing the ink supplying operation. Further, in this structure, the air bubbles etc., generated in the ink in the ink containing section due to the other factor than decreases of ink amount, for example, due to carriage vibration, or changes in temperature or atmospheric pressure or the like, is captured by the filter, thus preventing entry of air into the ink supplying path. This function ensures printing with high image quality, as well as efficient consumption of ink.

Therefore, with the foregoing arrangements, it is possible to provide an image forming apparatus with an ink supplying system designed to prevent defects upon continuous discharge of ink, such as entry of air into the ink supplying system before the ink is depleted.

Further, with the foregoing arrangements, it is possible to set the negative pressure when the ink is supplied (including the time when the ink is supplied due to depletion of ink) by specifying the filtration accuracy F(m) with small variation, thus ensuring more stable negative pressure.

The foregoing image forming apparatus preferably satisfies:

$$D_N<F'<1/(N'\cdot R')$$

(F'=F when the opening of the filter is circle; $F'=\sqrt{2}\cdot F$ in other cases)

where $D_N$(m) expresses a diameter of the nozzle of the print head.

With this arrangement, the critical value of the absorbing pressure of ink meniscus of the nozzle (nozzle section) of the print head becomes larger than the critical value of the pressure of ink meniscus of the opening of the filter. This structure can prevent entry of air from the nozzle end, thus preventing inadequate discharge of the print head.

Further, with the foregoing arrangements, it is possible to prevent entry of air into the ink supplying path due to breakage of ink meniscus formed on the opening of the filter;, and therefore, this structure can prevent accidental entry of air into the ink supplying path, thus efficiently supplying the ink from the ink absorbing body to the print head. Accordingly, this structure can more effectively prevent entry of air into the ink supplying path by other factor than decreases of ink remaining amount, thus more effectively avoiding error operation in detecting the remaining amount of ink.

Therefore, with the foregoing arrangements, it is possible to provide an image forming apparatus with an ink supplying system designed to prevent defects upon continuous discharge of ink, such as entry of air into the ink supplying system before the ink is depleted.

An image forming apparatus according to the present invention includes: an ink containing section (for example, an ink tank provided in the ink cartridge) therein including a porous ink absorbing body (for example, a foam material) for retaining ink; and an ink supplying path for supplying the ink from the ink containing section to a print head, the ink supplying path therein including a filter (for example, a filter provided in a part (end) of the ink supplying path on the side of the ink containing section): wherein the image forming apparatus satisfies:

$$4\cdot\eta/F'>|P\mu|+|Pi|$$

$$P\mu=(k/A)\cdot\{\mu_{TK}\cdot L\cdot(N\cdot R)^2/S\}\cdot Q$$

(where the coefficient (k/A)=485)

$$\mu_{TK}=\alpha\cdot\exp(\beta/T_K),$$

$$\alpha=\mu_{25}/\exp(\beta/298),$$

$$\beta=Ln\{0.42\cdot Ln(\mu_{25})+4.71\}/(1/273-1/298)$$

(F'=F when an opening of the filter is circle; $F'=\sqrt{2}\cdot F$ in other cases)

where F(m) expresses a filtration accuracy of the filter; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; S ($m^2$) expresses a cross-sectional area of the ink absorbing body when the ink absorbing body is contained in the ink containing section in a compressed state; L expresses a length (m) of the ink absorbing body when the ink absorbing body is contained in the ink containing section in a compressed state; $\mu_{25}$ (Pa·s) expresses an ink viscosity at 25° C.; and $\mu_{TK}$ (Pa·s) expresses a viscosity at an arbitrary temperature $T_K$ (K).

With the foregoing arrangement, it is possible to adjust the negative pressure generated in the ink absorbing body to be smaller than the critical value of the negative pressure of the ink meniscus in the opening of the filter. Thus, it is possible to prevent entry of air into the ink supplying path due to breakage of ink meniscus formed on the opening of the filter. Accordingly, this structure can prevent entry of air into the ink supplying path by other factor than decreases of ink remaining amount, thus avoiding error operation in detecting the remaining amount of ink. With this function, it is possible to carry out printing with high image quality.

Therefore, with the foregoing arrangements, it is possible to provide an image forming apparatus with an ink supplying system designed to prevent defects upon continuous discharge of ink, such as entry of air into the ink supplying system before the ink is depleted, and also designed with an account of characteristics of the ink.

Further, with the foregoing arrangements, it is possible to set the negative pressure when the ink is supplied (including the time when the ink is supplied due to depletion of ink) by specifying the filtration accuracy F(m) with small variation, thus ensuring more stable negative pressure.

The foregoing image forming apparatus preferably satisfies:

$$4\cdot\eta/D_N-|Ph|>4\cdot\eta/F'>|P\mu|+|Pi|$$

(F'=F when an opening of the filter is circle; $F'=\sqrt{2}\cdot F$ in other cases)

where $D_N$(m) expresses a diameter of the nozzle of the print head; and Ph (Pa) expresses a head pressure between an ink discharging throat of the nozzle and an ink supplying throat of the ink containing section.

With the foregoing arrangement, it is possible to appropriately control leakage of pressure of the filter when ink is supplied (especially when ink is supplied immediately before the ink is depleted) so that the leakage do not exceed the critical pressure of the discharge nozzle of the print head, and thus prevent the discharge nozzle from sucking air and also effectively filtrate foreign substances flowing toward the ink supplying path, thus ensuring higher reliability of the discharge operation of the discharge nozzle.

Therefore, with the foregoing arrangements, it is possible to provide an image forming apparatus with an ink supplying system designed to prevent defects upon continuous discharge of ink, such as entry of air into the ink supplying system before the ink is depleted.

An image forming apparatus according to the present invention includes: an ink containing section (for example, an ink tank provided in the ink cartridge) therein including a porous ink absorbing body (for example, a foam material) for retaining ink; and an ink supplying path for supplying the ink from the ink containing section to a print head, the ink supplying path therein including a filter (for example, a filter provided in a part (end) of the ink supplying path on the side of the ink containing section), wherein: the ink absorbing body is compressed before the ink absorbing body is contained in the ink containing section, and the image forming apparatus satisfies:

$$4\cdot\eta/F'>|P\mu|+|Pi|$$

$$P\mu=(k/A)\cdot\{\mu_{TK}\cdot L\cdot(N'\cdot R')^2/S\}\cdot Q$$

(where the coefficient (k/A)=485, F'=F when an opening of the filter is circle; $F'=\sqrt{2}\cdot F$ in other cases), where F(m) expresses a filtration accuracy of the filter; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; η (N/m) expresses a surface tension of the ink; N' (cells/m) expresses a cell density of the ink absorbing body before the ink absorbing body is compressed; R' expresses a compressibility which is a volume ratio of the ink absorbing body when the ink absorbing body is compressed to the ink absorbing body before the ink absorbing body is compressed; S ($M^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state; $\mu_{25}$ (Pa·s) expresses an ink viscosity at 25° C.; and $\mu_{TK}$ (Pa·s) expresses a viscosity at an arbitrary temperature $T_K$ (K).

With the foregoing arrangement, when ink is supplied, it is possible to appropriately control the critical value of the pressure of meniscus in the opening of the filter so that the pressure of the meniscus of the opening of the filter does not exceed the critical value of the pressure of meniscus of the nozzle of the print head, and thus prevent the discharge nozzle from sucking air. Also, it is possible to adjust the negative pressure generated in the ink absorbing body to be smaller than the critical value of the negative pressure of the ink meniscus in the opening of the filter. Thus, it is possible to prevent entry of air into the ink supplying path due to breakage of ink meniscus formed on the opening of the filter. Accordingly, this structure can prevent entry of air into the ink supplying path by other factor than decreases of ink remaining amount, thus avoiding error operation in detecting the remaining amount of ink. With this function, it is possible to carry out printing with high image quality.

Therefore, with the foregoing arrangements, it is possible to provide an image forming apparatus with an ink supplying system designed to prevent defects upon continuous discharge of ink, such as entry of air into the ink supplying system before the ink is depleted, and also designed with an account of characteristics of the ink.

Further, with the foregoing arrangements, it is possible to set the negative pressure when the ink is supplied (including the time when the ink is supplied due to depletion of ink) by specifying the filtration accuracy F(m). with small variation, thus ensuring more stable negative pressure.

The foregoing image forming apparatus preferably satisfies:

$$4\cdot\eta/D_N-|Ph|>4\cdot\eta/F'>|P\mu|+|Pi|$$

(F'=F when an opening of the filter is circle; $F'=\sqrt{2}\cdot F$ in other cases)

where $D_N$(m) expresses a diameter of the nozzle of the print head; and Ph (Pa) expresses a head pressure between an ink discharging throat of the nozzle and an ink supplying throat of the ink containing section.

With the foregoing arrangement, when ink is supplied, it is possible to appropriately control the critical value of the pressure of meniscus in the opening of the filter so that the pressure of the meniscus of the opening of the filter does not exceed the critical value of the pressure of meniscus of the nozzle of the print head, and thus prevent the discharge nozzle from sucking air. Also, it is possible to adjust the negative pressure generated in the ink absorbing body to be smaller than the critical value of the negative pressure of the ink meniscus in the opening of the filter. Thus, it is possible to prevent entry of air into the ink supplying path due to breakage of ink meniscus formed on the opening of the filter. Accordingly, this structure can prevent entry of air into the ink supplying path by other factor than decreases of ink remaining amount, thus avoiding error operation in detecting the remaining amount of ink. With this function, it is possible to carry out printing with high image quality.

Therefore, with the foregoing arrangements, it is possible to provide an image forming apparatus with an ink supplying system designed to prevent defects upon continuous discharge of ink, such as entry of air into the ink supplying system before the ink is depleted, and also designed with an account of characteristics of the ink.

Further, with the foregoing arrangements, it is possible to set the negative pressure when the ink is supplied (including the time when the ink is supplied due to depletion of ink) by specifying the filtration accuracy F(m). with small variation, thus ensuring more stable negative pressure.

Further, the foregoing image forming apparatus preferably further includes: a detector (for example, detecting electrodes which detect stoppage of a current flowing between themselves as an indication of depletion of ink) for detecting whether or not the ink remains in the ink supplying path.

With the foregoing arrangement, it is possible to adjust the negative pressure generated in the ink absorbing body to be smaller than the critical value of the negative pressure of the ink meniscus in the opening of the filter. Thus, it is possible to prevent entry of air into the ink supplying path due to breakage of ink meniscus formed on the opening of the filter. Accordingly, this structure can prevent entry of air into the ink supplying path by other factor than decreases of ink remaining amount (other time than when the ink is depleted), thus avoiding error operation in detecting the remaining amount of ink. With this function, it is possible to carry out printing with high image quality.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, comprising:

an ink containing section for retaining ink; and an ink supplying path for supplying the ink from the ink containing section to a print head, wherein:

the ink supplying path therein includes a filter, which generates negative pressure when the ink is supplied, the negative pressure being smaller than ink absorbing pressure of a nozzle of the print head, wherein:

the ink containing section therein includes a porous ink absorbing body for retaining ink, the image forming apparatus satisfies:

$$4\cdot\eta/D_N-|Ph|>4\cdot\eta/F'>|P\mu|+|Pi|$$

$$P\mu=(k/A)\square\{\mu\cdot L\cdot(N\cdot R)^2/S\}\cdot Q$$

(where the coefficient (k/A)=485, F'=F when an opening of the filter is circle; $F'=\sqrt{2}\cdot F$ in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

2. An image forming apparatus, comprising:

an ink containing section for retaining ink; and an ink supplying path for supplying the ink from the ink containing section to a print head, wherein:

the ink supplying path therein includes a filter, which generates negative pressure when the ink is supplied, the negative pressure being smaller than ink absorbing pressure of a nozzle of the print head, wherein:

the ink containing section therein includes a porous ink absorbing body for retaining ink, the ink absorbing body being compressed before the ink absorbing body is contained in the ink containing section, the image forming apparatus satisfies:

$$4\cdot\eta/D_N-|Ph|>4\cdot\eta/F'>|P\mu|+|Pi|$$

$$P\mu=(k/A)\cdot\{\mu\cdot L\cdot(N'\cdot R')^2/S\}\cdot Q$$

(where the coefficient (k/A)=485, F'=F when an opening of the filter is circle; $F'=\sqrt{2}\cdot F$ in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N' (cells/m) expresses a cell density of the ink absorbing body before the ink absorbing body is compressed; R' expresses a compressibility which is a volume ratio of the ink absorbing body when the ink absorbing body is compressed to the ink absorbing body before the ink absorbing body is compressed; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

3. An image forming apparatus, comprising:

an ink containing section for retaining ink; and an ink supplying path for supplying the ink from the ink containing section to a print head, wherein:

the ink supplying path therein includes a filter, which generates a negative pressure of not more than 2.0 kPa, which is applied to the ink supplying path when the ink is supplied, wherein:

the ink containing section therein includes a porous ink absorbing body for retaining ink, and the image forming apparatus satisfies:

$$4\cdot\eta/D_N-|Ph|>4\cdot\eta/F'>|P\mu|+|Pi|$$

$$P\mu=(k/A)\cdot\{\mu\cdot L\cdot(N\cdot R)^2/S\}\cdot Q$$

(where the coefficient (k/A)=485, F'=F when an opening of the filter is circle; $F'=\sqrt{2}\cdot F$ in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

4. An image forming apparatus, comprising:

an ink containing section for retaining ink; and an ink supplying path for supplying the ink from the ink containing section to a print head, wherein:

the ink supplying path therein includes a filter, which generates a negative pressure of not more than 2.0 kPa, which is applied to the ink supplying path when the ink is supplied, wherein:

the ink containing section therein includes a porous ink absorbing body for retaining ink, the ink absorbing body being compressed before the ink absorbing body is contained in the ink containing section, the image forming apparatus satisfies:

$$4\cdot\eta/D_N-|Ph|>4\cdot\eta/F'>|P\mu|+|Pi|$$

$$P\mu=(k/A)\cdot\{\mu\cdot L\cdot(N'\cdot R')^2/S\}\cdot Q$$

(where the coefficient (k/A)=485, F'=F when an opening of the filter is circle; F'=$\sqrt{2}$·F in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N' (cells/m) expresses a cell density of the ink absorbing body before the ink absorbing body is compressed; R' expresses a compressibility which is a volume ratio of the ink absorbing body when the ink absorbing body is compressed to the ink absorbing body before the ink absorbing body is compressed; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

5. An image forming apparatus, comprising:

an ink containing section for retaining ink; and an ink supplying path for supplying the ink from the ink containing section to a print head, the ink supplying path therein including a filter, wherein:

the image forming apparatus satisfies:

$$F'=4\eta/Pm$$

$$Pm\leqq 2000$$

(F'=F when the opening of the filter is circle; F'=$\sqrt{2}$·F in other cases)

where F(m) expresses a filtration accuracy of the filter; η (N/m) expresses a surface tension of the ink; and Pm (Pa) expresses a critical pressure of a negative pressure generated in the filter when the ink is supplied.

6. The image forming apparatus as set forth in claim 5, wherein:

the ink containing section therein includes a porous ink absorbing body for retaining ink, the image forming apparatus satisfies:

$$F'<1/(N\cdot R)$$

(F'=F when an opening of the filter is circle; F'=$\sqrt{2}$·F in other cases)

where F(m) expresses a filtration accuracy of the filter; N (cells/m) expresses a cell density of the ink absorbing body before the ink absorbing body is contained in the ink containing section; and R expresses a compressibility, which is a volume ratio of the ink absorbing body when the ink absorbing body is contained in a compressed state in the ink containing section to the ink absorbing body before the ink absorbing body is contained in the ink containing section.

7. The image-forming apparatus as set forth in claim 6, wherein the image forming apparatus satisfies:

$$D_N<F'<1/(N\cdot R)$$

(F'=F when the opening of the filter is circle; F'=$\sqrt{2}$·F in other cases)

where $D_N$(m) expresses a diameter of the nozzle of the print head.

8. The image forming apparatus as set forth in claim 5, wherein:

the ink containing section therein includes a porous ink absorbing body for retaining ink, the ink absorbing body being compressed before the ink absorbing body is contained in the ink containing section, the image forming apparatus satisfies:

$$F'<1/(N'\cdot R')$$

(F'=F when the opening of the filter is circle; F'=$\sqrt{2}$·F in other cases)

where F(m) expresses a filtration accuracy of the filter; N' (cells/m) expresses a cell density of the ink absorbing body before the ink absorbing body is compressed; and R' expresses a compressibility, which is a volume ratio of the ink absorbing body when the ink absorbing body is compressed to the ink absorbing body before the ink absorbing body is compressed.

9. The image-forming apparatus as set forth in claim 8, wherein:

the image forming apparatus satisfies:

$$D_N<F'<1/(N'\cdot R')$$

(F'=F when the opening of the filter is circle; F'=$\sqrt{2}$·F in other cases)

where $D_N$(m) expresses a diameter of the nozzle of the print head.

10. The image forming apparatus as set forth in claim 5, wherein:

the ink containing section therein includes a porous ink absorbing body for retaining ink, the image forming apparatus satisfies:

$$4\cdot\eta/D_N-|Ph|>4\cdot\eta/F'>|P\mu|+|Pi|$$

$$P\mu=(k/A)\cdot\{\mu\cdot L\cdot(N\cdot R)^2/S\}\cdot Q$$

(where the coefficient (k/A)=485, F'=F when an opening of the filter is circle; F'=$\sqrt{2}$·F in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

11. The image forming apparatus as set forth in claim 5, wherein:

the ink containing section therein includes a porous ink absorbing body for retaining ink, the ink absorbing body being compressed before the ink absorbing body is contained in the ink containing section, the image forming apparatus satisfies:

$$4\cdot\eta/D_N-|Ph|>4\cdot\eta/F'>|P\mu|+|Pi|$$

$$P\mu=(k/A)\cdot\{\mu\cdot L\cdot(N'\cdot R')^2/S\}\cdot Q$$

(where the coefficient (k/A)=485, F'=F when an opening of the filter is circle; $F'=\sqrt{2}\cdot F$ in other cases), where Ph (Pa) expresses a head pressure between an ink discharging throat of the nozzle of the print head and an ink supplying throat of the ink containing section; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; F(m) expresses a filtration accuracy of the filter; $D_N$(m) expresses a diameter of the nozzle of the print head; η (N/m) expresses a surface tension of the ink; N' (cells/m) expresses a cell density of the ink absorbing body before the ink absorbing body is compressed; R' expresses a compressibility which is a volume ratio of the ink absorbing body when the ink absorbing body is compressed to the ink absorbing body before the ink absorbing body is compressed; S ($m^2$) expresses a cross-sectional area of the ink absorbing body when the ink absorbing body is contained in the ink containing section in a compressed state; and L expresses a length (m) of the ink absorbing body when the ink absorbing body is contained in the ink containing section in a compressed state.

12. The image forming apparatus as set forth in claim 5, further comprising:

a removable ink cartridge, wherein:

the ink containing section is provided in the ink cartridge, and therein includes a porous ink absorbing body for retaining ink, the image forming apparatus satisfies:

$$\eta\cdot N\cdot R\cdot B>2\cdot\gamma\cdot h$$

(coefficient $B=4.08\times10^{-4}$)

where η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; h(m) expresses a head height of the ink, which is a maximum height of the ink containing section under an arbitrary orientation and is relative to the ink supplying throat in the vertical direction; and γ expresses a specific gravity of the ink.

13. The image forming apparatus as set forth in claim 5, further comprising:

a removable ink cartridge, wherein:

the ink containing section is provided in the ink cartridge, and therein includes a porous ink absorbing body for retaining ink, the ink absorbing body being compressed before the ink absorbing body is contained in the ink containing section, and the image forming apparatus satisfies:

$$\eta\cdot N'\cdot R'\cdot B>2\cdot\gamma\cdot h$$

(coefficient $B=4.08\times10^{-4}$)

where η (N/m) expresses a surface tension of the ink; N' (cells/m) expresses a cell density of the ink absorbing body before the ink absorbing body is compressed; R' expresses a compressibility which is a volume ratio of the ink absorbing body when the ink absorbing body is compressed to the ink absorbing body before the ink absorbing body is compressed; h(m) expresses a head height of the ink, which is a maximum height of the ink containing section under an arbitrary orientation and is relative to the ink supplying throat in the vertical direction; and γ expresses a specific gravity of the ink.

14. The image forming apparatus as set forth in claim 5, further comprising:

a detector for detecting whether or not the ink remains in the ink supplying path.

15. An image forming apparatus, comprising:

an ink containing section including a porous ink absorbing body for retaining ink; and an ink supplying path for supplying the ink from the ink containing section to a print head, wherein:

the ink supplying path therein includes a filter, and the image forming apparatus satisfies:

$$4\cdot\eta/F'>|P\mu|+|Pi|$$

$$P\mu=(k/A)\cdot\{\mu_{TK}\cdot L\cdot(N\cdot R)^2/S\}\cdot Q$$

(where the coefficient (k/A)=485)

$$\mu_{TK}=\alpha\cdot\exp(\beta/T_K),$$

$$\alpha=\mu_{25}/\exp(\beta/298),$$

$$\beta=Ln\{0.42\cdot Ln(\mu_{25})+4.71\}/(1/273-1/298)$$

($F'=F$ when an opening of the filter is circle; $F'=\sqrt{2}\cdot F$ in other cases)

where F(m) expresses a filtration accuracy of the filter; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; η (N/m) expresses a surface tension of the ink; N (cells/m) expresses a cell density of the ink absorbing body before the ink absorbing body is contained in the ink containing section; R expresses a compressibility which is a volume ratio of the ink absorbing body when the ink absorbing body is contained in the ink containing section in a compressed state to the ink absorbing body before the ink absorbing body is contained in the ink containing section; S ($m^2$) expresses a cross-sectional area of the ink absorbing body when the ink absorbing body is contained in the ink containing section in a compressed state; L expresses a length (m)

of the ink absorbing body when the ink absorbing body is contained in the ink containing section in a compressed state; $\mu_{25}$ (Pa·s) expresses an ink viscosity at 25° C.; and $\mu_{TK}$ (Pa·s) expresses a viscosity at an arbitrary temperature $T_K$ (K).

16. The image forming apparatus as set forth in claim 15, wherein:

the image forming apparatus satisfies:

$$4\cdot\eta/D_N-|Ph|>4\cdot\eta/F'>|P\mu|+|Pi|$$

(F'=F when an opening of the filter is circle; $F'=\sqrt{2}\cdot F$ in other cases)

where $D_N$(m) expresses a diameter of the nozzle of the print head; and Ph (Pa) expresses a head pressure between an ink discharging throat of the nozzle and an ink supplying throat of the ink containing section.

17. The image forming apparatus as set forth in claim 15, further comprising:

a detector for detecting whether or not the ink remains in the ink supplying path.

18. An image forming apparatus, comprising:

an ink containing section including a porous ink absorbing body for retaining ink; and an ink supplying path for supplying the ink from the ink containing section to a print head, wherein:

the ink containing section therein includes a porous ink absorbing body for retaining ink, the ink absorbing body being compressed before the ink absorbing body is contained in the ink containing section, and the image forming apparatus satisfies:

$$4\cdot\eta/F'>|P\mu|+|Pi|$$

$$P\mu=(k/A)\cdot\{\mu_{TK}\cdot L\cdot(N'\cdot R')^2/S\}\cdot Q$$

(where the coefficient (k/A)=485)

$$\mu_{TK}=\alpha\cdot\exp(\beta/T_K),$$

$$\alpha=\mu_{25}/\exp(\beta/298),$$

$$\beta=Ln\{0.42\cdot Ln(\mu_{25})+4.71\}/(1/273-1/298)$$

(F'=F when an opening of the filter is circle; $F'=\sqrt{2}\cdot F$ in other cases)

where F(m) expresses a filtration accuracy of the filter; Pi (Pa) expresses a head pressure of the ink containing section which occurs when the ink is going to be supplied to the print head via the ink supplying throat when the ink containing section is filled with the ink; Pμ (Pa) expresses a pressure loss due to a viscosity resistance of the ink containing section; η (N/m) expresses a surface tension of the ink; N' (cells/m) expresses a cell density of the ink absorbing body before the ink absorbing body is compressed; and R' expresses a compressibility, which is a volume ratio of the ink absorbing body when the ink absorbing body is compressed t o the ink absorbing body before the ink absorbing body is compressed; S ($m^2$) expresses a cross-sectional area of the ink absorbing body when the ink absorbing body is contained in the ink containing section in a compressed state; L expresses a length (m) of the ink absorbing body when the ink absorbing body is contained in the ink containing section in a compressed state; $\mu_{25}$ (Pa·s) expresses an ink viscosity at 25° C.; and $\mu_{TK}$ (Pa·s) expresses a viscosity at an arbitrary temperature $T_K$ (K).

19. The image forming apparatus as set forth in claim 18, wherein:

the image forming apparatus satisfies:

$$4\cdot\eta/D_N-|Ph|>4\cdot\eta/F'>|P\mu|+|Pi|$$

where $D_N$(m) expresses a diameter of the nozzle of the print head; and Ph (Pa) expresses a head pressure between an ink discharging throat of the nozzle and an ink supplying throat of the ink containing section.

20. The image forming apparatus as set forth in claim 18, further comprising:

a detector for detecting whether or not the ink remains in the ink supplying path.

* * * * *